US007259740B2

(12) United States Patent
Haga et al.

(10) Patent No.: US 7,259,740 B2
(45) Date of Patent: Aug. 21, 2007

(54) DISPLAY DEVICE AND SEMICONDUCTOR DEVICE

(75) Inventors: Hiroshi Haga, Tokyo (JP); Kenichi Takatori, Tokyo (JP); Hideki Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 274 days.

(21) Appl. No.: 10/261,584

(22) Filed: Oct. 2, 2002

(65) Prior Publication Data

US 2003/0067434 A1 Apr. 10, 2003

(30) Foreign Application Priority Data

Oct. 3, 2001 (JP) ..... 2001-307398
May 17, 2002 (JP) ..... 2002-142536

(51) Int. Cl.
*G09G 3/36* (2006.01)

(52) U.S. Cl. ..... 345/98; 345/89; 345/100; 345/205

(58) Field of Classification Search ..... 345/87–103, 345/204–205, 208–210, 690
See application file for complete search history.

(56) References Cited

U.S. PATENT DOCUMENTS 5,093,655 A * 3/1992 Tanioka et al. ..... 345/96

(Continued)

FOREIGN PATENT DOCUMENTS

CN 1099887 A 3/1995

(Continued)

*Primary Examiner*—Lun-Yi Lao
(74) *Attorney, Agent, or Firm*—Sughrue Mion, PLLC

(57) ABSTRACT

A display device of high definition, multiple colors and low power consumption includes a display panel having a pixel section in which pixels are arrayed in the form of a matrix at the cross points of a plurality of data lines and a plurality of scanning lines, a scanning circuit for applying voltage sequentially to the plurality of scanning lines, and a data-line driver, which receives display data supplied by a host device, for applying signals corresponding to the display data to the plurality of data lines. Provided external to the display panel is a controller IC having a display memory for storing display data corresponding to the pixel section, an output buffer for reading data out of the display memory and outputting this data to the display panel, and a controller for controlling the display memory and output buffer and communication with the host device. The display panel is provided with a digital/analog converter, which forms part of the data-line driver, for converting display data represented by a digital signal to an analog signal. The width of a bus for data transfer between the controller IC and data-line driver of the display panel is such that data of a greater number of bits is transferred in parallel by a single transfer than is transferred by the bus between the controller and the host device. This allows the operating frequency of the data-line driver to be reduced.

3 Claims, 50 Drawing Sheets

U.S. PATENT DOCUMENTS 5,168,270 A * 12/1992 Masumori et al. ..... 345/100
5,414,443 A * 5/1995 Kanatani et al. ..... 345/95
5,748,165 A * 5/1998 Kubota et al. ..... 345/96
6,028,587 A * 2/2000 Igari ..... 345/597
6,147,667 A * 11/2000 Yamazaki et al. ..... 345/92
6,157,358 A * 12/2000 Nakajima et al. ..... 345/96
6,331,844 B1 * 12/2001 Okumura et al. ..... 345/87
6,424,328 B1 * 7/2002 Ino et al. ..... 345/87
6,429,838 B1 * 8/2002 Go ..... 345/87
6,603,465 B1 * 8/2003 Hashimoto et al. ..... 345/204
6,693,616 B2 * 2/2004 Koyama et al. ..... 345/98
6,717,179 B1 * 4/2004 Yamazaki et al. ..... 257/59

FOREIGN PATENT DOCUMENTS

JP 6-324643 A 11/1994
JP 11-202290 * 7/1999
JP 11-202290 A 7/1999
WO WO 00/23977 4/2000

* cited by examiner

DISPLAY DEVICE AND SEMICONDUCTOR DEVICE

FIELD OF THE INVENTION

This invention relates to a display device used in a projector, a notebook personal computer, a monitor, a cellular phone and a personal digital assistant, etc. More particularly, the invention relates to a voltage-driven display device and current-driven display device such as a liquid crystal display device.

BACKGROUND OF THE INVENTION

As the era of multimedia has progressed, so has the rapid spread of display devices. These find use in small-size applications such as the viewfinders of projectors and video cameras as well as cellular phones, in mid-size applications such as the display panels of vehicular televisions and navigation systems as well as mobile terminals such as personal digital assistants (PDAs) and pocket personal computers, and in large-size applications such as notebook personal computers and monitors. Among these display devices, liquid crystal display devices presently are being applied to the largest group of products. In particular, active-matrix liquid crystal devices driven by thin-film transistors (abbreviated to "TFT" below) are the dominant liquid crystal display devices because they exhibit a resolution and image quality that are superior to those of simple matrix-type liquid crystal display devices. TFTs are classified as amorphous silicon TFTs and polysilicon TFTs depending upon a difference in the semiconductor material used.

Amorphous silicon TFT does not require a high-temperature fabrication process. This makes it possible to fabricate a panel using a substrate such as glass.

Because polysilicon TFTs conventionally require a high-temperature process, they necessitate expensive quartz substrates and are limited to small-size panels of high added value. Owing to advances in techniques such as laser annealing in recent years, technology has been developed that makes it possible to form a precursor film by low-pressure (LP) CVD, plasma (P) CVD or sputtering, etc., subject the film to polycrystallization by laser annealing and form a polysilicon TFT at low temperature that allows use of a glass substrate or the like. Mid-size display panels and display panels for notebook personal computers also can now be fabricated using polysilicon TFTs.

In comparison with amorphous silicon TFT, a polysilicon TFT has a mobility that is higher by an order of magnitude and exhibits a higher current driving capability.

When a liquid crystal display device is constructed using polysilicon TFTs, the fact that such a TFT has a high current driving capability enables the integration of peripheral circuitry on the same substrate as the pixels. As a consequence, it is possible to realize a reduction in the number of LSI elements, a reduction in size and a reduction in packaging cost.

A liquid crystal display device in which peripheral circuitry is integrated with the same substrate as the pixels is referred to as a "combined driver circuit and liquid crystal display device".

The most popular type of combined driver circuit and liquid crystal display device has, as the peripheral circuitry, a data driver that drives the data line connected to the source terminals of the pixel TFTs, and a gate driver that drives the gate lines connected to the gate terminals of the pixel TFTs. Such liquid crystal display devices find wide use in liquid crystal projectors, which require small, high-definition LCDs, and in portable notebook personal computers that require a picture frame of reduced size.

With a driver device in a conventional liquid crystal display in which the driver circuits are not integrated with the substrate, a group of gate driver LSI chips, a controller and a DC-DC converter are provided on a TCP (Tape Carrier Package) and a flexible circuit board or connection circuit board. With this structure, packaging becomes more complicated as definition and tonality increase, and an increase in the size of the picture frame cannot be avoided. At the same time, the problem of EMI (Electromagnetic Interference) becomes more pronounced owing to higher frequency. For this reason, great endeavors have been made to deal with the noise problem. These include reinforcing the ground wiring of the printed circuit board used, altering the arrangement of component materials on the printed circuit board, changing the routing of wiring, adding on EMI filters and improving interfaces.

By contrast, the integrated type of driver circuits in which the peripheral circuits are integrated on the same substrate lends itself to easy packaging and the size of the picture frame does not change much even if higher definition and tonality are provided. Such a device is extremely effective for use in mobile applications.

FIG. 37 is a diagram illustrating an overview of a display system that employs a liquid crystal display device integral with driver circuits according to the prior art. In this conventional combined driver circuit and liquid crystal display device, as shown in FIG. 37, an active-matrix display area 110, in which pixels of M rows and N columns are arranged the form of a matrix, a row-direction scanning circuit [scanning-line (gate-line) driver circuit] 109, a column-direction scanning circuit (data-line driver circuit) 3504, an analog switch 3505 and a level shifter 3503 are formed integrally by polysilicon TFTs on a display device substrate 101.

A controller 113, a memory 111, a digital/analog converter (DAC) 3502, a scanning-line/data register 3501 and an interface circuit 114, etc., are formed external to the display device substrate 101 using monocrystalline silicon circuits (LSI circuits).

The analog switch 3505 has outputs the number of which is the same as the number N of column-direction data lines of the active-matrix display area 110.

The conventional combined driver circuit and liquid crystal display devices also include devices of the type having more complicated built-in circuits, such as DACs. FIG. 38 is a diagram illustrating an overview of a display system that employs a liquid crystal display device integral with driver circuits and having a built-in DAC according to the prior art. In the conventional liquid crystal display device having the built-in DAC, the following circuits are formed on the display device substrate 101 in addition to the active-matrix display area 110, in which pixels of M rows and N columns are wired in the form of a matrix, the row-direction scanning circuit 109 and a column-direction scanning circuit 3506 similar to those of the device in FIG. 37 not having the built-in DAC: a data register 3507, a latch circuit 105, a DAC circuit 106, a selector circuit 107, a level shifter/timing buffer 108 and a level shifter.

According to this arrangement, the controller IC having an internal memory does not include the DAC; the memory 111, an output buffer 112 and the controller 113 are all implemented by digital circuits. As a result, fabrication is possible without making joint use of a process for analog circuits. This means that the IC can be fabricated at a cost lower than that the above-mentioned driver IC having the internal memory.

The liquid crystal display device set forth above is thin and light and consumes less power than a CRT (cathode-ray tube). This feature is exploited to mount the liquid crystal display device on mobile information processing equipment.

Owing to the rapid spread of mobile terminals such as cellular phones, PDAs and mobile personal computers in recent years, there is increasing demand for displays used in mobile applications. A display for use in such mobile terminals must satisfy the following requirements:

(a) The area of the device, with the exception of the display, must be reduced in order to enhance portability.

(b) Mobile terminals generally are powered by batteries. Low power consumption is desired, therefore, in order to prolong continuous operating time provided by a single charge.

(c) Since a low price is necessary in order for mobile terminals to become more widespread, it is desired that mobile displays also be reduced in cost.

It is expected that these requirements can be implemented by a combined driver circuit and liquid crystal display device and by an organic EL (electroluminescence) device, etc.

The specification of Japanese Patent Kokai Publication JP-A-11-202290 discloses a device so adapted as to lower the power consumption, reduce the size and improve the definition of a liquid crystal display having built-in peripheral circuits. The device is such that a peripheral circuit on the signal side and a peripheral circuit on the scanning side for driving liquid crystal, as well as a connecting portion having a relay bus for transferring display data to signal wiring, are formed on a TFT substrate, and an image memory chip, which is formed to include a read-out control circuit and an image memory for storing at least one line of image data read in from a CPU via the connecting portion, is mounted on a liquid crystal display device. Display data from the image memory chip is transferred in parallel one line at a time in response to a low-speed clock.

SUMMARY OF THE DISCLOSURE

The conventional display device set forth above has a number of problems.

A first problem is that an increase in the cost of the driver IC and an increase in power consumption accompany an improvement in definition and tonality of the display.

The reason for this is that the display data for all pixels must be transferred serially to the liquid crystal module at high-speed frame by frame. The higher the definition and the greater the number of pixels, the higher the transfer rate becomes. As a result of high-speed data transfer, the driver IC also is required to exhibit high speed, short circuit current from a higher potential power supply to a lower potential power supply is produced in the large number of CMOS elements that constitute the circuit elements, and therefore power consumption increases with a rise in operating speed. Further, an IC that operates at high speed also is high in price. When there is an increase in the number of tones, this necessitates more complicated circuitry and even higher transfer speed, thereby inviting greater power consumption and higher cost. Further, as mentioned above, an IC having an internal DAC and the like necessitates the combined use of different fabrication processes. This also leads to an increase in cost.

A second problem is that a limitation is imposed upon the number of pixels and the number of tones (gray-scales) owing to the need to suppress the overall power consumption and price of the system.

The reason for this is that power consumed by the driver IC increases when there is an increase in the number of pixels and tones, as mentioned above.

A third problem is reliability, which is related to high-frequency operation.

The reason for this is that TFT characteristics tend to change when a low-temperature polysilicon TFT is operated at high speed.

A fourth problem is that since the voltage used differs for every circuit block on the display panel substrate, it is necessary to make joint use of fabrication processes corresponding to a plurality of voltages.

Furthermore, the problem of EMI becomes particularly acute when the frequency of the input signal is high. The reason for this is that a source driver IC is driven using the input frequency per se. As a result, there is an increase in spurious electric waves produced from the square wave of the driver circuit to increase EMI noise. This means that greater endeavors must be made to deal with EMI, as mentioned above.

If the EMI noise level is made sufficiently low, the device can pass various standard tests with ease. Not only is reliability improved but it also becomes possible to lower cost relating to EMI-related tests.

Accordingly, it is an object of the present invention to provide a display device for realizing a high-definition, multicolor display at lower cost and with reduced power consumption.

Another object of the present invention is to provide a display device of enhanced reliability.

A further object of the present invention is to provide a display device that suppresses the effects of EMI.

A further object of the present invention is to provide a combined driver circuit and liquid crystal display device in which all circuits can be driven by one type of voltage-related process without making combined use of processes relating to a plurality of voltages.

According to one aspect of the present invention, the foregoing objects are attained by providing a display device comprising: a display panel having a display area in which pixels are arrayed in the form of a matrix at cross points of a plurality of data lines and a plurality of scanning lines; a scanning-line driver circuit for applying voltage sequentially to the plurality of scanning lines; a data-line driver circuit, which receives display data supplied by a host device, for applying signals corresponding to the display data to the plurality of data lines; a controller unit provided externally of the display panel and having a display memory for storing display data, an output buffer for reading data out of the display memory and outputting this data to the display panel, and a controller for controlling the display memory and the output buffer as well as managing communication and control with the host device; and a digital/analog converter circuit (referred to as a "DAC" below), which forms part of the data-line driver circuit, for converting display data represented by a digital signal, which has been transferred from the controller IC, to an analog signal; wherein width of a bus for data transfer between the controller IC and the display panel is such that data of a greater number of bits is transferred in parallel by a single transfer than is transferred by a bus between the controller and the host device. In the present invention, enlarging the bus width of the data transfer reduces the operating frequency of the data-line driver circuit. As a result, the transistor elements that construct peripheral circuits inclusive of the data-line driver circuit and scanning-line driver circuit can be formed by the same process as that used to manufacture the TFTs (thin-film transistors) that constitute the pixel switches formed on the display panel, and the film thickness of the gate insulating films of the transistor elements in the peripheral circuits can be set to be the same as film thickness of the gate insulating films of the TFTs of the pixel switches, which are driven by high voltage.

Further, according to another aspect of the present invention, the display panel is equipped with a display memory for storing display data, and a DAC for converting display data, which is represented by a digital signal, to an analog signal. In the present invention, a process identical with that used to form the TFTs of the pixel portions forms the DAC and display memory.

In accordance with the present invention, the display panel has a selector circuit, to which outputs of the DAC are input, for connecting these outputs to a group of data lines. In the present invention, the display panel has a level shifter for level shifting signal amplitude, which is decided by the power-supply voltage of the controller IC, to a high-voltage on the side of the display panel. In the present invention, the display panel is equipped with a serial/parallel converter circuit for converting serial data to parallel data, and the parallel data output from the serial/parallel converter circuit is supplied to the DAC.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

Figure 1:
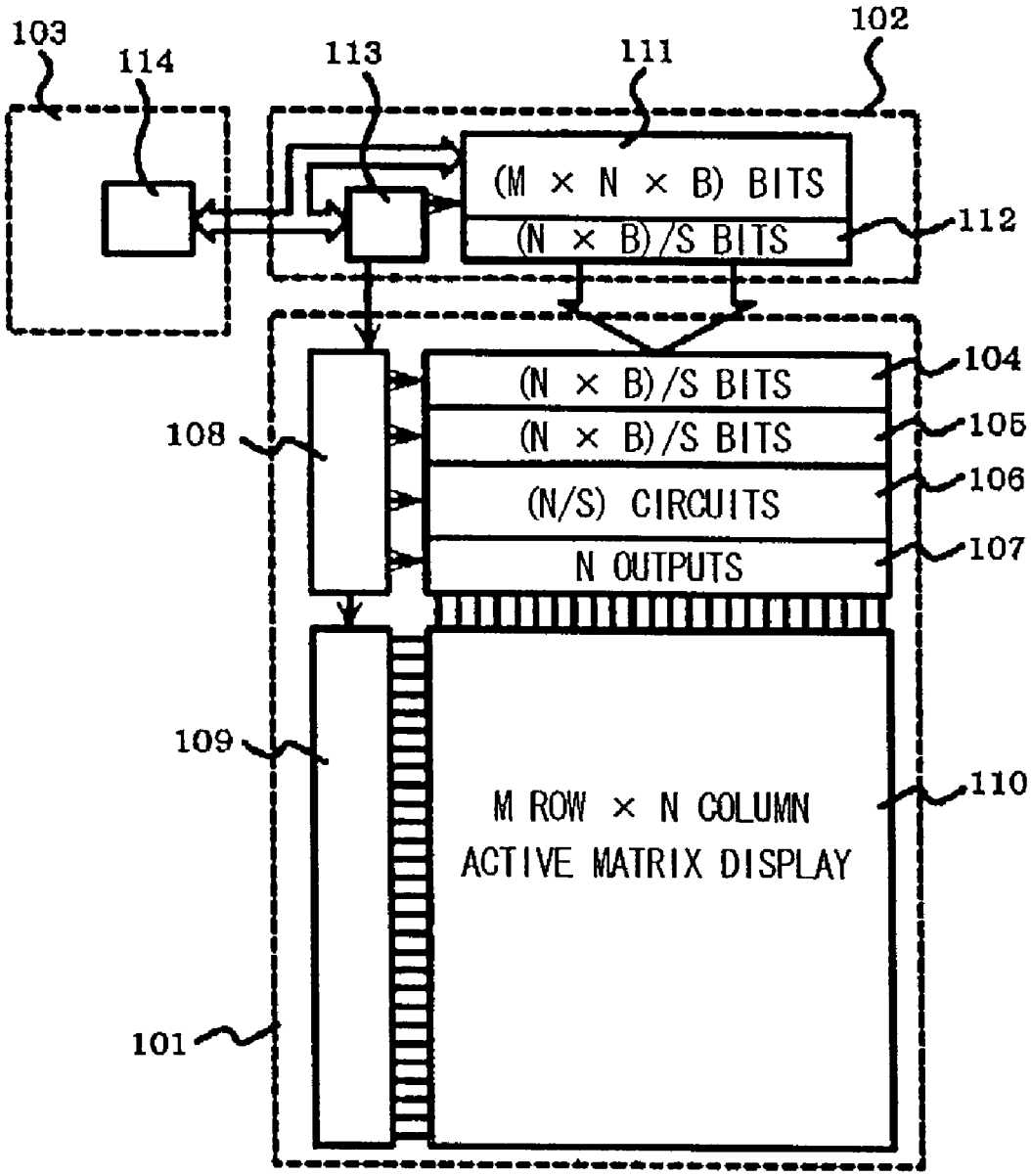
FIG. 1 is a diagram illustrating the structure of a display device according to a first embodiment of the present invention.

Preferred embodiments of the present invention will now be described.

In a first preferred embodiment of the present invention, a display device according to the present invention has a display panel having a display area (110 in FIG. 1) in which pixels are arrayed in the form of a matrix at cross points of a plurality of data lines and a plurality of scanning lines; a scanning-line driver circuit (109 in FIG. 1) for applying voltage sequentially to the plurality of scanning lines; and a data-line driver circuit, which receives display data supplied by a host device, for applying signals corresponding to the display data to the plurality of data lines. A controller IC (102 in FIG. 1) is provided externally of a display device substrate (101 in FIG. 1) and has a display memory (111 in FIG. 1) for storing display data corresponding to the pixels, an output buffer (112 in FIG. 1) for reading data out of the display memory and outputting this data to the display device substrate (101 in FIG. 1), and a controller (113 in FIG. 1) for controlling the display memory (111 in FIG. 1) and the output buffer (112 in FIG. 1) as well as managing communication and control with the host device. A digital/analog converter circuit (DAC) (106 in FIG. 1), which forms part of the data-line driver circuit, is provided on the display device substrate (101 in FIG. 1) for converting display data represented by a digital signal to an analog signal. The width of a bus for data transfer between the controller IC (102 in FIG. 1) and the display device substrate (101 in FIG. 1) is such that data of a greater number of bits is transferred in parallel by a single transfer than is transferred by a bus between the controller (113 in FIG. 1) and the host device (114 in FIG. 1).

More specifically, in a preferred embodiment of the invention, there is provided a display device having a display device substrate (101 in FIG. 1) provided with a display area (110 in FIG. 1) having pixels arrayed in M rows and N columns in the form of a matrix at cross points of a plurality (N) of data lines and a plurality (M) of scanning lines, and a controller IC (102 in FIG. 1), which is provided separately of the display device substrate (101 in FIG. 1). The controller IC has a display memory (111 in FIG. 1) for storing (M×N) pixels of B-bit grayscale display data (i.e., M×N×B bits), an output buffer (112 in FIG. 1) for reading data out of the display memory (111 in FIG. 1) and outputting this data to the display device substrate (101 in FIG. 1), and a controller (113 in FIG. 1) for controlling the display memory (111 in FIG. 1) and the output buffer (112 in FIG. 1) as well as managing communication and control with a host device.

Disposed in the controller IC (102 in FIG. 1 are (N×B)/S-number of the output buffers (112 in FIG. 1). This number is obtained by dividing (N×B) bits, which correspond to one row of bits in the (M×N×B)-number of bits of the display memory, by a block dividing number S.

One line of display data is transferred from the output buffers (112 in FIG. 1) of the controller IC (102 in FIG. 1) to the display device substrate (101 in FIG. 1) via a data bus, which has a width of (N×B)/S bits, upon being divided S (where S is the block dividing number) times in one horizontal scanning period in units of (N×B)/S bits.

The display device substrate (101 in FIG. 1) is equipped with a data-line driver circuit having a level shifter for level-shifting the amplitude of a signal received from the data bus to a signal having a higher amplitude, a latch circuit for latching an output of the level shifter, a DAC (106 in FIG. 1), to which B-bit outputs of the latch circuits are supplied, for outputting an analog signal, and a selector (107 in FIG. 1) to which the output of the DAC circuit is supplied and having N-number of outputs, which is the same as the N-number of columns of the display area; and with a scanning-line driver circuit (109 in FIG. 1) for applying voltage sequentially to the plurality of scanning lines (gate lines). There are provided (N×B)/S-number of the level shifters (104 in FIG. 1), (N×B)/S-number of the latch circuits (105 in FIG. 1) and (N/S)-number of the DACs (106 in FIG. 1). The selector circuit (107 in FIG. 1) receives outputs of the (N/S)-number of DACs (106 in FIG. 1) and, on the basis of a selector control signal input thereto, supplies data signals to a group of S-number of data lines sequentially, for every output from each DAC, in a time obtained by dividing one horizontal scanning period by the block dividing number S. The controller (113 in FIG. 1) of the controller IC supplies a clock signal to a level shifter/timing buffer (108 in FIG. 1) of the display device substrate (101 in FIG. 1). A latch clock signal and the selector control signal which are boosted and output by the level shifter/timing buffer (108 in FIG. 1), are supplied to the latch circuits (105 in FIG. 1) and to the selector, respectively.

In an embodiment of the present invention, the transistor elements that construct peripheral circuits inclusive of the data-line driver circuit and scanning-line driver circuit formed on the display device substrate are formed by the same process as that used to manufacture TFTs that constitute the pixel switches formed on the display area. Preferably, the transistor elements comprise polysilicon TFTs. Specifically, the film thickness of the gate insulating films of the transistor elements constituting the data-line driver circuit and scanning-line driver circuit are set to be the same as film thickness of the gate insulating films of the TFTs of the pixel switches, which are driven by high voltage.

In an embodiment of the present invention, the scanning-line driver circuit (109 in FIG. 5) may be provided on both sides of the display area, and a level shifter/timing buffer (108 in FIG. 5) for supplying the data-line driver circuit with a clock may be provided on both sides of the display area.

Figure 6:
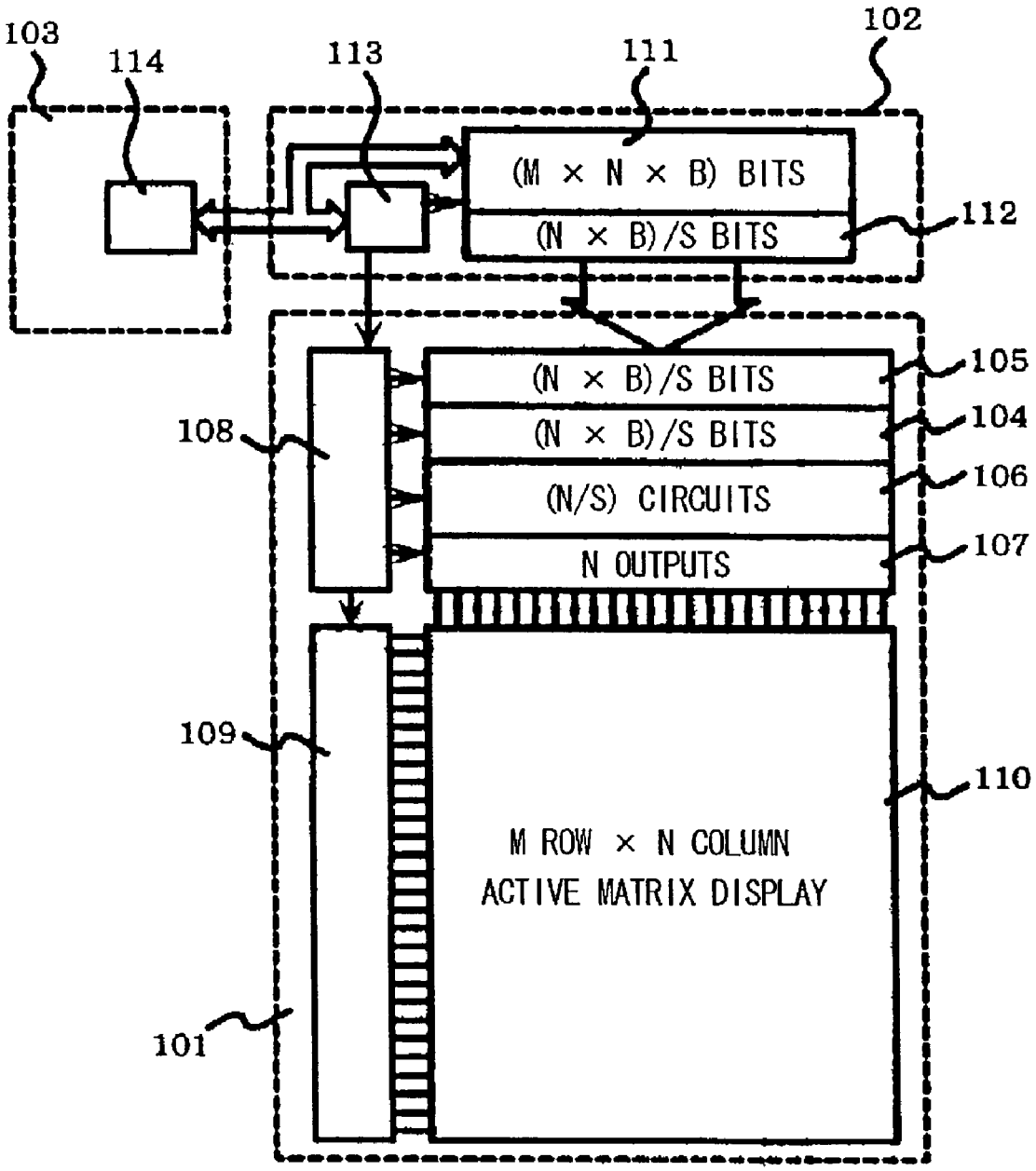

In an embodiment of the present invention, the positions of the latch circuit and level shifter fabricated on the display device substrate (101) and constructing the data-line driver circuit may be interchanged (see FIG. 6).

In an embodiment of the present invention, the amplitude of the signal in the controller IC (102 in FIG. 7) and the amplitude of the signal in the display device substrate (101 in FIG. 7) may be made the same. The level shifter may be deleted from the display device substrate (101 in FIG. 7).

Figure 10:
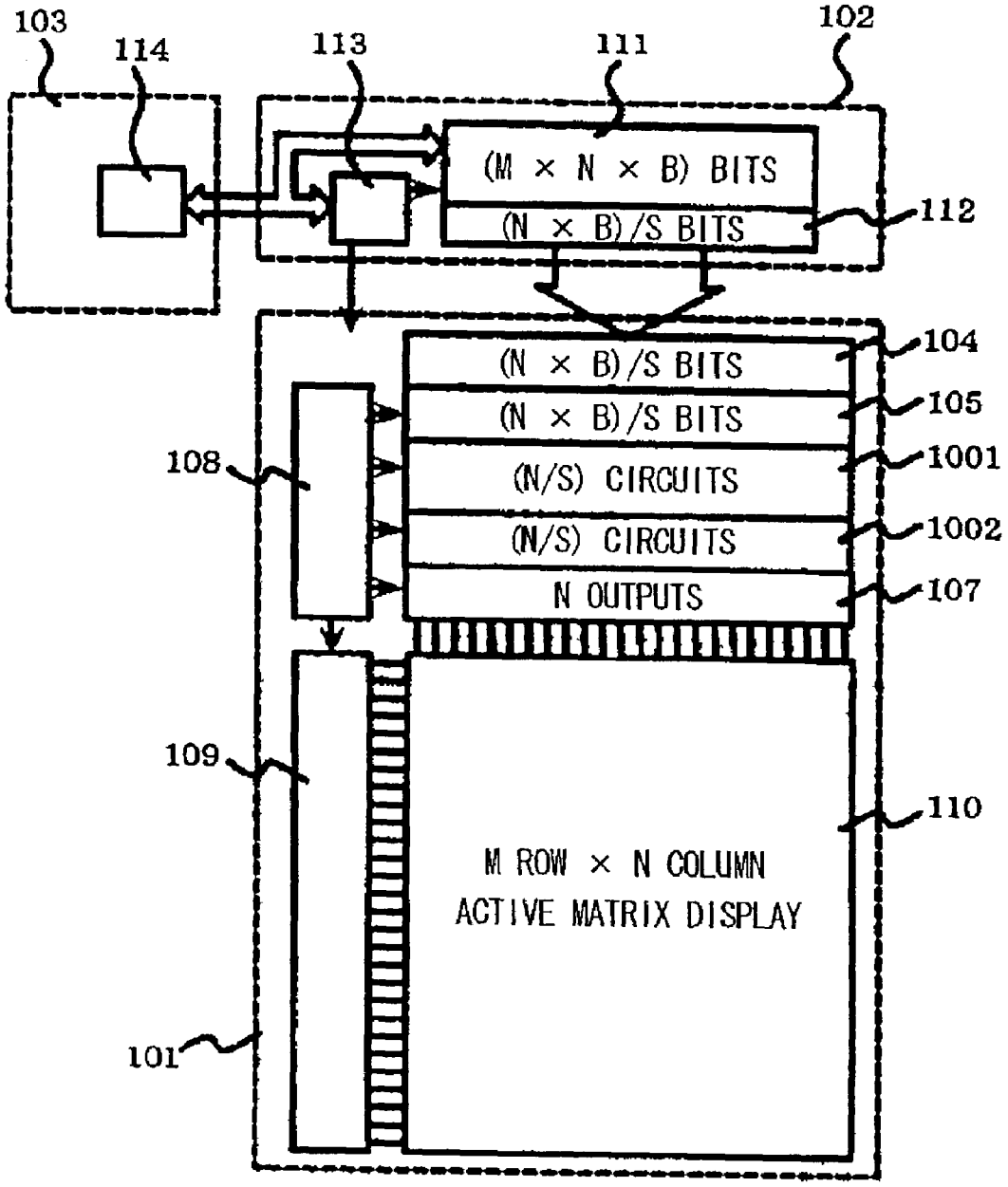
FIGS. 10 and 11 illustrate the structures of display devices according to sixth and seventh embodiments, respectively, of the present invention.
Figure 17:
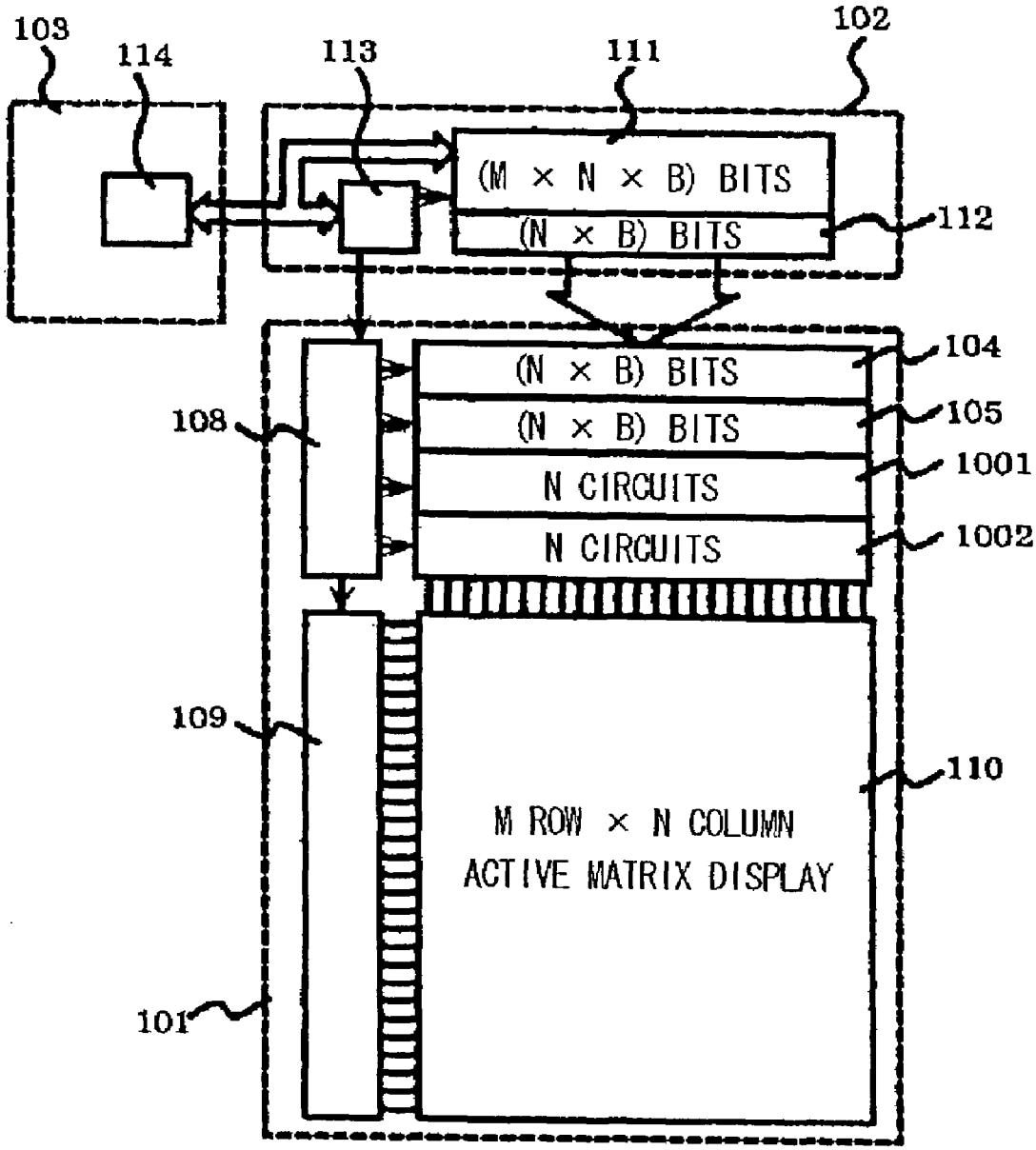
FIGS. 17 and 18 illustrate the structures of display devices according to $11^{th}$ and $12^{th}$ embodiments, respectively, of the present invention.

In order to drive current-driven-type pixels in an embodiment of the present invention, there may be provided a voltage-current converting circuit/current output buffer (801 in FIGS. 8 and 15) for generating a current corresponding to the gray level of the display data and supplying this current to a data line, as well as a decoder and a current output buffer (1001 and 1002 in FIGS. 10 and 17).

In another embodiment of carrying out the present invention, an arrangement may be adopted in which (N×B)-number of the output buffers (112 in FIGS. 11 and 13) are disposed in the controller IC (102 FIGS. 11 and 29), one line of display data is transferred by a single transfer from the controller IC to the display device substrate (101 FIGS. 11 and 13) in one horizontal scanning period in units of (N×B) bits, and N-number of the DACs (106 in FIGS. 11 and 13) are provided to correspond to the data lines. In such an arrangement, the amplitude of the signal in the controller IC (102 in FIGS. 14 and 29) and the amplitude of the signal in the display device substrate (101 in FIGS. 14 and 29) may be made the same. The level shifter may be deleted from the display device substrate (101 in FIG. 14).

In an embodiment of the present invention, an arrangement may be adopted in which the display device substrate (101) is equipped with a serial/parallel converter circuit (1801 in FIG. 18, FIGS. 20 to 23, FIGS. 25 and 26, FIGS. 28 to 30 and FIGS. 32 to 34) for converting serial data to parallel data, and the parallel data obtained by the serial/parallel converter circuit is supplied to the DACs. The operating frequency of the DACs can be reduced by supplying the input side of the DACs with data that has been converted to parallel bits by the serial/parallel converter circuit (a signal obtained by latching this data and/or a signal obtained by level-shifting this data).

In another embodiment of carrying out the present invention, the display device of the invention is such that the display panel (101 in FIGS. 33 and 34) is equipped with a DAC (106 in FIG. 33) for converting display data represented by a digital signal to an analog signal, and with a display memory (111 in FIGS. 33 and 34) for storing display data. A process identical with that used to form the TFTs of the pixel portions forms the DAC and the display memory.

Figure 33:
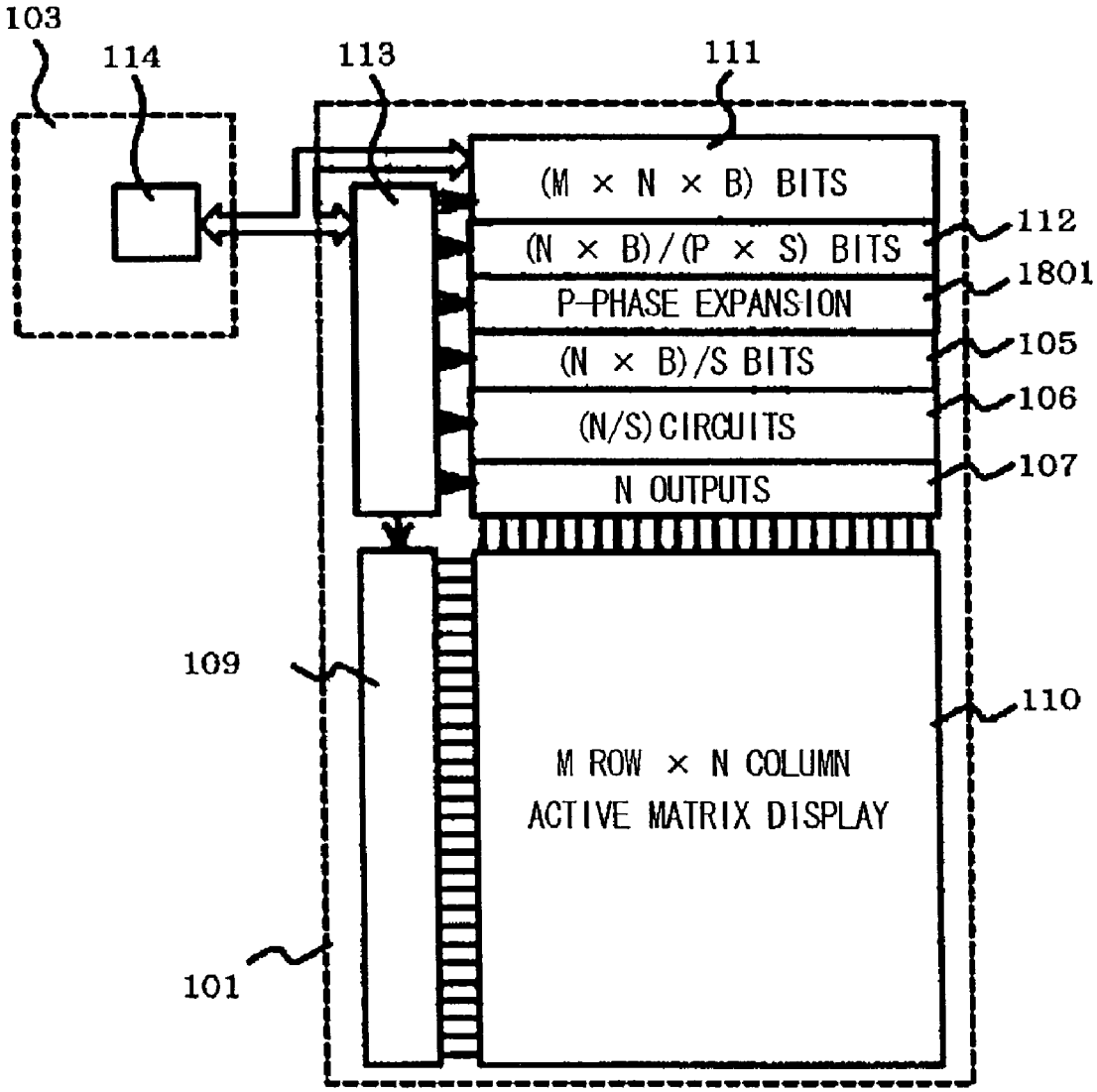

More specifically, a display device according to the present invention in another embodiment of thereof comprises the following on the same display device substrate (101 in FIG. 33: a display area (110 in FIG. 33) having pixels arrayed in M rows and N columns in the form of a matrix at cross points of a plurality (N) of data lines and a plurality (M) of scanning lines; a display memory (311 in FIG. 33) for storing (M ×N) pixels of B-bit grayscale display data (i.e., M×N×B bits); an output buffer (112 in FIG. 33) for reading data out of the display memory and outputting this data to said display device substrate; and a controller (113 in FIG. 33) for controlling the display memory (111 in FIG. 33) and the output buffer (112 in FIG. 33) as well as managing communication and control with a host device. The output buffers (112 in FIG. 33) provided are (N×B)/(P×S) in number. This number is obtained by dividing (N×B) bits, which correspond to one row of bits in the (M×N×B)-number of bits of the display memory (111 in FIG. 33), by the product of a block dividing number S and P phases.

The display device substrate (101 in FIG. 33) is equipped with a data-line driver circuit having a serial/parallel converter circuit (1801 in FIG. 33), to which the output of the output buffer (112 in FIG. 33) is serially input, for expanding this data into P phases, a latch circuit (105 in FIG. 33) for latching the output of the serial/parallel converter circuit (1801 in FIG. 33), a DAC (106 in FIG. 33), to which a B-bit output of said latch circuit is supplied, for outputting an analog signal, a selector (107 in FIG. 33) to which the output of the DAC is supplied and having N-number of outputs, which is the same as the N-number of columns of the display area; and a scanning-line driver circuit (109 in FIG. 33) for applying voltage sequentially to the plurality of scanning lines. There are provided (N×B)/(P×S)-number of the serial/parallel converter circuits (1801 in FIG. 33), (N×B)/S-number of the latch circuits (105 in FIG. 33) and (N/S)-number of the DACs (106 in FIG. 33). The selector circuits (107 in FIG. 33) receive outputs of the (N/S)-number of DACs (106 in FIG. 33) and, on the basis of a selector control signal, supply data signals to a group of S-number of data lines sequentially, for every output from each DAC, in a time obtained by division by the block dividing number S. The controller (113 in FIG. 33) supplies a latch clock signal to the latch circuits (105 in FIG. 33), supplies the selector control signal to the selector circuits (107 in FIG. 33), and supplies a serial/parallel conversion control signal to the serial/parallel converter circuits (1801 in FIG. 33).

In this embodiment, the TFTs that construct peripheral circuits inclusive of the data-line driver circuit and scanning-line driver circuit are formed by the same process as that used to manufacture the TFTs that constitute the pixel switches formed on the display area.

Preferred embodiments of the present invention will now be described in detail with reference to the drawings.

A first embodiment of the present invention will now be described with reference to FIG. 1, which illustrates the structure of a display device according to this embodiment.

As shown in FIG. 1, this embodiment includes a circuit board 103 on the system side, a controller IC 102 and a display device substrate 101. The circuit board 103 on the system side includes an interface circuit 114 by which the board is connected to the controller IC 102. The controller IC 102 includes a controller 113; a memory 111 and an output buffer 112 and are connected to the system circuit board 103 and to the display device substrate 101. The display device substrate 101 has a built-in level shifter/timing buffer (controller) 108, a scanning circuit (scanning-line driver circuit) 109, a level shifter 104, a latch circuit 105, a DAC 106, a selector circuit 107 and a display area 110. The display device substrate 101 is connected to the controller IC 102. The level shifter 104, latch circuit 105, DAC 106 and selector circuit 107 are arranged in the order mentioned, and the selector circuit 107 is connected to the column-side of the display area 110. The latch circuit 105 latches the output of the level shifter 104, and the output of the latch circuit 105 is converted to an analog signal by the DAC 106. The analog signal is output to the data lines of the display area 110 via the selector circuit 107.

In this embodiment, the display area 110 presents an active-matrix display of M rows and N columns, and the number of grayscale bits is B. Thus the memory 11 has a capacity of (M×N×B) bits. The selector circuit 107 has N-number of outputs, which is the same as the number of inputs on the column side of the display area 110.

The output buffer 112 is constituted by circuits (output buffers) of (N×B)/S-number of bits. This number is obtained by dividing (N×B) bits, which correspond to one row of bits in the (M×N×B)-number of bits of the memory 111, divided by a block dividing number S.

The level shifter 104 and latch circuit 105 are both constituted by circuits corresponding to (N×B)/S-number of bits just as is the output buffer 112. That is, (N×B)/S-number of the level shifters and (N×B)/S-number of the latch circuits are provided.

The DAC 106 comprises (N/S)-number of circuits(DACs) and has the B-number of grayscale bits supplied thereto for outputting an analog signal that corresponds to the digital value of each gray level.

Figure 2:
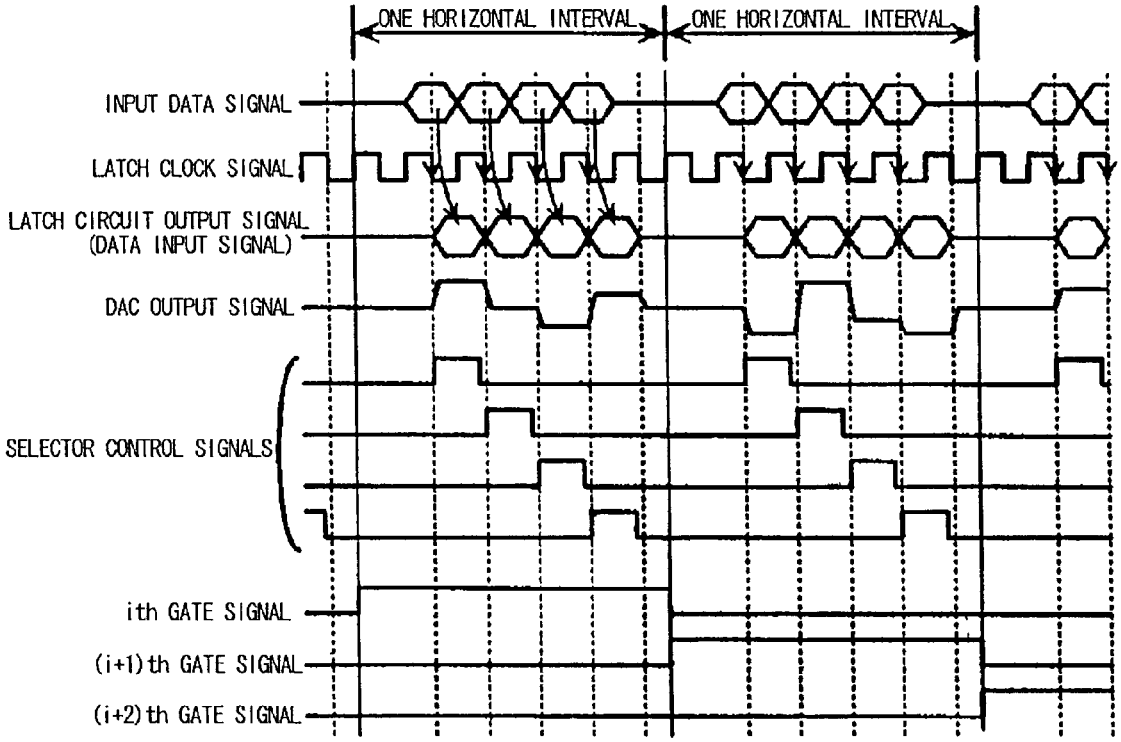
FIG. 2 is a diagram useful in describing the timing operation of the display device according to the first embodiment.

FIG. 2 is a diagram useful in describing the timing operation of the first embodiment. When an input data signal is supplied to the display device substrate 101 from the output buffer 112 of the controller IC 102 via a (N×B)/S-bit data bus in one horizontal scanning period, the data signal is latched at the timing of the falling edge of a latch clock signal supplied to the latch circuit 105. As a result, the output signal of the latch circuit 105 becomes the input signal to the DAC 106. The latch clock signal is supplied to the latch circuit 105 from the level shifter/timing buffer 108.

Each data signal undergoes a DA (digital-to-analog) conversion in the DAC 106, whereby there is obtained an analog signal conforming to the digital value of each gray level.

Control pulses are scanned sequentially with respect to S-number of lines (where S represents the block dividing number, and S=4 holds in FIG. 2) as a selector control signal supplied to the selector circuit 107, as shown in FIG. 2.

When the selector control signal is supplied to the selector circuit 107, the latter selects signals sequentially from the output signals of the DAC 106, separates the signals into S-number of signals and sends these signals to each of the signal lines (data lines) of a signal-line group in which the number of lines is S, namely the block dividing number.

By arraying (N/S)-number of these signal-line groups and supplying all of them with signals in parallel, supply of signals to N-number of signal lines in one horizontal scanning period is achieved.

Gate signals for driving the gate lines of pixel switches in M rows of the display area 110 are supplied by M-number of the scanning circuits 109. These signals are held at the high level for one horizontal scanning period and revert to the low level at all other times. The gate signals are scanned sequentially so that they are supplied to M-number of gate lines.

In this embodiment, it is possible to present a display on the display area 110 of M rows and N columns using the arrangement illustrated in FIGS. 1 and 2.

The data signals supplied to the display area 110 of M rows and N columns are digital signals, and data of M×N×B bits are stored in the memory 111 in accordance with the number B of digital grayscale bits.

The output buffer 112 outputs data, upon dividing the data by the block dividing number S, for each of M-number of gate scanning lines. As a result, data is transferred in units of (N×B)/S bits. One line of display data is transferred from the output buffer 112 of the controller IC 102 to the display device substrate 101 via a (N×B)/S-bit data bus upon being divided S(=4) times in one horizontal scanning period. As a result, it is possible to transfer data at a transfer rate that is slow in comparison with the conventional serial transfer method.

The transferred data signal is boosted by the level shifter 104 from input data having low voltage amplitude to a high voltage value (voltage amplitude).

Since data transfer at a high voltage is made unnecessary by the level shifter 104, power consumption is reduced greatly.

As shown in FIG. 2, the latch circuit 105 latches the data signal at the timing of the falling edge of the latch clock signal supplied to the latch circuit 105. A signal obtained by boosting the output of the controller 113 to a high voltage amplitude using the level shifter/timing buffer 108 is supplied to the latch circuit 105 as the latch clock signal. The level shifter 104 and latch circuit 105 executes processing in units of (N×B)/S bits, which is the same as the number of bits transferred from the output buffer 112.

The DAC 106, which comprises (N/S)-number of circuits (DACs ), executes a digital-to-analog conversion from a data group of B grayscale bits a time from among the (N×B)/S bits input thereto and obtains a single analog signal, whereby (N/S) (bit) analog signal data is output from the DAC circuits in their entirety. In other words, B-number of outputs of (N×B)/S-number of latch circuits 105 are supplied to one corresponding DAC 106, and the DAC 106 outputs an analog voltage signal that corresponds to the grayscale data.

The (N/S) number analog data signals output from the DAC 106 are selected sequentially by the selector circuit 107 based upon the selector control signal in a time obtained by division by the block dividing number S on a per-output basis, whereby data signals are supplied to a group of S-number (S=4 in FIG. 2) of data lines.

As a result, data signals are supplied to N-number of data lines.

Whenever each gate line of the M-number of gate lines is scanned, the corresponding data is read out of the memory 111 sequentially and is written to the display area 110, whereby a display is presented.

A second embodiment of the present invention will now be described with reference to FIG. 5, which illustrates the structure of a display device according to this embodiment.

Figure 5:
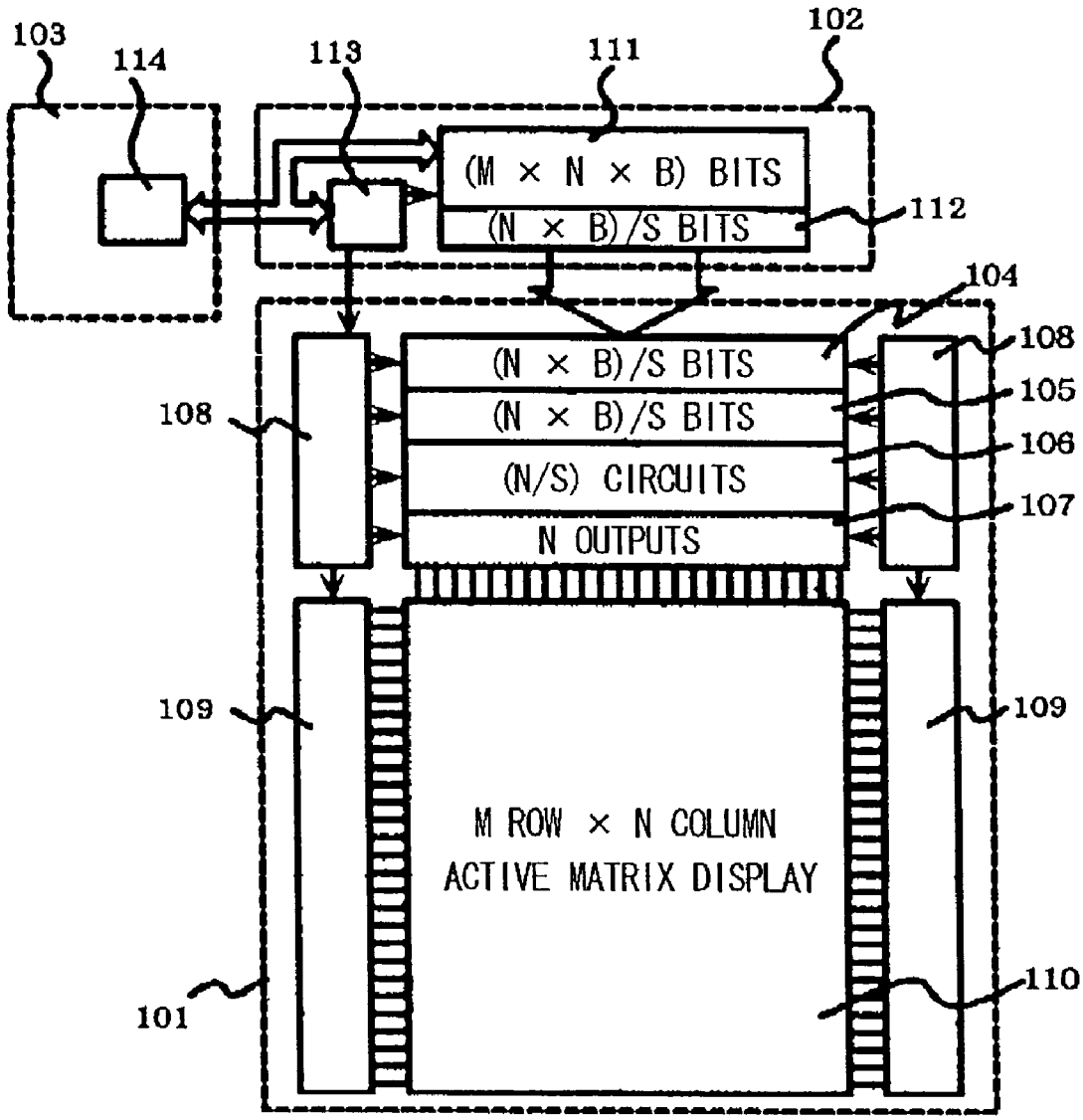
FIGS. 5, 6, 7 and 8 illustrate the structures of display devices according to second, third, fourth and fifth embodiments, respectively, of the present invention.

As shown in FIG. 5, the second embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The latter has the built-in level shifter/timing buffer 108, scanning circuit 109, level shifter 104, latch circuit 105, DAC 106, selector circuit 107 and display area 110. The display device substrate 101 is connected to the controller IC 102. The level shifter 104, latch circuit 105, DAC 106 and selector circuit 107 are disposed in the order mentioned, and the selector circuit 107 is connected to the column-side of the display area 110.

This embodiment differs from the first embodiment in that the level shifter/timing buffer 108 and scanning-line driver circuit 109 are disposed on both sides of the display area 110. This arrangement eliminates a decline in the driving capability of the gate drivers of the scanning circuit 109 and as well as the delay between both ends of the gate lines.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 is constituted by circuits(output buffers) of (N×B)/S-number of bits. This number is obtained by dividing (N×B) bits, which correspond to one row of bits in the (M×N×B)-number of bits of the memory 111, by the block dividing number S. The level shifter 104 and latch circuit 105 are both constituted by circuits corresponding to (N×B)/S-number of bits just as is the output buffer 112. The DAC 106 comprises (N/S)-number of DAC circuits.

A third embodiment of the present invention will now be described with reference to FIG. 6, which illustrates the structure of a display device according to this embodiment.

As shown in FIG. 6, the third embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The latter has the built-in level shifter/timing buffer 108, scanning circuit 109, level shifter 104, latch circuit 105, DAC 106, selector circuit 107 and display area 110. The display device substrate 101 is connected to the controller IC 102. The latch circuit 105, level shifter 104, DAC 106 and selector circuit 107 are disposed in the order mentioned, and the selector circuit 107 is connected to the column-side of the display area 110.

Thus, this embodiment differs from the first embodiment in that the positions of the level shifter 104 and latch circuit 105 are interchanged, with the latch circuit 105 being located on the input side of the level shifter 10 in this embodiment.

According to this embodiment, the display area 110 presents an active-matrix display of M rows and N columns, and the number of grayscale bits is B.

Thus the memory 111 has a capacity of (M×N×B) bits.

Further, the selector circuit 107 has N-number of outputs, which is the same as the number of inputs on the column side of the display area 110. The output buffer 112 is constituted by circuits(output buffers) corresponding to (N×B)/S-number of bits. This number is obtained by dividing (N×B) bits, which correspond to one row of bits in the (M×N×B)-number of bits of the memory 111, by the block dividing number S.

The level shifter 104 and latch circuit 105 are both constituted by circuits corresponding to (N×B)/S-number of bits just as is the output buffer 112. The DAC 106 comprises (N/S)-number of DAC circuits.

It goes without saying that this embodiment also may be so arranged that the level shifter/timing buffer 108 and scanning circuit 109 are disposed on the left and right sides of the display area 110 in a manner similar to that of the second embodiment.

A fourth embodiment of the present invention will now be described with reference to FIG. 7, which illustrates the structure of a display device according to this embodiment.

Figure 7:
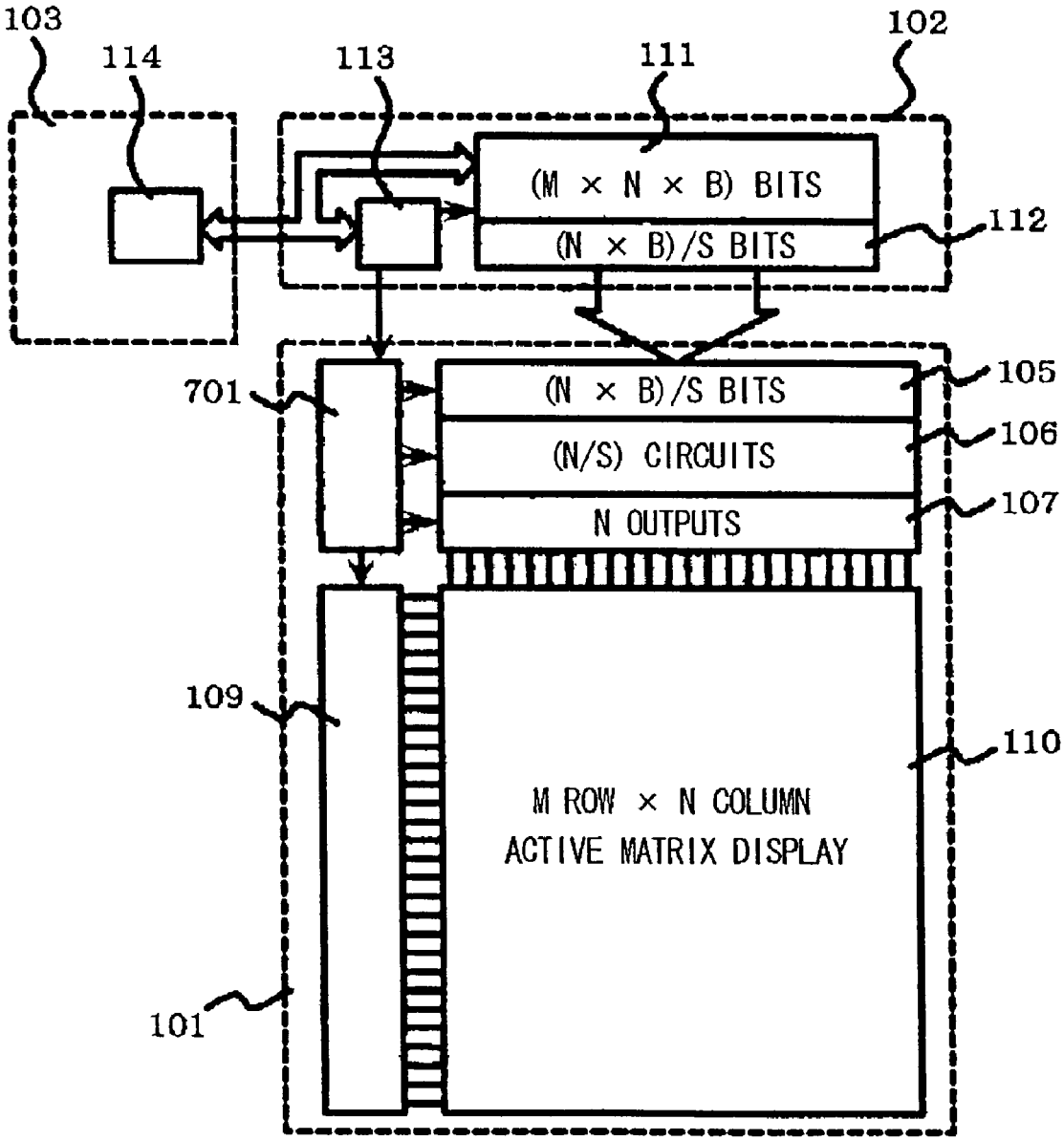

As shown in FIG. 7, the fourth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The latter has a built-in timing buffer 701 and the built-in scanning circuit 109, latch circuit 105, DAC 106, selector circuit 107 and display area 110. The display device substrate 101 is connected to the controller IC 102. The latch circuit 105, DAC 106 and selector circuit 107 is disposed in the order mentioned, and the selector circuit 107 is connected to the column-side of the display area 110.

Thus, this embodiment differs from the first and third embodiments in that the level shifter 104 is not provided and the timing buffer 701 is provided instead of the level shifter/timing buffer 108.

According to this embodiment, the display area 110 presents an active-matrix display of M rows and N columns, and the number of grayscale bits is B. Thus the memory 11 has a capacity of (M×N×B) bits.

Further, the selector circuit 107 has N-number of outputs, which is the same as the number of inputs on the column side of the display area 110. The output buffer 112 is constituted by circuits of (N×B)/S-number of bits. This number is obtained by dividing (N×B) bits, which correspond to one row of bits in the (M×N×B)-number of bits of the memory 111, by the block dividing number S. The latch circuit 105 is composed by latch circuits of (N×B)/S-number of bits just as is the output buffer 112. The DAC 106 comprises (N/S)-number of DAC circuits.

It goes without saying that this embodiment also may be so arranged that the timing buffer 701 and scanning circuit 109 are disposed on the left and right sides of the display area 110 in a manner similar to that of the second embodiment.

A fifth embodiment of the present invention will now be described with reference to FIG. 8, which illustrates the structure of a display device according to this embodiment.

Figure 8:
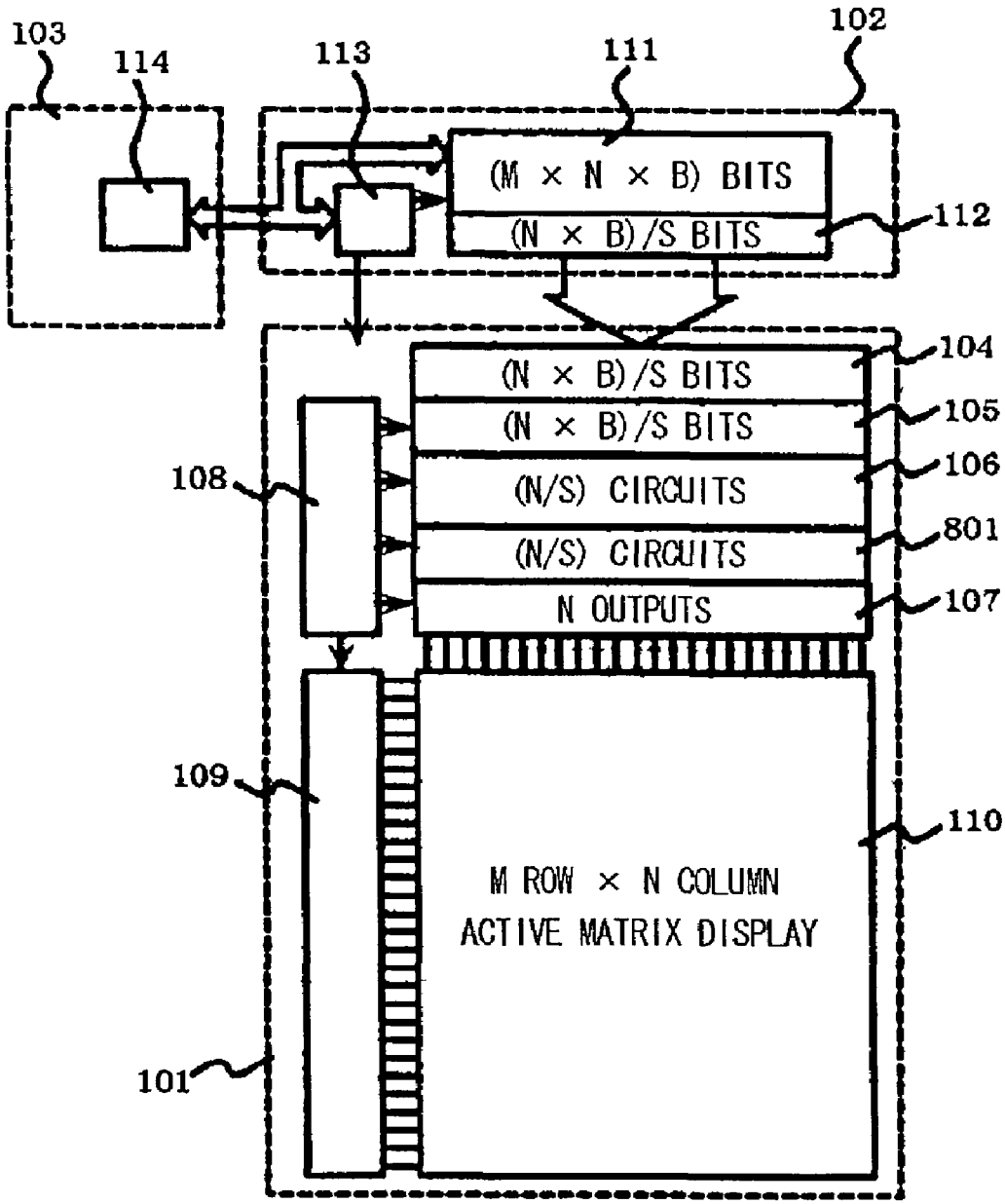

As shown in FIG. 8, the fifth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The latter has the built-in level shifter/timing buffer 108, scanning circuit 109, level shifter 104, latch circuit 105, DAC 106 and selector circuit 107, a built-in voltage-current converting circuit/current output buffer 801 and the built-in display area 110. The display device substrate 101 is connected to the controller IC 102. The level shifter 104, latch circuit 105, DAC 106, voltage-current converting circuit/current output buffer 801 and selector circuit 107 are disposed in the order mentioned, and the selector circuit 107 is connected to the column-side of the display area 110.

Thus, this embodiment differs from the first to fourth embodiments in the provision of the voltage-current converting circuit/current output buffer 801.

According to this embodiment, the display area 110 presents an active-matrix display of M rows and N columns, and the number of grayscale bits is B. Thus the memory II has a capacity of (M×N×B) bits.

Further, the selector circuit 107 has N-number of outputs, which is the same as the number of inputs on the column side of the display area 110. The output buffer 112 is constituted by circuits(output buffers) corresponding to (N×B)/S-number of bits. This number is obtained by dividing (N×B) bits, which correspond to one row of bits in the (M×N×B)-number of bits of the memory 111, by the block dividing number S. The level shifter 104 and latch circuit 105 are both constituted by circuits corresponding to (N×B)/S-number of bits just as is the output buffer 112.

The DAC 106 and the voltage-current converting circuit/current output buffer 801 each comprise (N/S)-number of DAC circuits.

It goes without saying that this embodiment also may be so arranged that the level shifter/timing buffer 108 and scanning circuit 109 are disposed on the left and right sides of the display area 110 in a manner similar to that of the second embodiment.

Unlike the first to fourth embodiments, this embodiment is provided with the voltage-current converting circuit/ current output buffer 801, thereby making it possible to supply data signals to current-drive display elements, i.e., without relying upon voltage drive.

Figure 9:
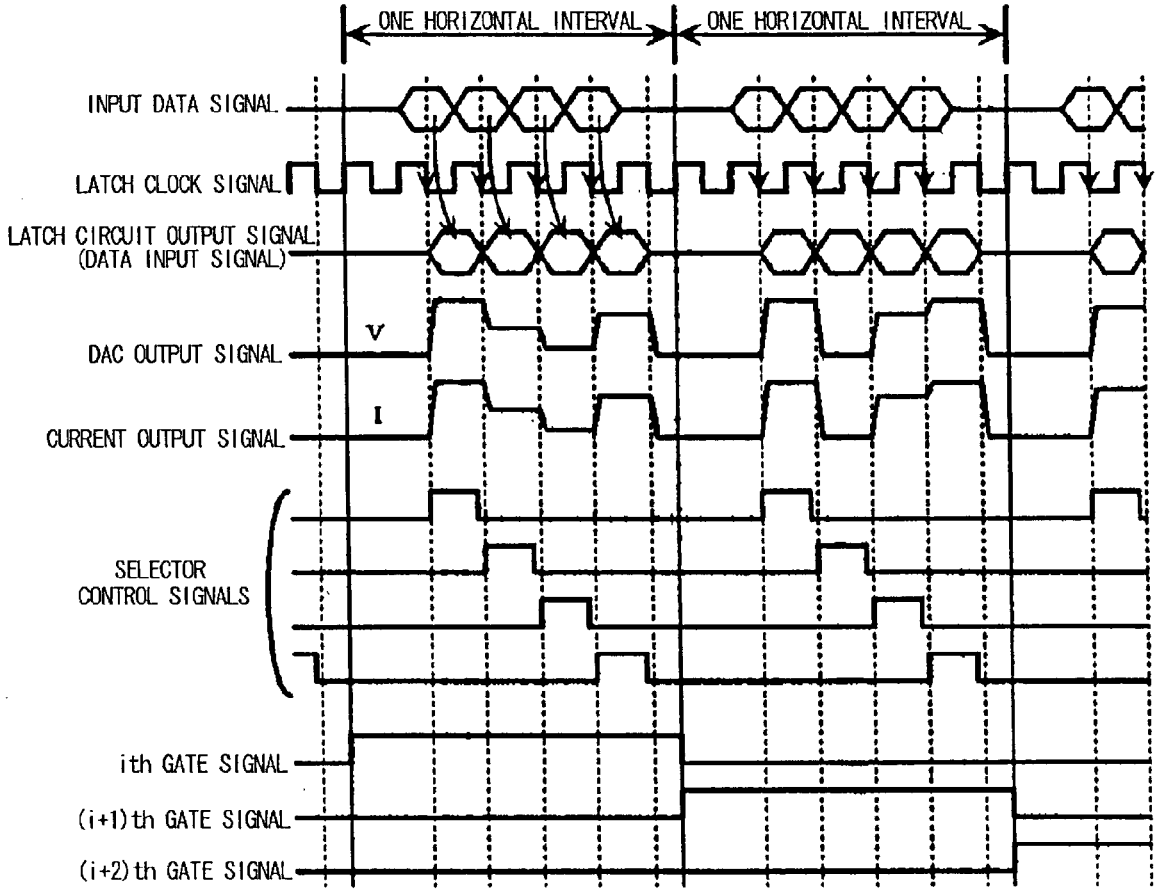
FIG. 9 is a diagram useful in describing the timing operation of the display device according to the fifth embodiment.

FIG. 9 is a diagram useful in describing the timing operation of the fifth embodiment. When an input data signal is supplied to the display device substrate 101 in one horizontal scanning period, the data signal is latched at the timing of the falling edge of a latch clock signal supplied to the latch circuit 105. As a result, the output signal of the latch circuit 105 becomes as shown in FIG. 9. This signal becomes the input to the DAC 106.

Each data signal undergoes a DA (digital-to-analog) conversion in the DAC 106, whereby there is obtained an analog signal conforming to the digital value of each gray level.

Control pulses are scanned sequentially, as shown in FIG. 9, with respect to S-number of lines (where S represents the block dividing number, and S=4 holds in FIG. 2) as the selector control signal When the selector control signal is supplied to the selector circuit 107, the latter selects signals sequentially from the output signals of the voltage-current converting circuit/current output buffer 801, separates the signals into S-number of signals and sends these signals to each of the signal lines of a signal-line group in which the number of lines is S, namely the block dividing number.

By arraying (N/S)-number of these signal-line groups and supplying them with signals, supply of signals to N-number of signal lines in one horizontal scanning period is achieved.

Each gate signal is held at the high level for one horizontal scanning period and reverts to the low level at all other times. The gate signals are scanned sequentially so that they are supplied to M-number of gate lines.

In this embodiment, it is possible to present a display based upon current signals on the display area 110 of M rows and N columns using the arrangement illustrated in FIGS. 8 and 9. The data signals supplied to the display area 110 of M rows and N columns are digital signals, and data of (M×N×B) bits is stored in the memory 111 in accordance with the number B of digital grayscale bits. The output buffer 112 outputs data, upon dividing (N×B) bit data corresponding to one line by the block dividing number S, for each of M-number of gate scanning lines, and therefore data is transferred in units of (N×B)/S bits. As a result, it is possible to transfer data at a transfer rate that is slow in comparison with the conventional transfer method.

The transferred data signal is boosted by the level shifter 104 from input data having low voltage amplitude to a high voltage value (voltage amplitude). Since data transfer at a high voltage is made unnecessary by the level shifter 104, power consumption is reduced greatly. As shown in FIG. 9, the latch circuit 105 latches the data signal. The level shifter 104 and latch circuit 105 executes processing in units of (N×B)/S bits, which is the same as the number of bits transferred from the output buffer 112. The DAC 106 is comprised of (N/S)-number of DAC circuits, which executes a digital-to-analog conversion from a data group of B grayscale bits at a time from among the (N×B)/S bits supplied to the DAC 106 and obtains a single analog output signal, whereby (N/S)-line analog data signals are output from the circuits of the DAC 106 in their entirety.

The (N/S)-line analog data signals are converted from voltage values to current values by the voltage-current converting circuit/current output buffer 801. These signals are selected sequentially by the selector circuit 107 in a time obtained by division by the block dividing number S on a per-bit basis, whereby data signals are supplied to group of S-number of data lines.

As a result, data signals (corresponding to one line) are supplied to N-number of data lines. Whenever each gate line of the M-number of gate lines is scanned, data is read out of the memory 111 sequentially and is written to the display area 110.

A sixth embodiment of the present invention will now be described with reference to FIG. 10, which illustrates the structure of a display device according to this embodiment.

As shown in FIG. 10, the sixth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 11 and the output buffer 112 and is connected to the system circuit board 103 and to the display device substrate 101. The latter has, built-in, the level shifter/timing buffer 108, the scanning circuit 109, the level shifter 104, the latch circuit 105, the selector circuit 107, a decoder circuit 1001, a current output buffer 1002 and the display area 110. The display device substrate 101 is connected to the controller IC 102. The level shifter 104, latch circuit 105, decoder circuit 1001, current output buffer 1002 and selector circuit 107 are disposed in the order mentioned, and the selector circuit 107 is connected to the column-side of the display area 110.

Thus, this embodiment differs from the first to fifth embodiments in that the DAC 106 are eliminated and the decoder circuit 1001 and current output buffer 1002 are provided. The current output buffer 1002 is of the variable-current type and outputs a current that conforms to the result of decoding performed by the decoder circuit 1001.

According to this embodiment, the display area 110 presents an active-matrix display of M rows and N columns, and the number of grayscale bits is B. Thus the memory 11 has a capacity of (M×N×B) bits.

Further, the selector circuit 107 has N-number of outputs, which is the same as the number of inputs on the column side of the display area 110. The output buffer 112 is constituted by circuits(output buffers) corresponding to (N×B)/S-number of bits. This number is obtained by dividing (N×B) bits, which correspond to one row of bits in the (M×N×B)-number of bits of the memory 111, by the block dividing number S. The level shifter 104 and latch circuit 105 are both constituted by circuits corresponding to (N×B)/S-number of bits just as is the output buffer 112. The decoder circuit 1001 and the current output buffer 1002 each comprise (N/S)-number of DAC circuits.

It goes without saying that this embodiment also may be so arranged that the level shifter/timing buffer 108 and scanning circuit 109 are disposed on the left and right sides of the display area 110 in a manner similar to that of the second embodiment.

A seventh embodiment of the present invention will now be described with reference to FIG. 11, which illustrates the structure of a display device according to this embodiment.

Figure 11:
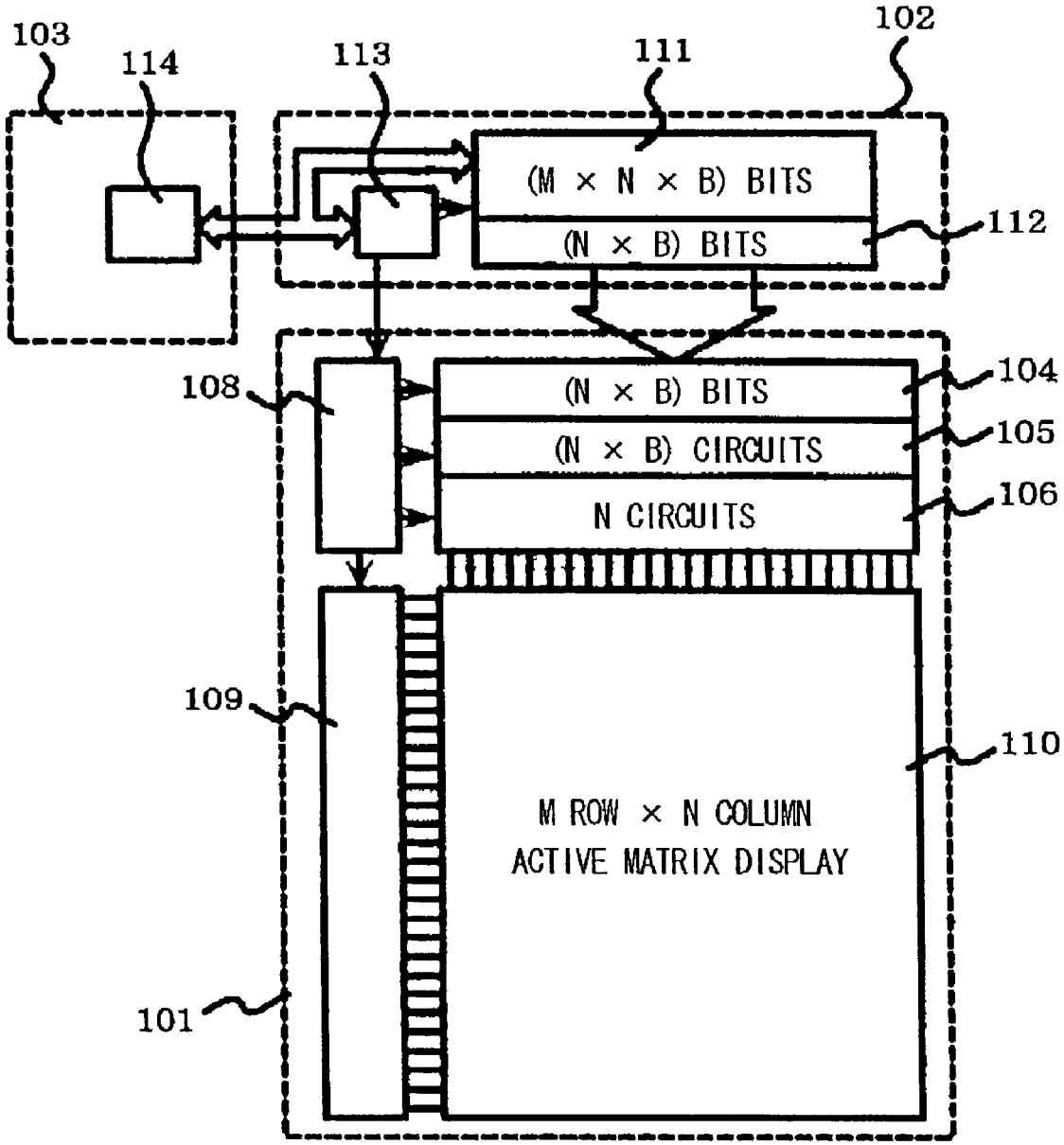

As shown in FIG. 11, the seventh embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106 and display area 110 and is connected to the controller IC 102. The level shifter 104, latch circuit 105 and DAC 106 are disposed in the order mentioned, and the DAC 106 is connected to the column-side of the display area 110.

According to this embodiment, the display area 110 presents an active-matrix display of M rows and N columns, and the number of grayscale bits is B. Thus the memory 11 has a capacity of (M×N×B) bits.

Further, the DAC 106 has N-number of outputs, which is the same as the number of inputs on the column side of the display area 110. The output buffer 112 is constituted by circuits(output buffer) of (N×B)-number of bits corresponding to one row of bits in the (M×N×B)-number of bits of the memory 111. The level shifter 104 and latch circuit 105 are both constituted by circuits corresponding to (N×B)-number of bits just as is the output buffer 112.

Thus, unlike the first to sixth embodiments, this embodiment is not provided with the selector circuit 107 and block division is not carried out. It goes without saying that this embodiment also may be so arranged that the level shifter/timing buffer 108 and scanning circuit 109 are disposed on the left and right sides of the display area 110 in a manner similar to that of the second embodiment.

Figure 12:
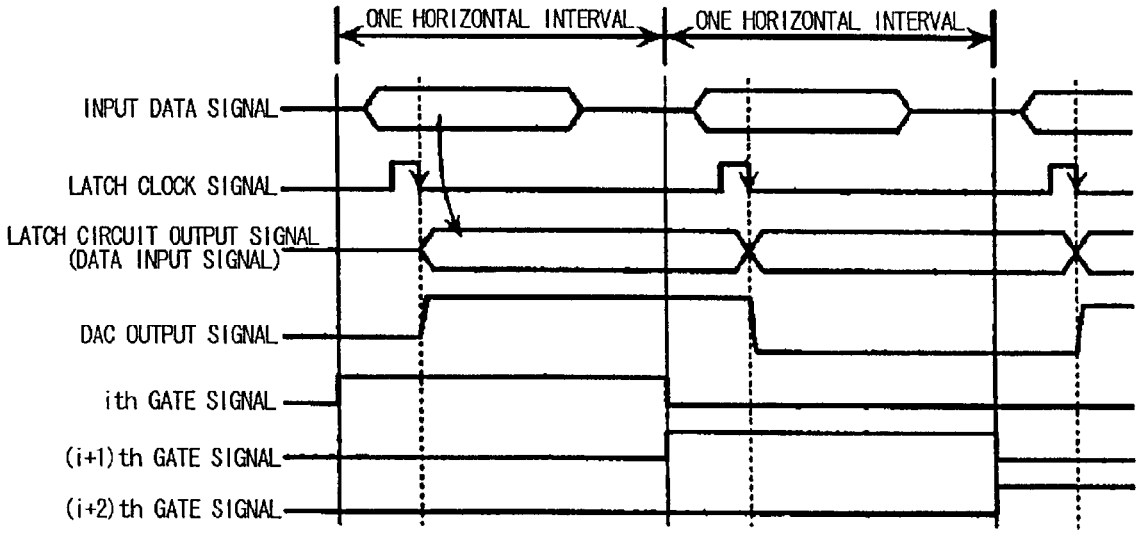
FIG. 12 is a diagram useful in describing the timing operation of the display device according to the seventh embodiment.

FIG. 12 is a diagram useful in describing the timing operation of the fifth embodiment. When an input data signal is supplied to the display device substrate 101 in one horizontal scanning period, the data signal is latched at the timing of the falling edge of a latch clock signal supplied to the latch circuit 105.

As a result, the output signal of the latch circuit 105 becomes as shown in FIG. 12. This signal becomes the input to the DAC 106. Each data signal undergoes a DA (digital-to-analog) conversion in the DAC 106, whereby there is obtained an analog signal conforming to the digital value of each gray level. The DAC output signals are sent to respective ones of the data signal lines as is.

Each gate signal is held at the high level for one horizontal scanning period and reverts to the low level at all other times. The gate signals are scanned sequentially so that they are supplied to M-number of gate lines.

In this embodiment, it is possible to present a display on the display area 110 of M rows and N columns using the arrangement illustrated in FIGS. 11 and 12. The data signals supplied to the display area 110 of M rows and N columns are digital signals, and data of M×N×B bits is stored in the memory 111 in accordance with the number B of digital grayscale bits. The output buffer 112 outputs data for each of M-number of gate scanning lines, and therefore data is transferred in units of (N×B) bits. As a result, it is possible to transfer data at a transfer rate that is slow in comparison with the conventional transfer method. The transferred data signal is boosted by the level shifter 104 from input data having a low voltage value to a high voltage value. Since data transfer at a high voltage is made unnecessary by the level shifter 104, power consumption is reduced greatly.

As shown in FIG. 12, the latch circuit 105 latches the data signal. The level shifter 104 and latch circuit 105 execute processing in units of (N×B) bits, which is the same as the number of bits transferred from the output buffer 112. The DAC 106, which comprises N-number of circuits, executes a digital-to-analog conversion from a data group of B grayscale bits at a time from among the (N×B) bits input thereto and obtains a single analog signal, whereby N-number of analog signal data is output from the DAC circuits in their entirety. The N-line analog data signals are supplied directly to N-number of data lines, thereby achieving supply of the data signals. Whenever each of the M-number of gate lines is scanned, data is read out of the memory 111 sequentially and is written to the display area 110.

An eighth embodiment of the present invention will now be described with reference to FIG. 13, which illustrates the structure of a display device according to this embodiment.

Figure 13:
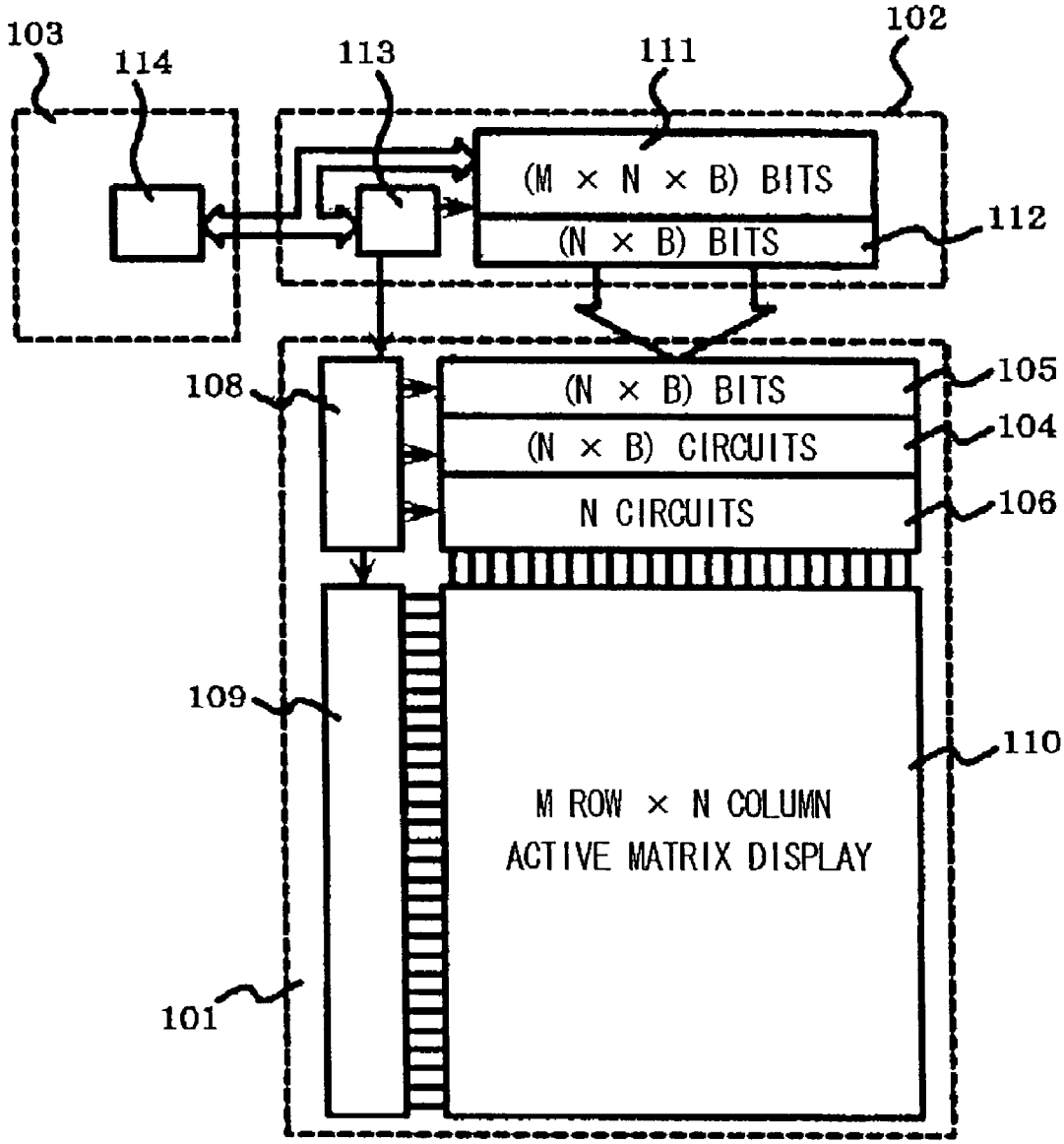
FIGS. 13, 14 and 15 illustrate the structures of display devices according to eighth, ninth and tenth embodiments, respectively, of the present invention.

As shown in FIG. 13, the eighth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106 and display area 110 and is connected to the controller IC 102. The latch circuit 105, level shifter 104 and DAC 106 are disposed in the order mentioned, and the DAC 106 is connected to the column-side of the display area 110.

Thus, this embodiment differs from the seventh embodiment in that the positions of the level shifter 104 and latch circuit 105 are interchanged, with the latch circuit 105 being located on the input side of the level shifter 104 in this embodiment.

According to this embodiment, the display area 110 presents an active-matrix display of M rows and N columns, and the number of grayscale bits is B. Thus the memory 11 has a capacity of (M×N×B) bits.

Further, the DAC 106 has N-number of outputs, which is the same as the number of inputs on the column side of the display area 110. The output buffer 112 is composed by circuits(output buffers) of (N×B)-number of bits corresponding to one row of bits in the (M×N×B)-number of bits of the memory 111. The level shifter 104 and latch circuit 105 are both constituted by circuits composed of (N×B)-number of bits just as is the output buffer 112.

Thus, this embodiment is similar to the seventh embodiment and differs from the first to sixth embodiments in that this embodiment is not provided with the selector circuit 107 and block division is not carried out. It goes without saying that this embodiment also may be so arranged that the level shifter/timing buffer 108 and scanning circuit 109 are disposed on the left and right sides of the display area 110 in a manner similar to that of the second embodiment.

A ninth embodiment of the present invention will now be described with reference to FIG. 14, which illustrates the structure of a display device according to this embodiment.

Figure 14:
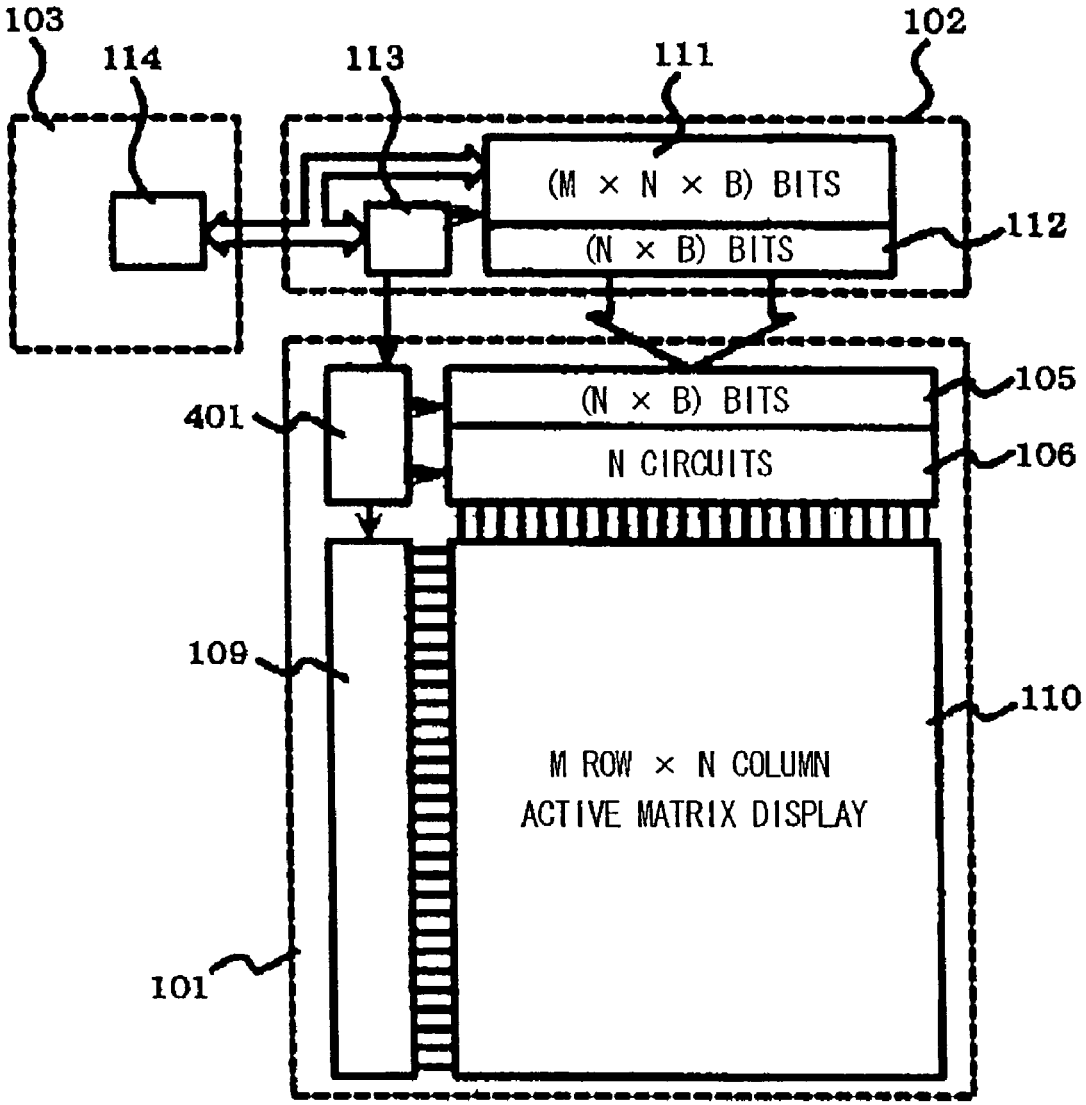

As shown in FIG. 14, the ninth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, a timing buffer 401, the scanning circuit 109, latch circuit 105, DAC 106 and display area 110 and is connected to the controller IC 102. The latch circuit 105 and DAC 106 are disposed in the order mentioned, and N-number of the DACs 106 is connected to the column-side of the display area 110.

Thus, this embodiment differs from the seventh and eighth embodiments in that the level shifter 104 is not provided and the timing buffer 401 is provided instead of the level shifter/timing buffer 108.

According to this embodiment, the display area 110 presents an active-matrix display of M rows and N columns, and the number of grayscale bits is B. Thus the memory 11 has a capacity of (M×N×B) bits. Further, the DAC 106 has N-number of outputs, which is the same as the number of inputs on the column side of the display area 110.

The output buffer 112 is provided with circuits corresponding to (N×B)-number of bits corresponding to one line of bits in the (M×N×B)-number of bits of the memory 111. The latch circuit 105 is provided with circuits corresponding to (N×B)-number of bits just as is the output buffer 112.

Thus, this embodiment is similar to the seventh embodiment and differs from the first to sixth embodiments in that this embodiment is not provided with the selector circuit 107 and block division is not carried out. It goes without saying that this embodiment also may be so arranged that the level shifter/timing buffer 108 and scanning circuit 109 are disposed on the left and right sides of the display area 110 in a manner similar to that of the second embodiment.

10th Embodiment

A tenth embodiment of the present invention will now be described with reference to FIG. 15, which illustrates the structure of a display device according to this embodiment.

Figure 15:
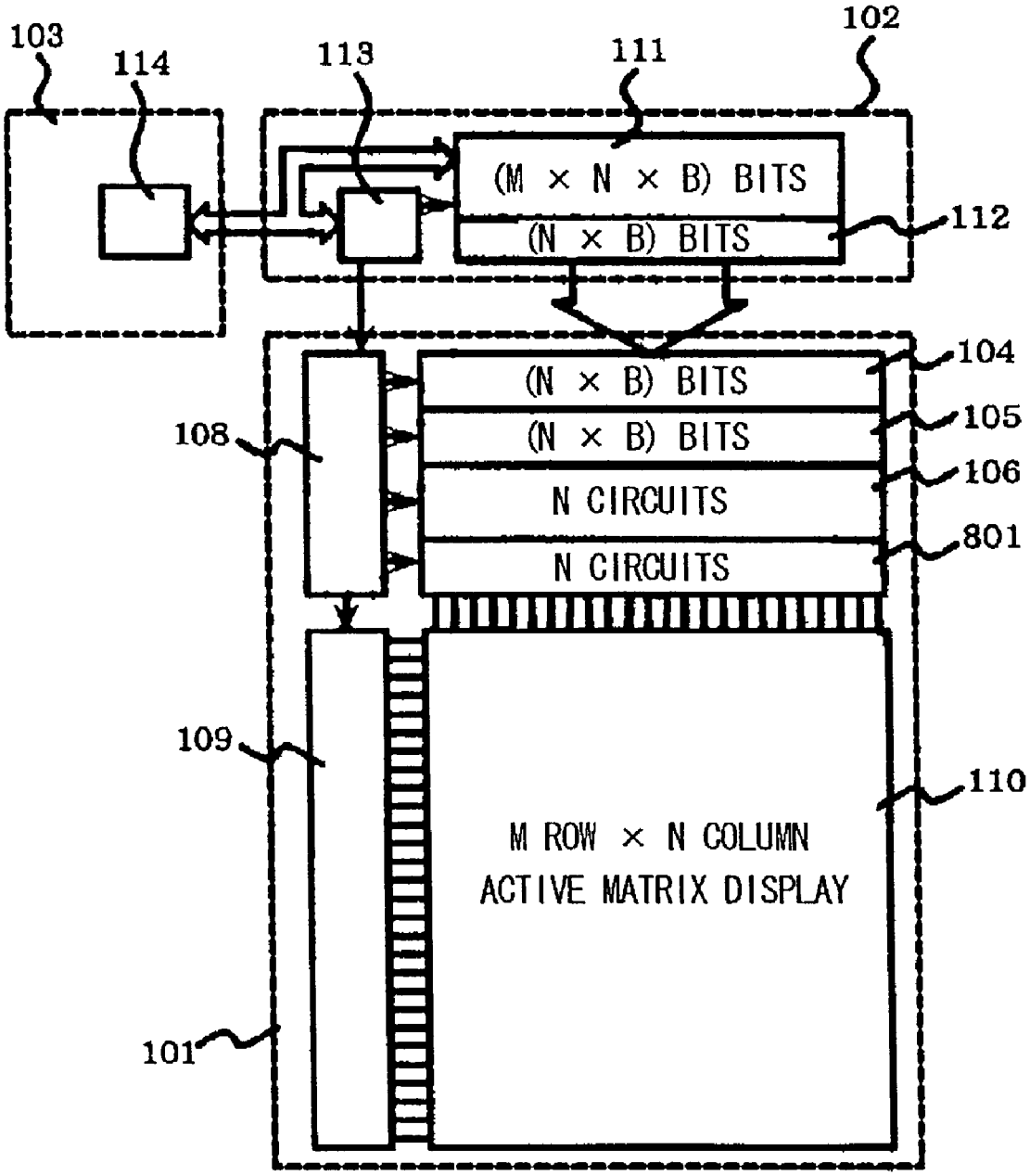

As shown in FIG. 15, the tenth embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113; the memory 111 and the output buffer 112 and are connected to the system circuit board 103 and to the display device substrate 101.

The display device substrate 101 has, built in, the level shifter/timing buffer 108, scanning circuit 109, level shifter 104, latch circuit 105, DAC 106, voltage-current converting circuit/current output buffer 801 and display area 110 and is connected to the controller IC 102. The level shifter 104, latch circuit 105, DAC 106 and voltage-current converting circuit/current output buffer 801 are disposed in the order mentioned, and the voltage-current converting circuit/current output buffer 801 is connected to the column-side of the display area 110.

According to this embodiment, the display area 110 presents an active-matrix display of M rows and N columns, and the number of grayscale bits is B. Thus the memory 11 has a capacity of (M×N×B) bits.

Further, the voltage-current converting circuit/current output buffer 801 has N-number of outputs, which is the same as the number of inputs on the column side of the display area 110. The output buffer 112 has circuits of (N×B)-number of bits corresponding to one row of bits in the (M×N×B)-number of bits of the memory 111.

Thus, this embodiment differs from the fifth embodiment in that it is not provided with the selector circuit 107 and block division is not carried out. It goes without saying that this embodiment also may be so arranged that the level shifter/timing buffer 108 and scanning circuit 109 are disposed on the left and right sides of the display area 110 in a manner similar to that of the second embodiment.

Figure 16:
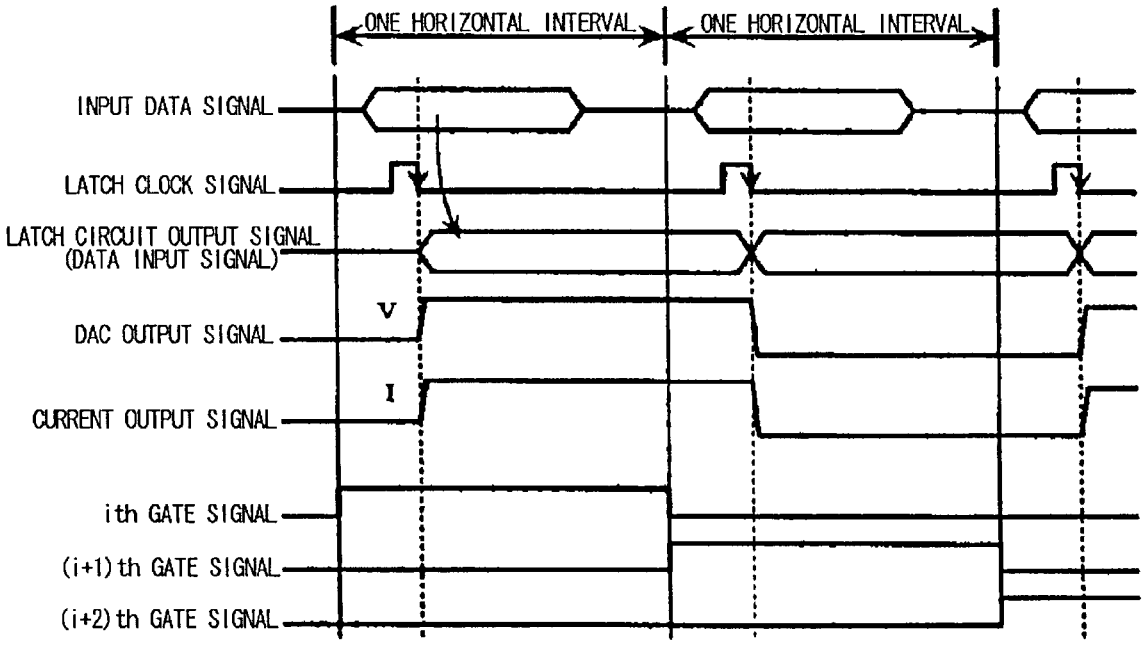
FIG. 16 is a diagram useful in describing the timing operation of the display device according to the tenth embodiment.

FIG. 16 is a diagram useful in describing the timing operation of the tenth embodiment. When an input data signal is supplied to the display device substrate 101 in one horizontal scanning period, the data signal is latched at the timing of the falling edge of a latch clock signal supplied to the latch circuit 105. As a result, the output signal of the latch circuit 105 becomes as shown in FIG. 16. This signal becomes the input to the DAC 106. Each data signal undergoes a DA (digital-to-analog) conversion in the DAC 106, whereby there is obtained an analog signal conforming to the digital value of each gray level. Though the DAC output signal is a voltage signal, this is converted to a current output signal by the voltage-current converting circuit/current output buffer 801. The current output signals are sent to the data signal lines as is. Each gate signal is held at the high level for one horizontal scanning period and reverts to the low level at all other times. The gate signals are scanned sequentially so that they are supplied to M-number of gate lines.

In this embodiment, it is possible to present a display on the display area 110 of M rows and N columns using the arrangement illustrated in FIGS. 15 and 16. The data signals supplied to the display area 110 of M rows and N columns are digital signals, and data of M×N×B bits is stored in the memory 111 in accordance with the number B of digital grayscale bits. The output buffer 112 outputs data for each of M-number of gate scanning lines, and therefore data is transferred in units of (N×B) bits. As a result, it is possible to transfer data at a transfer rate that is slow in comparison with the conventional transfer method. The transferred data signal is boosted by the level shifter 104 from input data having a low voltage value to a high voltage value. Since data transfer at a high voltage is made unnecessary by the level shifter 104, power consumption is reduced greatly.

As shown in FIG. 16, the latch circuit 105 latches the data signal. The level shifter 104 and latch circuit 105 execute processing in units of (N×B) bits, which is the same as the number of bits transferred from the output buffer 112.

The DAC 106, which comprises N-number of circuits, executes a digital-to-analog conversion from a data group of B grayscale bits at a time from among the (N×B) bits input thereto and obtains a single-line analog signal, whereby N-line analog-signal voltage data is output from the DAC circuits in their entirety. Each of the N-line analog data signal is converted from a voltage signal to a current signal by the voltage-current converting circuit/current output buffer 801. The N-line analog data signals are supplied directly to N-number of data lines, thereby achieving supply of the data signals. Whenever each of the M-number of gate lines is scanned, data is read out of the memory 111 sequentially and is written to the display area 110.

11th Embodiment

An 11th embodiment of the present invention will now be described with reference to FIG. 17, which illustrates the structure of a display device according to this embodiment.

As shown in FIG. 17, the 11th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, decoder circuit 1001, current output buffer 1002 and display area 110 and is connected to the controller IC 102. The level shifter 104, latch circuit 105, decoder circuit 1001, to which outputs of B-number of latch circuits 105 are supplied, and current output buffer 1002, to which outputs of the of the decoder circuit 1001 are supplied and which outputs current values conforming to the results of decoding, are disposed in the order mentioned, and the current output buffer 1002 is connected to the column-side of the display area 110.

According to this embodiment, the display area 110 presents an active-matrix display of M rows and N columns, and the number of grayscale bits is B. Thus the memory II has a capacity of (M×N×B) bits. Further, the current output buffer 1002 has N-number of outputs, which is the same as the number of inputs on the column side of the display area 110. The output buffer 112 comprises circuits corresponding to (N×B)-number of bits corresponding to one row of bits in the (M×N×B)-number of bits of the memory 111. The level shifter 104 and latch circuit 105 have circuits corresponding to (N×B)-number of bits, similar to the output buffer 112. The decoder circuit 1001 comprises N-number of circuits.

Thus, this embodiment differs from the sixth embodiment in that it is not provided with the selector circuit 107 and block division is not carried out. It goes without saying that this embodiment also may be so arranged that the level shifter/timing buffer 108 and scanning circuit 109 are disposed on the left and right sides of the display area 10 in a manner similar to that of the second embodiment.

12th Embodiment

A 12th embodiment of the present invention will now be described with reference to FIG. 18, which illustrates the structure of a display device according to this embodiment.

Figure 18:
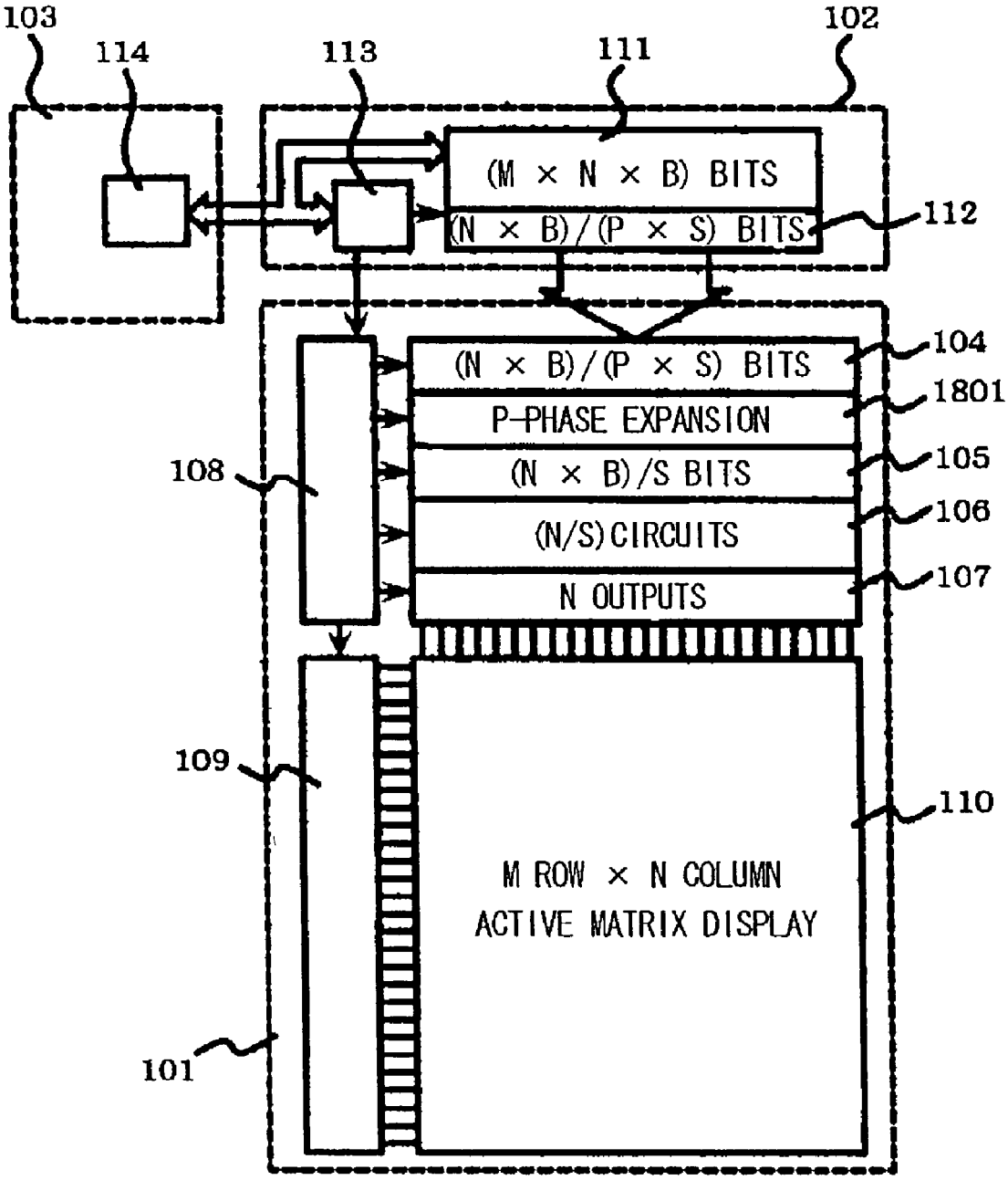

As shown in FIG. 18, the 12th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106, selector circuit 107, serial/parallel converting circuit 1801 and display area 110 and is connected to the controller IC 102. The level shifter 104, serial/parallel converting circuit 1801, latch circuit 105 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 is comprised of circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P. Like the output buffer 112, the level shifter 104 is comprised of circuits corresponding to (N×B)/(P×S)-number of bits. The DAC 106 is comprised of (N/S)-number of circuits.

This embodiment differs from the other embodiments in that the serial/parallel converting circuit 1801 is provided and in that the numbers of bits of each circuits differ.

Figure 19:
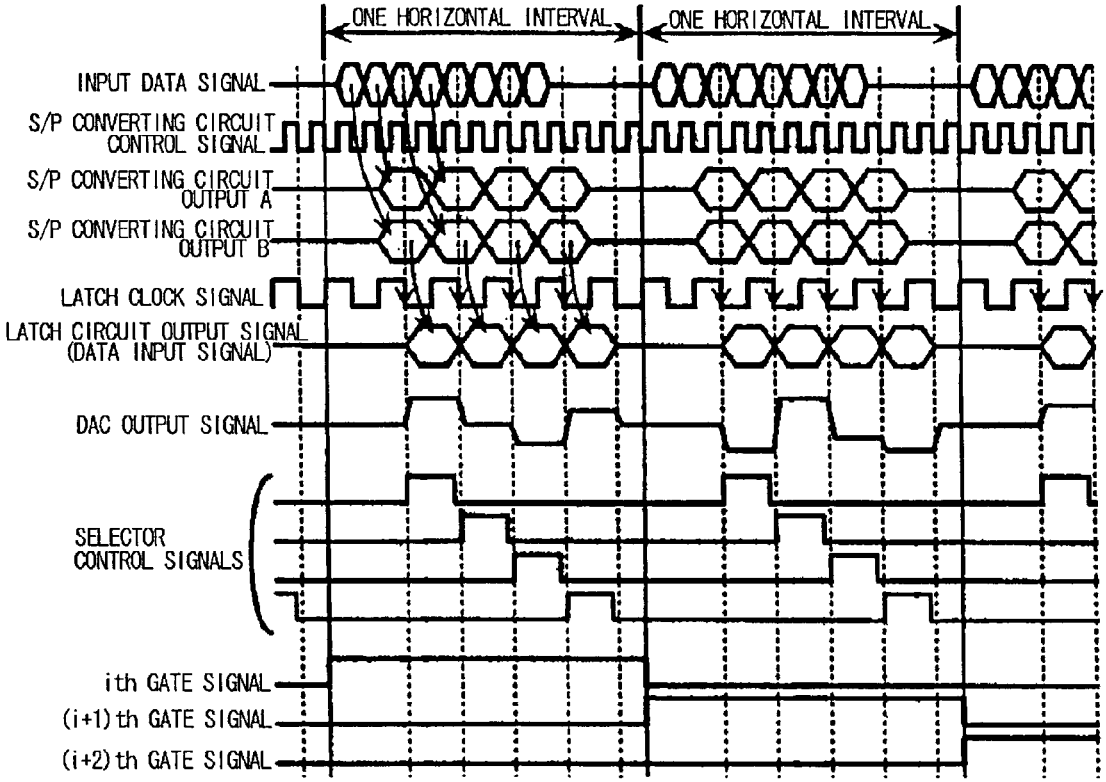
FIG. 19 is a diagram useful in describing the timing operation of the display device according to the $12^{th}$ embodiment.

FIG. 19 is a diagram useful in describing the timing operation of the 12th embodiment. When an input data signal is supplied to the display device substrate 101 in one horizontal scanning period, as shown in FIG. 19, the signal becomes one that has been expanded to a serial-parallel expansion number P (here P=2 holds) by the serial/parallel converting circuit (referred to as an "S/P converter" below) 1801.

This P-phase expansion is controlled by an S/P converter control signal in the S/P converter 1801. The S/P converter control signal is supplied to the S/P converter 1801 from the level shifter/timing buffer 108.

In the example shown in FIG. 19, odd-numbered data of the input data signal is latched at the timing of the falling edges of odd-numbered (even-numbered) pulses of the S/P converter control signal, and an S/P converter output A is produced. On the other hand, even-numbered data of the input data signal is latched at the timing of the falling edges of even-numbered (odd-numbered) pulses of the S/P converter control signal, and an S/P converter output B is produced. In a case where the expansion number P is equal to or greater than 3, the data signal is expanded in multiples of P. Next, the data signal is latched at the timing of the falling edge of a latch clock signal supplied to the latch circuit 105. As a result, the output signal of the latch circuit 105 becomes as illustrated in FIG. 19. This signal becomes the input signal to the DAC 106. Each data signal undergoes a DA (digital-to-analog) conversion in the DAC 106, whereby there is obtained an analog signal conforming to the digital value of each gray level.

Control pulses are scanned sequentially with respect to S-number of lines (where S represents the block dividing number, and S=4 holds in FIG. 19) as a selector control signal supplied to the selector circuit 107, as shown in FIG. 19. When the selector control signal is supplied to the selector circuit 107, the latter selects signals sequentially from the output signals of the DAC 106, separates the signals into S-number of signals and sends these signals to each of the signal lines of a signal-line group in which the number of lines is S, namely the block dividing number.

By arraying (N/S)-number of these signal-line groups and supplying all of them with signals in parallel, supply of signals to N-number of signal lines in one horizontal scanning period is achieved. Gate signals are held at the high level for one horizontal scanning period and revert to the low level at all other times. The gate signals are scanned sequentially so that they are supplied to M-number of gate lines.

In this embodiment, it is possible to present a display on the display area 110 of M rows and N columns using the arrangement illustrated in FIGS. 18 and 19. The data signals supplied to the display area 110 of M rows and N columns are digital signals, and data of (M×N×B ) bits is stored in the memory 111 in accordance with the number B of digital grayscale bits. The output buffer 112 outputs data, upon dividing the (N×B) bit data by the block dividing number S and separating the data into the serial/parallel phase expansion number P, for each of M-number of gate scanning lines. As a result, data is transferred in units of (N×B)/(P×S) bits.

This means that it is possible to transfer data at a transfer rate that is slow in comparison with the conventional transfer method. The level shifter 104 from input data having low voltage amplitude to high voltage value boosts the transferred data signal. Since data transfer at a high voltage is made unnecessary by the level shifter 104, power consumption is reduced greatly. As shown in FIG. 19, the S/P converter 1801 expands the signal into an output signal of the serial/parallel phase expansion number P (here P=2 holds). The level shifter 104 and S/P converter 1801 execute processing in units of (N×B)/(P×S) bits, which is the same as the number of bits transferred from the output buffer 112.

The latch circuit 105 latches the data signal in the manner shown in FIG. 19. The latch circuit 105 takes on a number of bits that is a multiple of P owing to the serial/parallel conversion and executes processing in units of (N×B)/S bits. The DAC 106 comprises (N/S)-number of circuits, each of which executes a digital-to-analog conversion from a data group of B grayscale bits at a time from among the (N×B)/S bits input thereto and obtains a 1-line analog signal, whereby (N/S)-line analog data signals are output from the DAC circuits in their entirety. The (N/S)—line analog data signals are selected sequentially by the selector circuit 107 in a time obtained by division by the block dividing number S on a per-bit basis, whereby data signals are supplied to a group of S-number of data lines. As a result, data signals are supplied to N-number of data lines. Whenever each gate line of the M-number of gate lines is scanned, the corresponding data is read out of the memory 111 sequentially and is written to the display area 110.

In this embodiment, latching is performed at the falling edge of the S/P converter control signal, though it is permissible for latching to be performed at the rising edge of this signal. Further, the output A may be latched at the falling (rising) edge and the output B at the rising (falling) edge. In such case the S/P converter control signal can utilize a waveform whose period is twice that of the S/P converter control signal shown in FIG. 19.

13th Embodiment

A 13th embodiment of the present invention will now be described with reference to FIG. 20, which illustrates the structure of a display device according to this embodiment.

Figure 20:
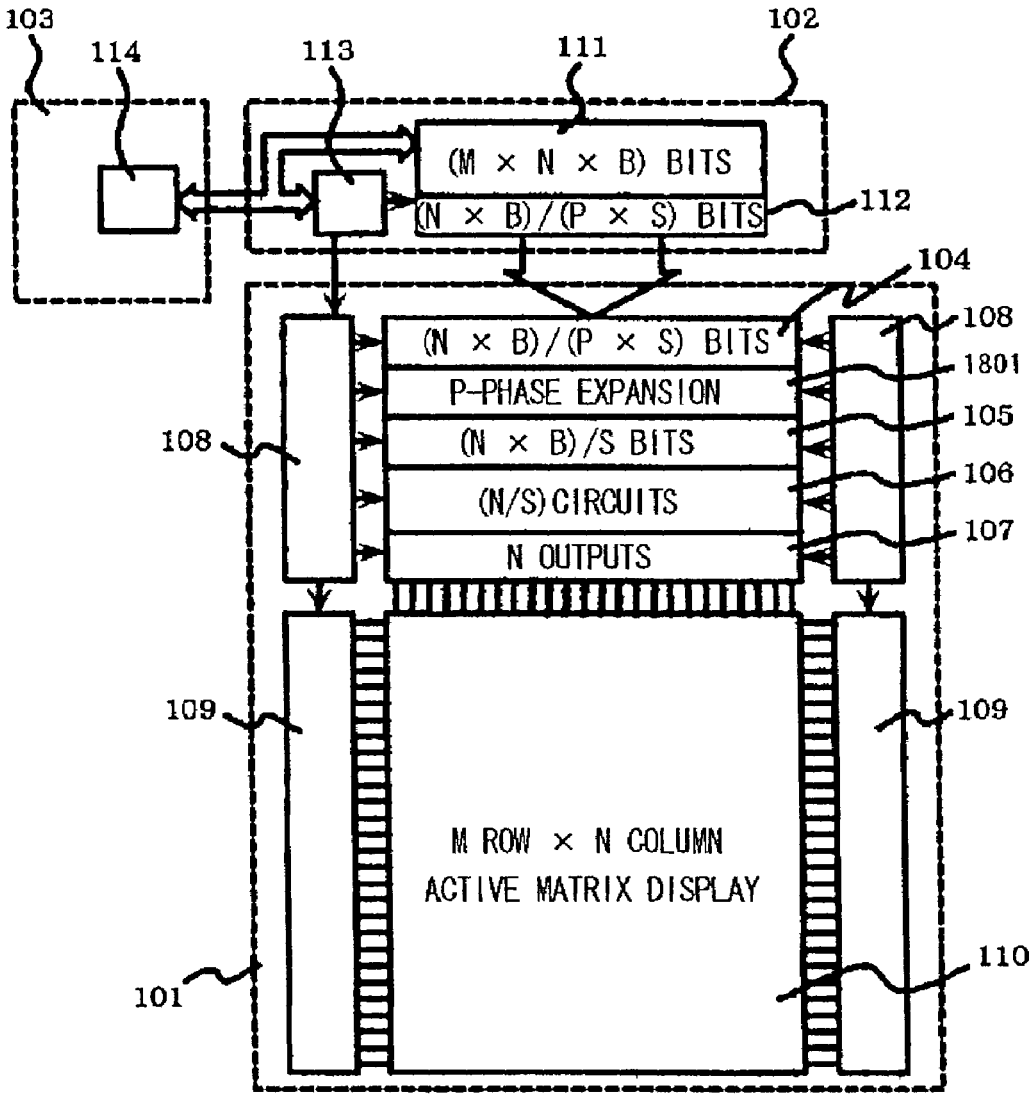
FIGS. 20, 21, 22 and 23 illustrate the structures of display devices according to $13^{th}$, $14^{th}$, $15^{th}$ and $16^{th}$ embodiments, respectively, of the present invention.

As shown in FIG. 20, the 13th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106, selector circuit 107, serial/parallel converting circuit 1801 and display area 110 and is connected to the controller IC 102. The level shifter 104, serial/parallel converting circuit 1801, latch circuit 105 and selector circuit 107 are disposed in the order mentioned, and the selector circuit 107 is connected to the column-side of the display area 110.

This embodiment differs from the 12th embodiment in that the level shifter/timing buffer 108 and scanning-line driver circuit 109 are disposed on both sides of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 comprises circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P. Like the output buffer 112, the level shifter 104 comprises circuits corresponding to (N×B)/(P×S)-number of bits. The DAC 106 comprises (N/S)-number of circuits.

14th Embodiment

A 14th embodiment of the present invention will now be described with reference to FIG. 21, which illustrates the structure of a display device according to this embodiment.

Figure 21:
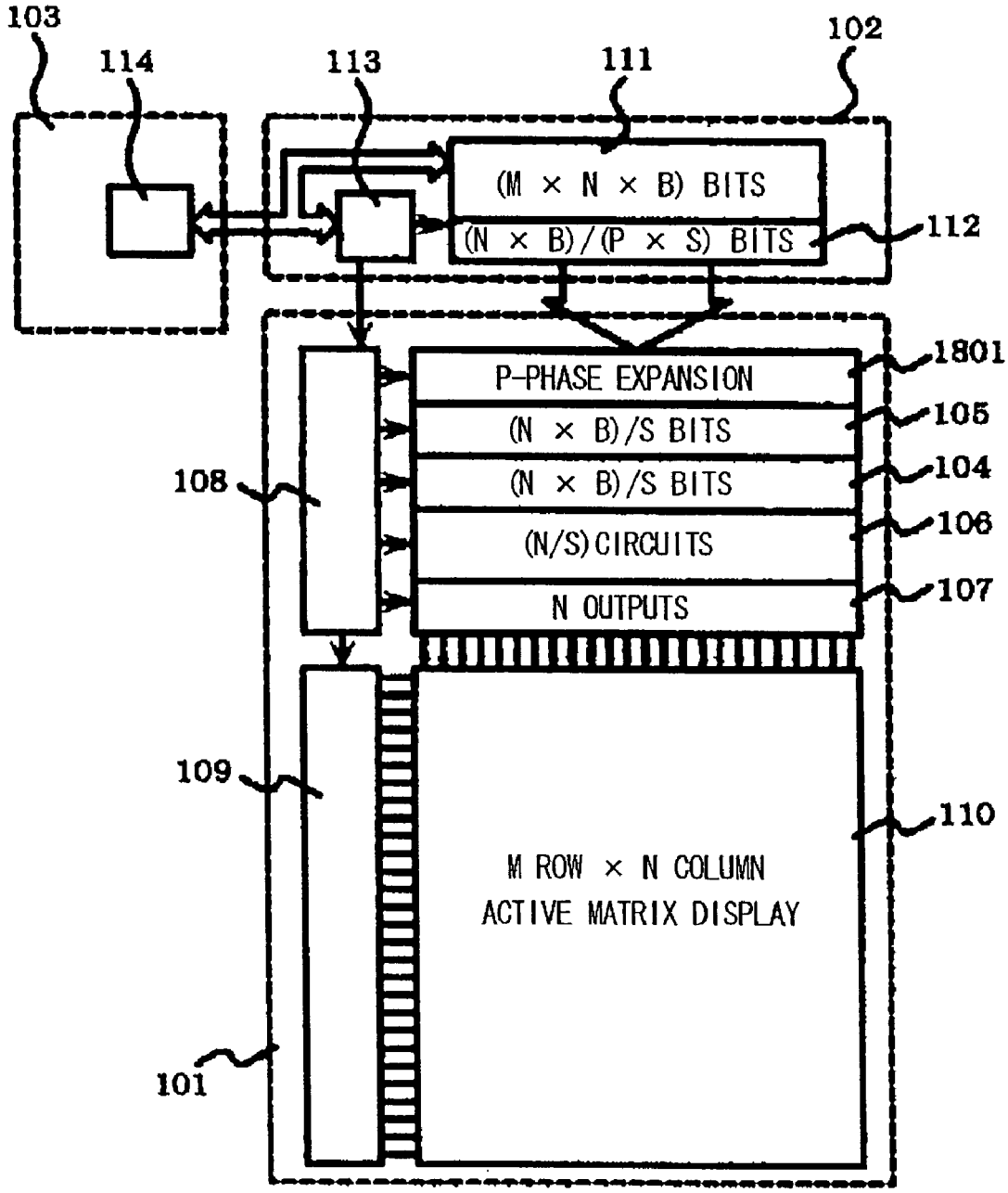

As shown in FIG. 21, the 14th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106, selector circuit 107, serial/parallel converting circuit 1801 and display area 110 and is connected to the controller IC 102. The serial/parallel converting circuit 1801, latches circuit 105, level shifter 104 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of display area 110. The output buffer 112 has circuits of (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P.

The level shifter 104 and latch circuit 105 are placed downstream of the S/P converter 1801 and therefore are composed of (N×B)/S-number of bits, which is greater than the number of output-buffer bits by a factor of P.

The DAC 106 comprises (N/S)-number of circuits.

This embodiment differs from the $12^{th}$ and $13^{th}$ embodiments in the order of placement of the S/P converter 1801, level shifter 104 and latch circuit 105 and in the numbers of circuits. It goes without saying that this embodiment also may be so arranged that the level shifter/timing buffer 108 and scanning circuit 109 are disposed on the left and right sides of the display area 110 in a manner similar to that of the 13th embodiment.

15th Embodiment

A 15th embodiment of the present invention will now be described with reference to FIG. 22, which illustrates the structure of a display device according to this embodiment.

Figure 22:
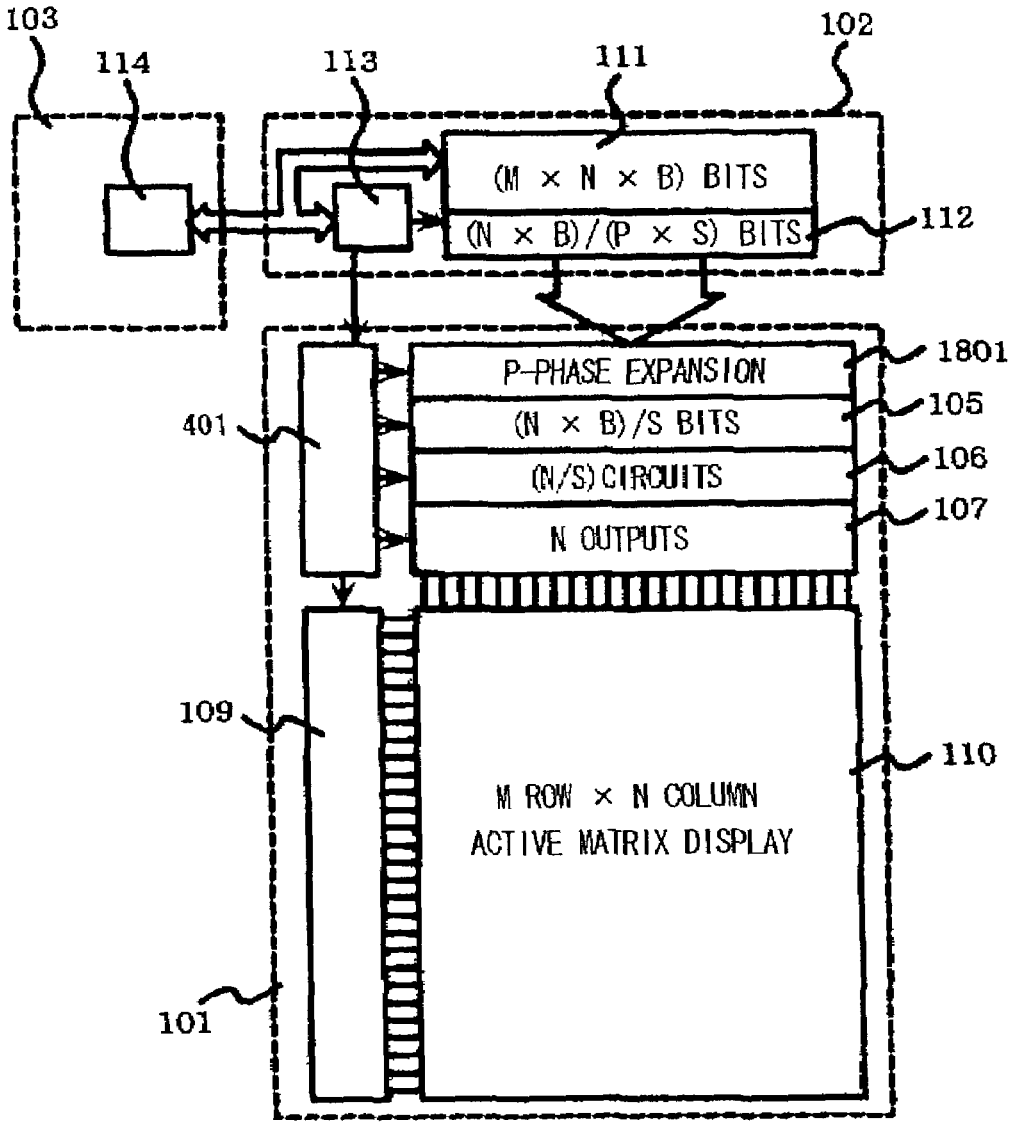

As shown in FIG. 22, the 15th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the timing buffer 401, scanning circuit 109, latch circuit 105, DAC 106, selector circuit 107, serial/parallel converting circuit 1801 and display area 110 and is connected to the controller IC 102. The serial/parallel converting circuit 1801, latches circuit 105, level shifter 104 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 comprises circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P. The latch circuit 105 is placed downstream of the S/P converter 1801 and therefore is composed of circuits corresponding to (N×B)/S-number of bits, which is greater than the number of output-buffer bits by a factor of P. The DAC 106 comprises (N/S)-number of circuits.

This embodiment differs from the $12^{th}$ and $14^{th}$ embodiments in that the level shifter 104 is not provided and in that the timing buffer 401 is provided instead of the level shifter/timing buffer 108. It goes without saying that this embodiment also may be so arranged that the timing buffer 401 and scanning circuit 109 are disposed on the left and right sides of the display area 110 in a manner similar to that of the second embodiment.

16th Embodiment

A 16th embodiment of the present invention will now be described with reference to FIG. 23, which illustrates the structure of a display device according to this embodiment.

Figure 23:
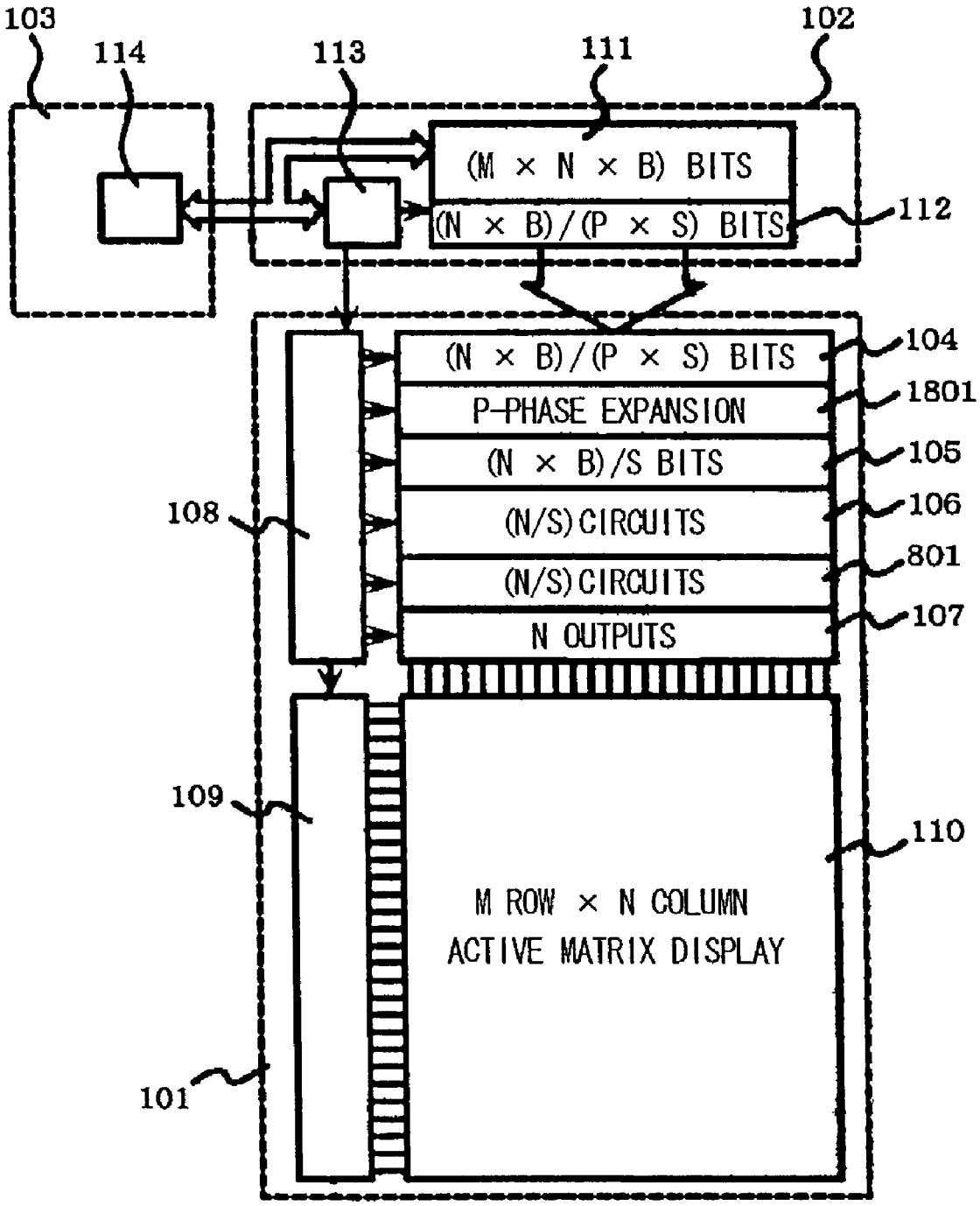

As shown in FIG. 23, the 16th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106, selector circuit 107, serial/parallel converting circuit 1801, voltage-current converting circuit/current output buffer 801 and display area 110 and is connected to the controller IC 102. The level shifter 104, serial/parallel converting circuit 1801, latch circuit 105, DAC 106, voltage-current converting circuit/current output buffer 801 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 is comprised of circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P.

Like the output buffer 112, the level shifter 104 is comprised of circuits corresponding to (N×B)/(P×S)-number of bits.

The DAC 106 and voltage-current converting circuit/current output buffer 801 each comprise (N/S)-number of circuits.

This embodiment differs from the other embodiments in that the voltage-current converting circuit/current output buffer 801 are provided. It goes without saying that this embodiment also may be so arranged that the level shifter/timing buffer 108 and scanning circuit 109 are disposed on the left and right sides of the display area 110 in a manner similar to that of the second embodiment.

Figure 24:
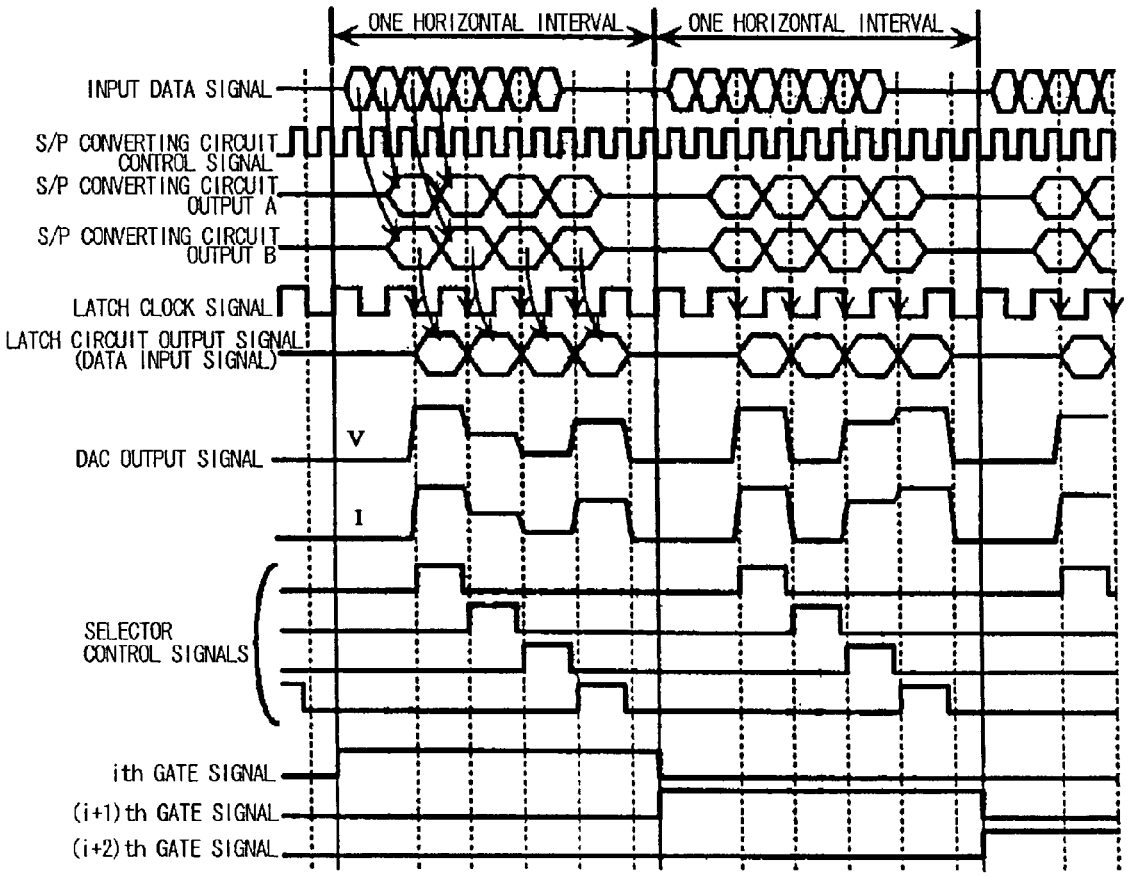
FIG. 24 is a diagram useful in describing the timing operation of the display device according to the $16^{th}$ embodiment.

FIG. 24 is a diagram useful in describing the timing operation of the 16th embodiment. When an input data signal is supplied to the display device substrate 101 in one horizontal scanning period, as shown in FIG. 24, the signal becomes one that has been expanded to a serial-parallel expansion number P (here P=2 holds) by the S/P converter 1801. This expansion is controlled by the S/P converter control signal in the S/P converter 1801.

In the example shown in FIG. 24, odd-numbered data of the input data signal is latched at the timing of the falling edges of odd-numbered (even-numbered) pulses of the S/P converter control signal, and an S/P converter output A is produced. On the other hand, even-numbered data of the input data signal is latched at the timing of the falling edges of even-numbered (odd-numbered) pulses of the S/P converter control signal, and an S/P converter output B is produced.

In a case where the expansion number P is equal to or greater than 3, the data signal is expanded in multiples of P.

Next, the data signal is latched at the timing of the falling edge of a latch clock signal supplied to the latch circuit 105.

As a result, the output signal of the latch circuit 105 becomes as illustrated in FIG. 24. This signal becomes the input signal to the DAC 106.

Each data signal undergoes a DA (digital-to-analog) conversion in the DAC 106, whereby there is obtained an analog signal conforming to the digital value of each gray level. Control pulses are scanned sequentially with respect to S-number of lines (where S represents the block dividing number, and S=4 holds in FIG. 24) as a selector control signal, as shown in FIG. 24.

When the selector control signal is supplied to the selector circuit 107, the latter selects signals sequentially from the output signals of the DAC 106, separates the signals into S-number of signals and sends these signals to each of the signal lines of a signal-line group in which the number of lines is S, namely the block dividing number. By arraying (N/S)-number of these signal-line groups and supplying all of them with signals in parallel, supply of signals to N-number of signal lines in one horizontal scanning period is achieved. Gate signals are held at the high level for one horizontal scanning period and revert to the low level at all other times. The gate signals are scanned sequentially so that they are supplied to M-number of gate lines.

In this embodiment, it is possible to present a display on the display area 110 of M rows and N columns using the arrangement illustrated in FIGS. 23 and 24. The data signals supplied to the display area 110 of M rows and N columns are digital signals, and data of (M×N×B) bits is stored in the memory 111 in accordance with the number B of digital grayscale bits.

The output buffer 112 outputs data, upon dividing the data by the block dividing number S and separating the data into the serial/parallel phase expansion number P, every M-number of gate scanning lines. As a result, data is transferred in units of (N×B)/(P×S) bits. This means that it is possible to transfer data at a transfer rate that is slow in comparison with the conventional transfer method.

The level shifter 104 from input data having low voltage amplitude to high voltage value boosts the transferred data signal. Since data transfer at a high voltage is made unnecessary by the level shifter 104, power consumption is reduced greatly.

As shown in FIG. 24, the S/P converter 1801 expands the signal into an output signal of the serial/parallel phase expansion number P (here P=2 holds). The level shifter 104 and S/P converter 1801 execute processing in units of (N×B)/(P×S) bits, which is the same as the number of bits transferred from the output buffer 112.

The latch circuit 105 latches the data signal in the manner shown in FIG. 24. The latch circuit 105 takes on a number of bits that is a multiple of P owing to the serial/parallel conversion and executes processing in units of (N×B)/S bits.

The DAC 106, comprises (N/S)-number of circuits, each of which executes a digital-to-analog conversion from a data group of B grayscale bits at a time from among the (N×B)/S bits input thereto and obtains a single analog signal, whereby (N/S)-line analog data signals are output from the DAC circuits in their entirety.

The (N/S)—line analog data signals are converted from voltage to current signals by the voltage-current converting circuit/current output buffer 801. The (N/S)-line analog current signals are selected sequentially by the selector circuit 107 in a time obtained by division by the block dividing number S on a per-bit basis, whereby data signals are supplied to a group of S-number of data lines. As a result, data signals are supplied to N-number of data lines.

Whenever each gate line of the M-number of gate lines is scanned, the corresponding data is read out of the memory 111 sequentially and is written to the display area 110.

In this embodiment, latching is performed at the falling edge of the S/P converter control signal, though it is permissible for latching to be performed at the rising edge of this signal. Further, the output A may be latched at the falling (rising) edge and the output B at the rising (falling) edge. In such case the S/P converter control signal can utilize a waveform whose period is twice that of the S/P converter control signal shown in FIG. 24.

17th Embodiment

A 17th embodiment of the present invention will now be described with reference to FIG. 25, which illustrates the structure of a display device according to this embodiment.

Figure 25:
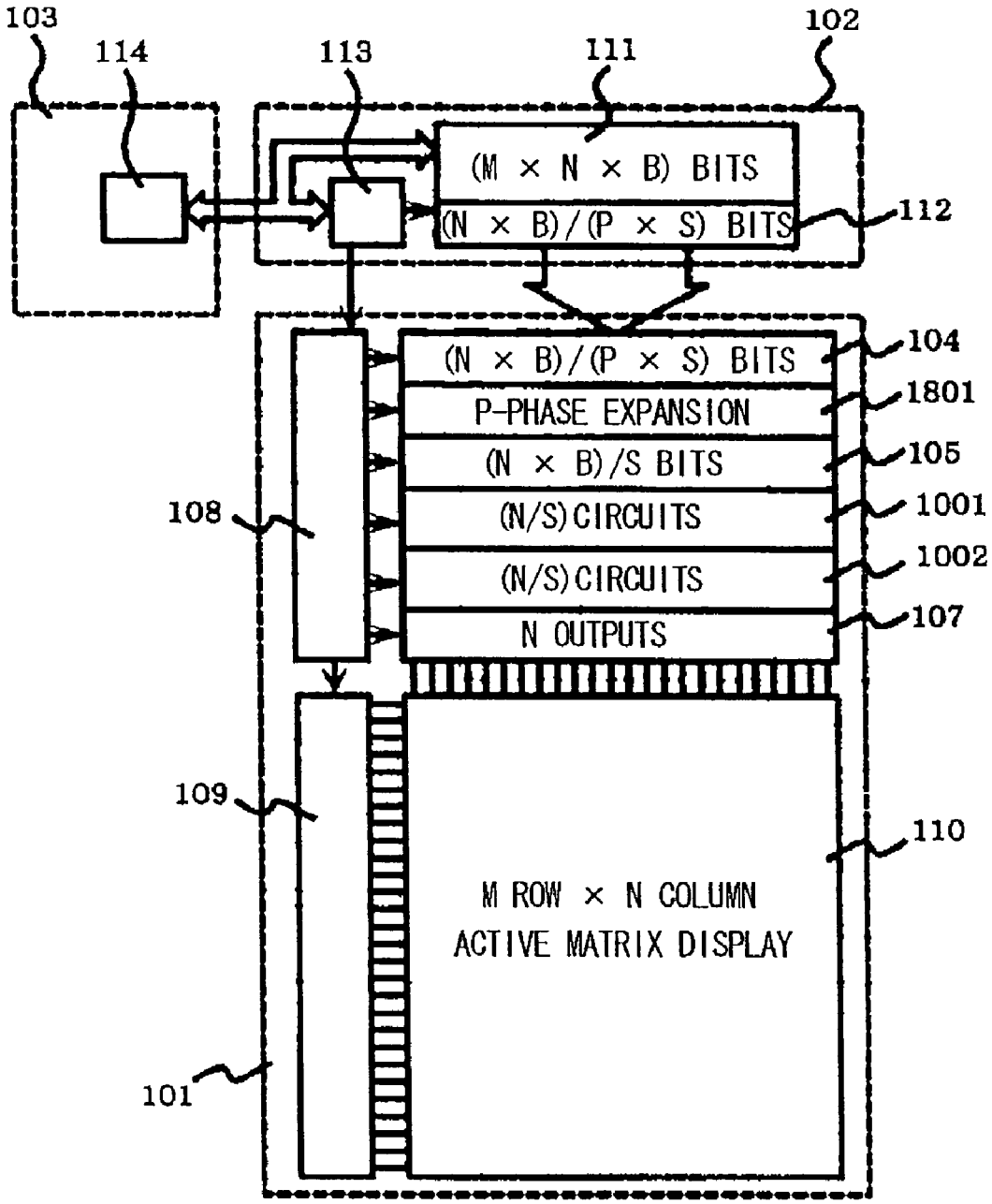
FIGS. 25 and 26 illustrate the structures of display devices according to $17^{th}$ and $18^{th}$ embodiments, respectively, of the present invention.

As shown in FIG. 25, the 17th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, decoder circuit 1001, selector circuit 107, serial/parallel converting circuit 1801, current output buffer 1002 and display area 110 and is connected to the controller IC 102. The level shifter 104, serial/parallel converting circuit 1801, latch circuit 105, decoder circuit 1001, current output buffer 1002 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 is comprised of circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P. The latch circuit 105 is comprised of circuits corresponding to (N×B)/S-number of bits. The decoder circuit 1001 and current output buffer 1002 each comprise (N/S)-number of circuits.

This embodiment differs from the above embodiment in that the decoder circuit 1001 and current output buffer 1002 are provided. It goes without saying that this embodiment also may be so arranged that the level shifter/timing buffer 108 and scanning circuit 109 are disposed on the left and right sides of the display area 110 in a manner similar to that of the 13th embodiment.

18th Embodiment

A 18th embodiment of the present invention will now be described with reference to FIG. 26, which illustrates the structure of a display device according to this embodiment.

Figure 26:
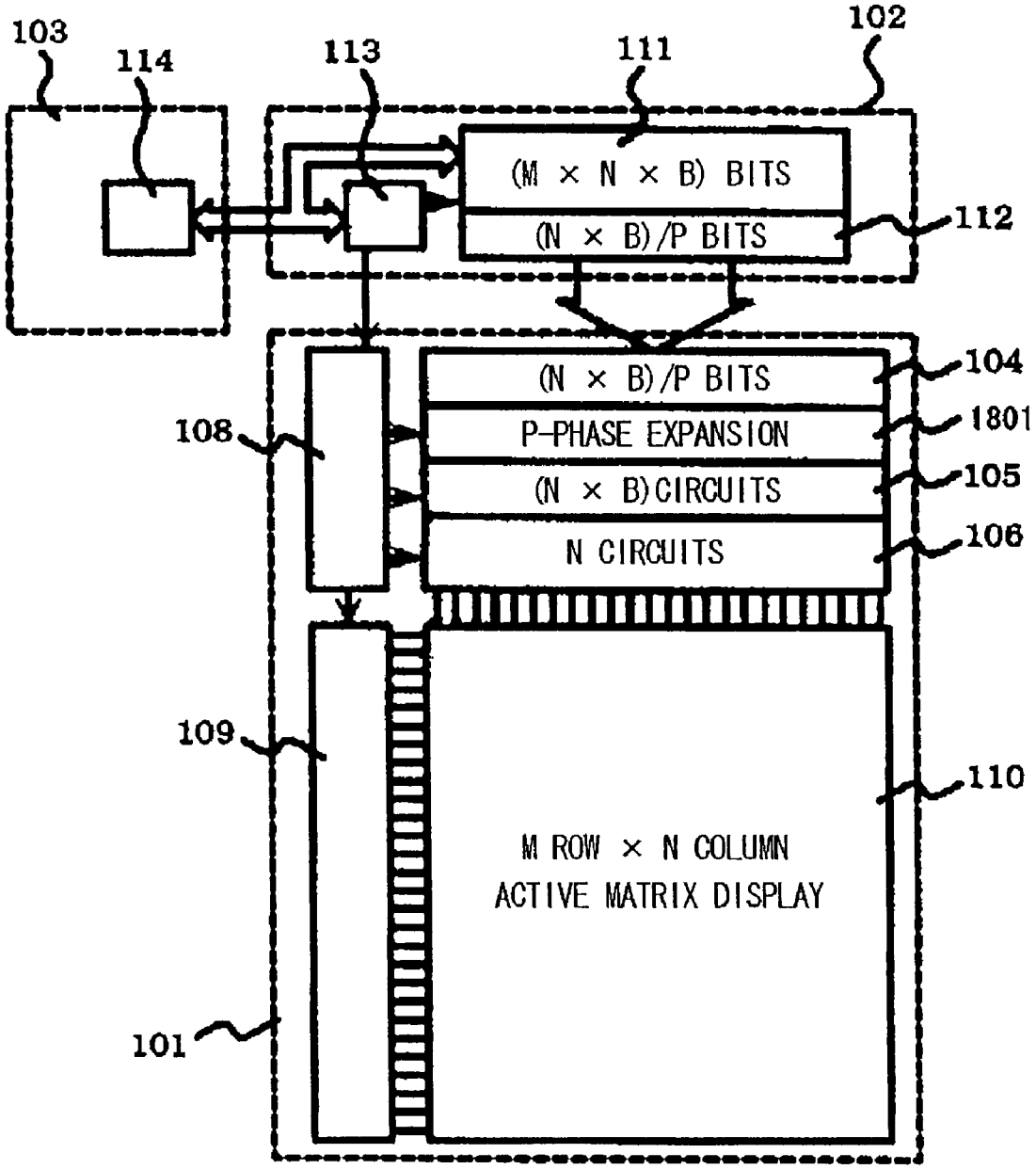

As shown in FIG. 26, the 18th embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, level shifter 104, latch circuit 105, DAC 106, S/P converter 1801 and display area 110 and is connected to the controller IC 102. The level shifter 104, serial/parallel-converting circuit 1801, latch circuit 105 and DAC 106 are disposed in the order mentioned, and the DAC 106 is connected to the column-side of the display area 110.

According to this embodiment, the display area 110 presents an active-matrix display of M rows and N columns, and the number of grayscale bits is B. Thus the memory 11 has a capacity of (M×N×B) bits.

Further, the DAC 106 has N-number of outputs, which is the same as the number of inputs on the column side of the display area 110. The output buffer 112 is comprised of circuits corresponding to (N×B)/P-number of bits. This number is obtained by dividing (N×B) bits, which correspond to one row of bits in the (M×N×B)-number of bits of the display memory 111, by the serial-parallel phase expansion number P. The latch circuit 105 is composed of circuits (N×B)-number of bits. The DAC 106 comprises N circuits.

This embodiment differs from the other embodiments in that the selector circuit 107 is not provided and in that the numbers of bits of the circuits differ. It goes without saying that this embodiment also may be so arranged that the level shifter/timing buffer 108 and scanning circuit 109 are disposed on the left and right sides of the display area 110 in a manner similar to that of the 13th embodiment.

Figure 27:
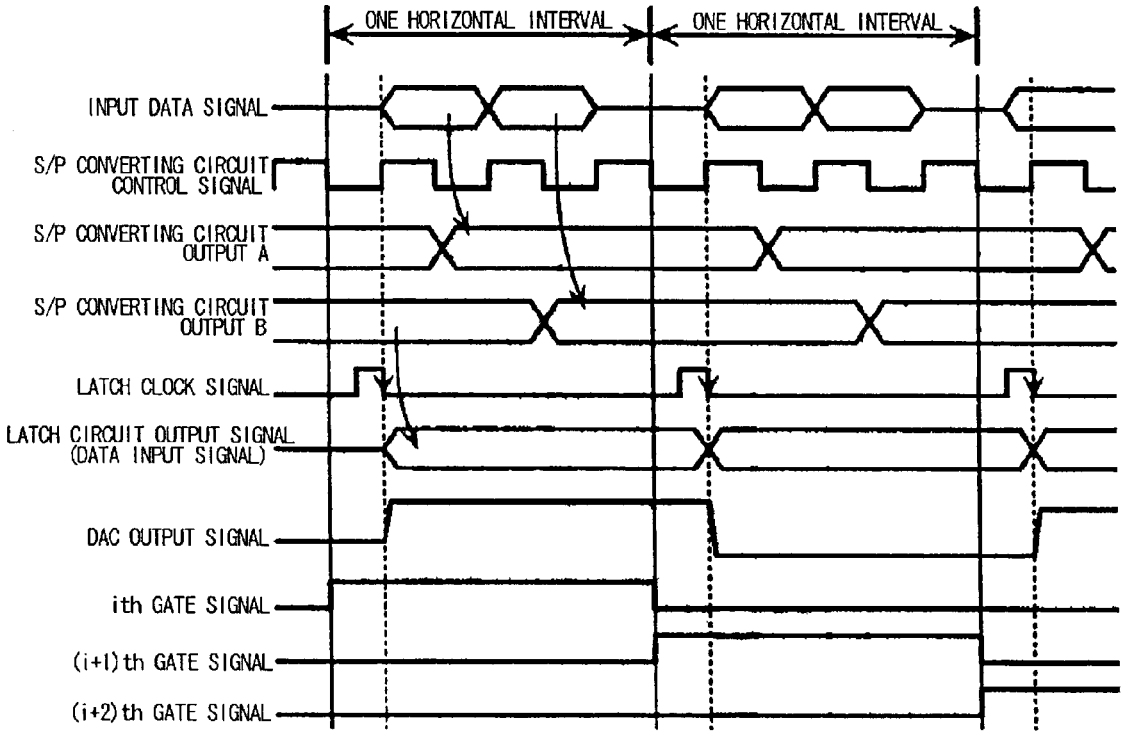
FIG. 27 is a diagram useful in describing the timing operation of the display device according to the $18^{th}$ embodiment.

FIG. 27 is a diagram useful in describing the timing operation of the 18th embodiment. When an input data signal is supplied to the display device substrate 101 in one horizontal scanning period, as shown in FIG. 27, the signal becomes one that has been expanded to a serial-parallel expansion number P (here P=2 holds) by the S/P converter 1801. This expansion is controlled by the S/P converter control signal in the S/P converter 1801.

In the example shown in FIG. 27, odd-numbered data of the input data signal is latched at the timing of the falling edges of odd-numbered (even-numbered) pulses of the S/P converter control signal, and an S/P converter output A is produced. On the other hand, even-numbered data of the input data signal is latched at the timing of the falling edges of even-numbered (odd-numbered) pulses of the S/P converter control signal, and an S/P converter output B is produced. In a case where the expansion number P is equal to or greater than 3, the data signal is expanded in multiples of P. Next, the data signal is latched at the timing of the falling edge of a latch clock signal supplied to the latch circuit 105. As a result, the output signal of the latch circuit 105 becomes as illustrated in FIG. 27. This signal becomes the input signal to the DAC 106. Each data signal undergoes a DA (digital-to-analog) conversion in the DAC 106, whereby there is obtained an analog signal conforming to the digital value of each gray level. The DAC output signals are sent to respective ones of the data signals lines as is.

Each gate signal is held at the high level for one horizontal scanning period and reverts to the low level at all other times. The gate signals are scanned sequentially so that they are supplied to M-number of gate lines.

In this embodiment, it is possible to present a display on the display area 110 of M rows and N columns using the arrangement illustrated in FIGS. 26 and 27. The data signals supplied to the display area 110 of M rows and N columns are digital signals, and data of M×N ×B bits is stored in the memory 111 in accordance with the number B of digital grayscale bits. The output buffer 112 outputs data, upon separating the data into the serial/parallel phase expansion number P, every M-number of gate scanning lines. As a result, data is transferred in units of (N×B)/P bits. This means that it is possible to transfer data at a transfer rate that is slow in comparison with the conventional transfer method. The level shifter 104 from input data having low voltage amplitude to high voltage value boosts the transferred data signal. Since data transfer at a high voltage is made unnecessary by the level shifter 104, power consumption is reduced greatly.

As shown in FIG. 27, the S/P converter 1801 expands the signal into an output signal of the serial/parallel phase expansion number P (here P=2 holds). The level shifter 104 and S/P converter 1801 execute processing in units of (N×B)/P bits, which is the same as the number of bits transferred from the output buffer 112. The latch circuit 105 latches the data signal in the manner shown in FIG. 27. The latch circuit 105 takes on number of bits that is a multiple of P owing to the serial/parallel conversion and executes processing in units of (N×B) bits. The DAC 106 comprises N-number of circuits, each of which executes a digital-to-analog conversion from a data group of B grayscale bits at a time from among the (N×B) bits supplied thereto and obtains a 1-line analog signal, whereby N-line analog signal data is output from the DAC circuits in their entirety. The N-line analog data signals are supplied to the N-number of data lines as is. Whenever each gate line of the M-number of gate lines is scanned, the corresponding data is read out of the memory 111 sequentially and is written to the display area 110.

In this embodiment, latching is performed at the falling edge of the S/P converter control signal, though it is permissible for latching to be performed at the rising edge of this signal. Further, the output A may be latched at the falling (rising) edge and the output B at the rising (falling) edge. In such case the S/P converter control signal can utilize a waveform whose period is twice that of the S/P converter control signal shown in FIG. 27.

19th Embodiment

A 19th embodiment of the present invention will now be described with reference to FIG. 28, which illustrates the structure of a display device according to this embodiment.

Figure 28:
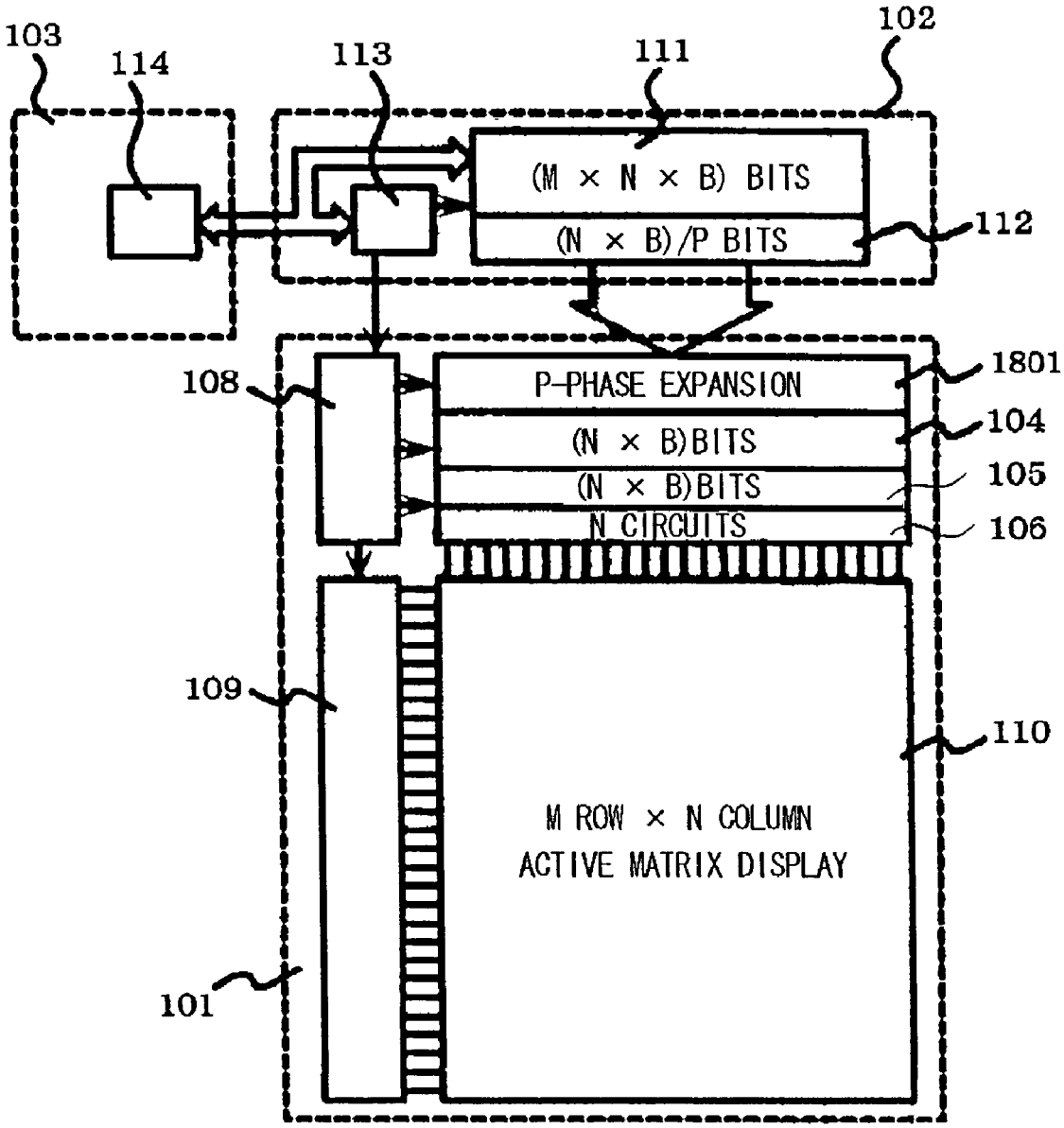
FIGS. 28, 29 and 30 illustrate the structures of display devices according to $19^{th}$, $20^{th}$ and 21st embodiments, respectively, of the present invention.

As shown in FIG. 28, the 19th embodiment includes the circuit board 103 on the system side, the controller IC 102 and the display device substrate 101.

The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the level shifter/timing buffer 108, scanning circuit 109, S/P converter 1801, level shifter 104, latch circuit 105, DAC 106, S/P converter 1801 and display area 110 and is connected to the controller IC 102. The S/P converter 1801, level shifter 104, latch circuit 105 and DAC 106 are disposed in the order mentioned, and the DAC 106 is connected to the column-side of the display area 11

According to this embodiment, the display area 110 presents an active-matrix display of M rows and N columns, and the number of grayscale bits is B. Thus the memory 11 has a capacity of (M×N×B) bits. Further, the DAC 106 has N-number of outputs, which is the same as the number of inputs on the column side of the display area 110.

The output buffer 112 is comprised of circuits corresponding to (N ×B)/P-number of bits, which correspond to one row of bits in the (M×N×B)-number of bits of the display memory 111. The latch circuit 105 is comprised of circuits corresponding to (N×B)-number of bits. The DAC 106 comprises N circuits.

This embodiment differs from the $18^{th}$ embodiment in the placement of the level shifter 104 and in the numbers of bits thereof. It goes without saying that this embodiment also may be so arranged that the level shifter/timing buffer 108 and scanning circuit 109 are disposed on the left and right sides of the display area 110 in a manner similar to that of the 13th embodiment.

20th Embodiment

A 20th embodiment of the present invention will now be described with reference to FIG. 29, which illustrates the structure of a display device according to this embodiment.

Figure 29:
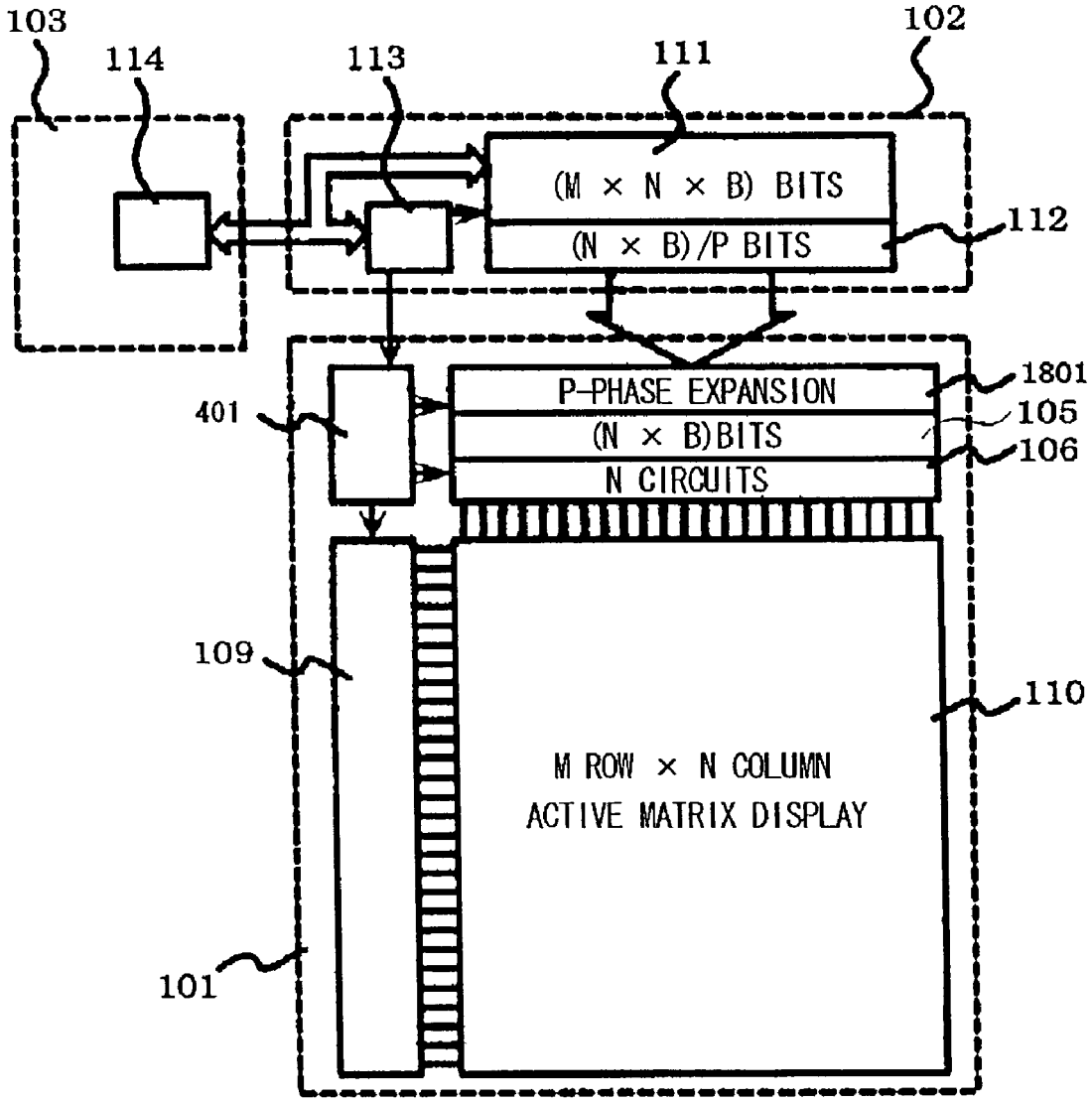

As shown in FIG. 29, the 19th embodiment includes the circuit board 103 on the system side, the controller IC 102 and the display device substrate 101.

The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101.

The display device substrate 101 has, built in, the timing buffer 401, scanning circuit 109, S/P converter 1801, level shifter 104, latch circuit 105, DAC 106, S/P converter 1801 and display area 110 and is connected to the controller IC 102. The S/P converter 1801, latches circuit 105 and DAC 106 are disposed in the order mentioned, and the DAC 106 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the DAC 106 has N-number of outputs, which is the same as the number of inputs on the column side of the display area 110.

The output buffer 112 has circuits of (N×B)/P-number of bits, which correspond to one row of bits in the (M×N×B)-number of bits of the display memory 111. The S/P converter 1801 receives the serial output from the output buffer 112 P times and expands it into P phases (i.e., outputs P bits in parallel). The S/P converter 1801 outputs (N×B)-number of bits in parallel. The latch circuit 105 has circuits of (N×B)-number of bits. The DAC 106 comprises N-number of DAC circuits.

This embodiment differs from the $18^{th}$ and $19^{th}$ embodiments in that the level shifter 104 is not provided and the timing buffer 401 is provided instead of the level shifter/timing buffer 108. It goes without saying that this embodiment also may be so arranged that the timing buffer 401 and scanning circuit 109 are disposed on the left and right sides of the display area 110 in a manner similar to that of the 13th embodiment.

21st Embodiment

A 21st embodiment of the present invention will now be described with reference to FIG. 30, which illustrates the structure of a display device according to this embodiment.

As shown in FIG. 26, the 21st embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The display device substrate 101 has, built in, the level shifter/timing buffer 108, scanning circuit 109, S/P converter 1801, level shifter 104, latch circuit 105, DAC 106, voltage-current converting circuit/current output buffer 801 and display area 110 and is connected to the controller IC 102. The level shifter 104, serial/parallel-converting circuit 1801, latch circuit 105, DAC 106 and voltage-current converting circuit/current output buffer 801 are disposed in the order mentioned, and the voltage-current converting circuit/current output buffer 801 is connected to the column-side of the display area 10.

According to this embodiment, the display area 110 presents an active-matrix display of M rows and N columns, and the number of grayscale bits is B. Thus the memory 11 has a capacity of (M×N×B) bits. The voltage-current converting circuit/current output buffer 801 has N-number of outputs, which is the same as the number of inputs on the column side of the display area 110.

The output buffer 112 is comprised of circuits corresponding to (N×B)/P-number of bits. This number is obtained by dividing (N×B) bits, which correspond to one row of bits in the (M×N×B)-number of bits of the display memory 111, by P. Like the output buffer 112, the level shifter 104 is comprised of circuits corresponding to (N×B)/P-number of bits. The latch circuit 105, which receives the parallel output (P) of the S/P converter 1801, is comprised of circuits corresponding to (N×B)-number of bits. The DAC 106 and the voltage-current converting circuit/current output buffer 801 each comprise N circuits.

This embodiment differs from the other embodiments in that the voltage-current converting circuit/current output buffer 801 are provided. It goes without saying that this embodiment also may be so arranged that the level shifter/timing buffer 108 and scanning circuit 109 are disposed on the left and right sides of the display area 110 in a manner similar to that of the 13th embodiment.

Figure 31:
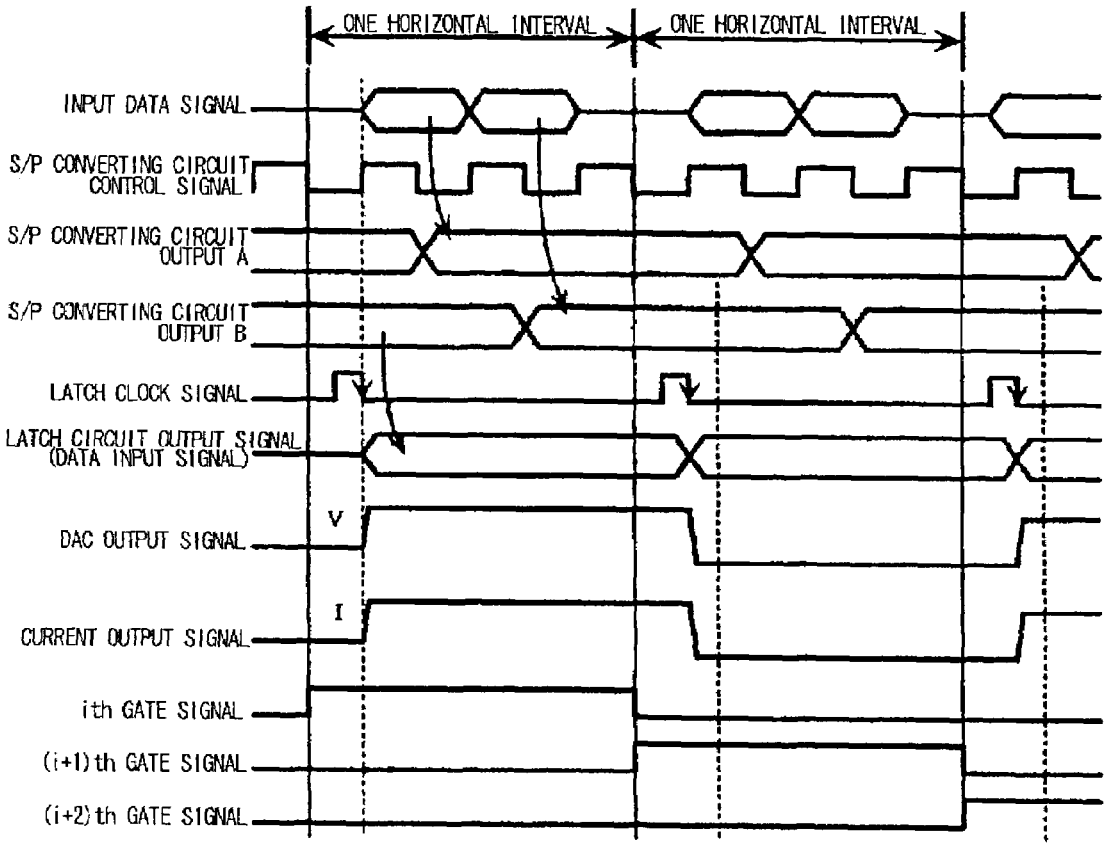
FIG. 31 is a diagram useful in describing the timing operation of the display device according to the $21^{st}$ embodiment.

FIG. 31 is a diagram useful in describing the timing operation of the 21st embodiment. When an input data signal is supplied to the display device substrate 101 in one horizontal scanning period, as shown in FIG. 31, the signal becomes one that has been expanded to a serial-parallel expansion number P (here P=2 holds) by the S/P converter 1801.

This expansion is controlled by the S/P converter control signal in the S/P converter 1801. In the example shown in FIG. 31, odd-numbered data of the input data signal is latched at the timing of the falling edges of odd-numbered (even-numbered) pulses of the S/P converter control signal, and an S/P converter output A is produced. On the other hand, even-numbered data of the input data signal is latched at the timing of the falling edges of even-numbered (odd-numbered) pulses of the S/P converter control signal, and an S/P converter output B is produced.

Next, the data signal is latched at the timing of the falling edge of a latch clock signal supplied to the latch circuit 105. As a result, the output signal of the latch circuit 105 becomes as illustrated in FIG. 31. This signal becomes the input signal to the DAC 106. Each data signal undergoes a DA (digital-to-analog) conversion in the DAC 106, whereby there is obtained an analog signal conforming to the digital value of each gray level. Though the DAC output signal is a voltage signal, this is converted to a current output signal by the voltage-current converting circuit/current output buffer 801. The current output signals are sent to the data signal lines as is. Each gate signal is held at the high level for one horizontal scanning period and reverts to the low level at all other times. The gate signals are scanned sequentially so that they are supplied to M-number of gate lines.

Figure 30:
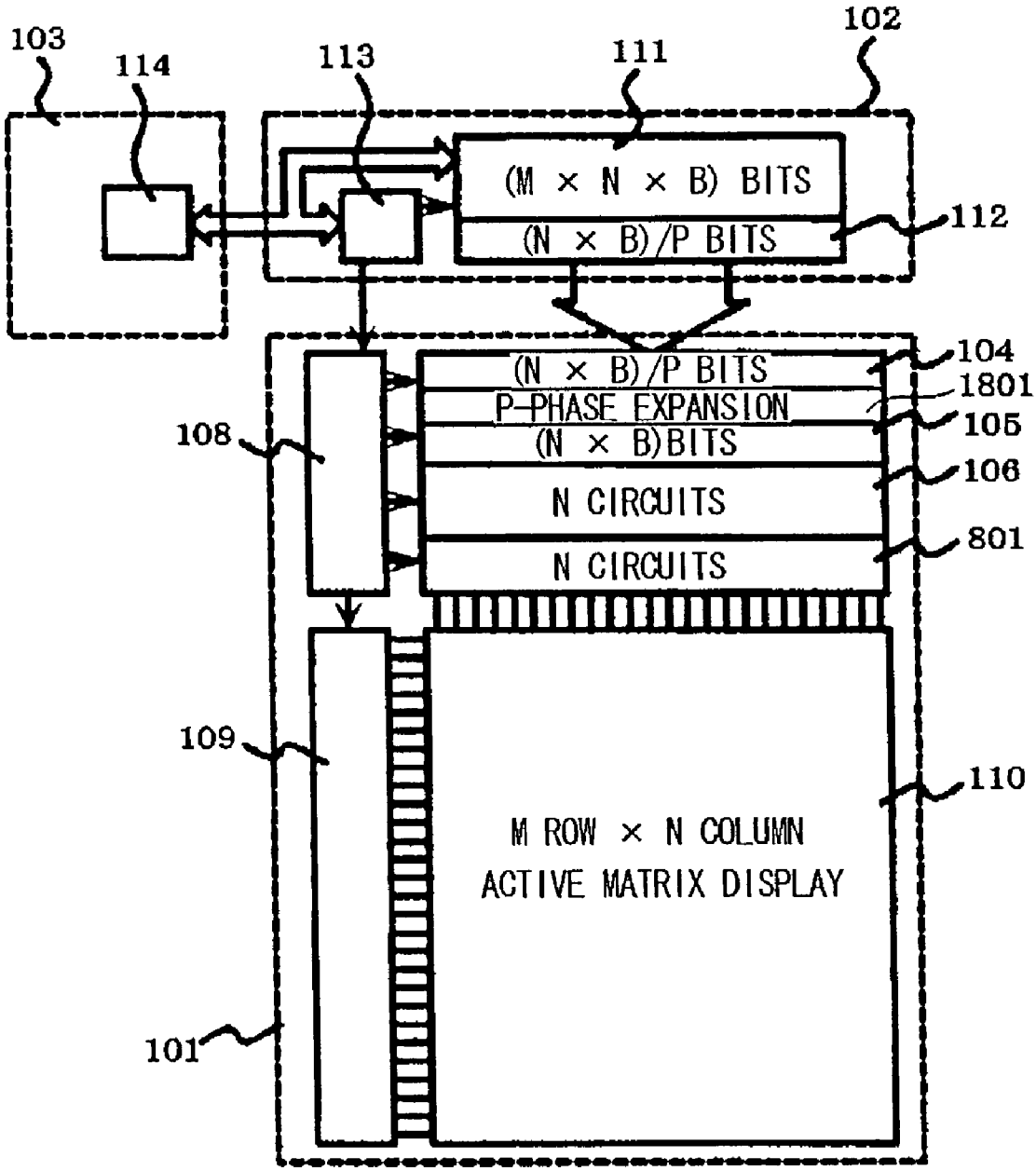

In this embodiment, it is possible to present a display on the display area 110 of M rows and N columns using the arrangement illustrated in FIGS. 30 and 31. The data signals supplied to the display area 110 of M rows and N columns are digital signals, and data of (M×N×B) bits is stored in the memory 111 in accordance with the number B of digital grayscale bits. The output buffer 112 outputs data, upon separating the data into the serial/parallel phase expansion number P, every M-number of gate scanning lines. As a result, data is transferred in units of (N×B)/P bits. This means that it is possible to transfer data at a transfer rate that is slow in comparison with the conventional transfer method. The level shifter 104 from input data having low voltage amplitude to high voltage value boosts the transferred data signal. Since data transfer at a high voltage is made unnecessary by the level shifter 104, power consumption is reduced greatly. As shown in FIG. 31, the S/P converter 1801 expands the signal into an output signal of the serial/parallel phase expansion number P (here P=2 holds). The level shifter 104 and S/P converter 1801 execute processing in units of (N×B)/P bits, which is the same as the number of bits transferred from the output buffer 112.

The latch circuit 105 latches the data signal in the manner shown in FIG. 31. The latch circuit 105 takes on number of bits that is a multiple of P owing to the serial/parallel conversion and executes processing in units of (N×B) bits. The DAC 106, which comprises N-number of circuits, executes a digital-to-analog conversion from a data group of B grayscale bits at a time from among the (N×B) bits input thereto and obtains a single analog signal, whereby N-number analog signal data is output from the DAC circuits in their entirety. The N-line analog data signals are converted from voltage to current signals by the voltage-current converting circuit/current output buffer 801, which comprises N bits. The N-number analog current data signals are supplied to the N-number of data lines as is. Whenever each gate line of the M-number of gate lines is scanned, the corresponding data is read out of the memory 111 sequentially and is written to the display area 110.

In this embodiment, latching is performed at the falling edge of the S/P converter control signal, though it is permissible for latching to be performed at the rising edge of this signal. Further, the output A may be latched at the falling (rising) edge and the output B at the rising (falling) edge. In such case the S/P converter control signal can utilize a waveform whose period is twice that of the S/P converter control signal shown in FIG. 31.

22nd Embodiment

Figure 32:
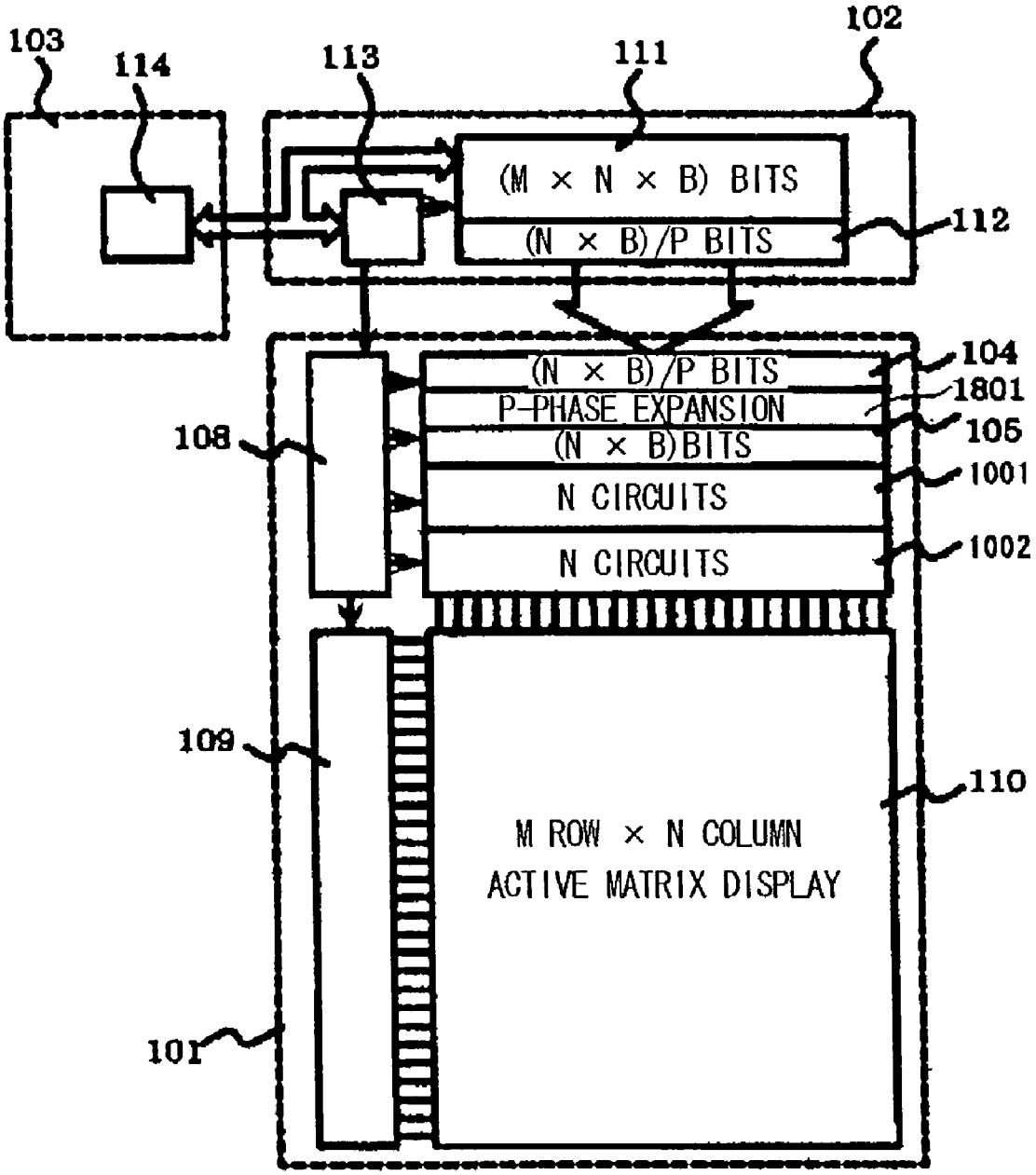
FIGS. 32, 33 and 34 illustrate the structures of display devices according to $22^{nd}$, $23^{rd}$ and $24^{th}$ embodiments, respectively, of the present invention.

A 22nd embodiment of the present invention will now be described with reference to FIG. 32, which illustrates the structure of a display device according to this embodiment. As shown in FIG. 32, the 22nd embodiment includes the circuit board 103 on the system side, the controller IC 102 and the display device substrate 101. The circuit board 103 on the system side includes the interface circuit 114 by which the board is connected to the controller IC 102. The controller IC 102 includes the controller 113, the memory 111 and the output buffer 112 and is connected to the system circuit board 103 and to the display device substrate 101. The display device substrate 101 has, built in, the level shifter/timing buffer 108, scanning circuit 109, level shifter 104, latch circuit 105, S/P converter 1801, decoder circuit 1001, current output buffer 1002 and display area 110 and is connected to the controller IC 102. The level shifter 104, serial/parallel converting circuit 1801, latch circuit 105, decoder circuit 1001 and current output buffer 1002 are disposed in the order mentioned, and the current output buffer 1002 is connected to the column-side of the display area 110.

According to this embodiment, the display area 110 presents an active-matrix display of M rows and N columns, and the number of grayscale bits is B. Thus the memory 11 has a capacity of (M×N×B) bits. The current output buffer 1002 have N-number of outputs, which is the same as the number of inputs on the column side of the display area 110.

The output buffer 112 is comprised of circuits(buffer circuits) corresponding to (N×B)/P-number of bits. This number is obtained by dividing (N×B) bits, which correspond to one row of bits in the (M×N×B)-number of bits of the display memory 111, solely by the serial/parallel phase expansion number P.

Like the output buffer 112, the level shifter 104 is comprised of circuits corresponding to (N×B)/P-number of bits. The latch circuit 105 is comprised of circuits(latch) corresponding to (N×B)-number of bits.

The decoder circuit 1001 and current output buffer 1002 each comprise N circuits.

This embodiment differs from the other embodiments in that the current output buffer 1002 are provided. It goes without saying that this embodiment also may be so arranged that the level shifter/timing buffer 108 and scanning circuit 109 are disposed on the left and right sides of the display area 110 in a manner similar to that of the 13th embodiment.

23rd Embodiment

A 23rd embodiment of the present invention will now be described with reference to FIG. 33, which illustrates the structure of a display device according to this embodiment. As shown in FIG. 33, the 23rd embodiment includes the circuit board 103 on the system side and the display device substrate 101. The circuit board 103 on the system side includes the interface circuit 114 by which the board is connected to the display device substrate 101. The display device substrate 101 has, built in, the controller 113, memory 111, output buffer 112, scanning circuit 109, latch circuit 105, S/P converter 1801, DAC 106, selector circuit 107 and display area 110 and is connected to the circuit board 103 on the system side. The serial/parallel converting circuit 1801, latch circuit 105, DAC 106 and selector circuit 107 are disposed in the order mentioned, and the selector circuit 107 is connected to the column-side of the display area 110.

According to this embodiment, the display area 110 presents an active-matrix display of M rows and N columns, and the number of grayscale bits is B. Thus the memory 11 has a capacity of (M×N×B) bits. Further, the selector circuit 107 has N-number of outputs, which is the same as the number of inputs on the column side of the display area 110. The output buffer 112 is comprised of circuits corresponding to (N×B)/(P×S)-number of bits. This number is obtained by dividing (N×B) bits, which correspond to one row of bits in the (M×N×B)-number of bits of the display memory 111, by the product of the block dividing number S and serial-parallel phase expansion number P. The latch circuit 105 is placed downstream of the S/P converter 1801 and therefore is composed of circuits corresponding to (N×B)/S-number of bits, which is greater than the number of output-buffer bits by a factor of P. The DAC 106 comprises (N/S)-number of circuits.

This embodiment differs from the other embodiments in that the controller IC 102 is not provided and in that the memory 111 and buffer 112 are placed on the display device substrate 101. It goes without saying that this embodiment also may be so arranged that the controller 113 and scanning circuit 109 are disposed on the left and right sides of the display area 110 in a manner similar to that of the second embodiment.

24th Embodiment

Figure 34:
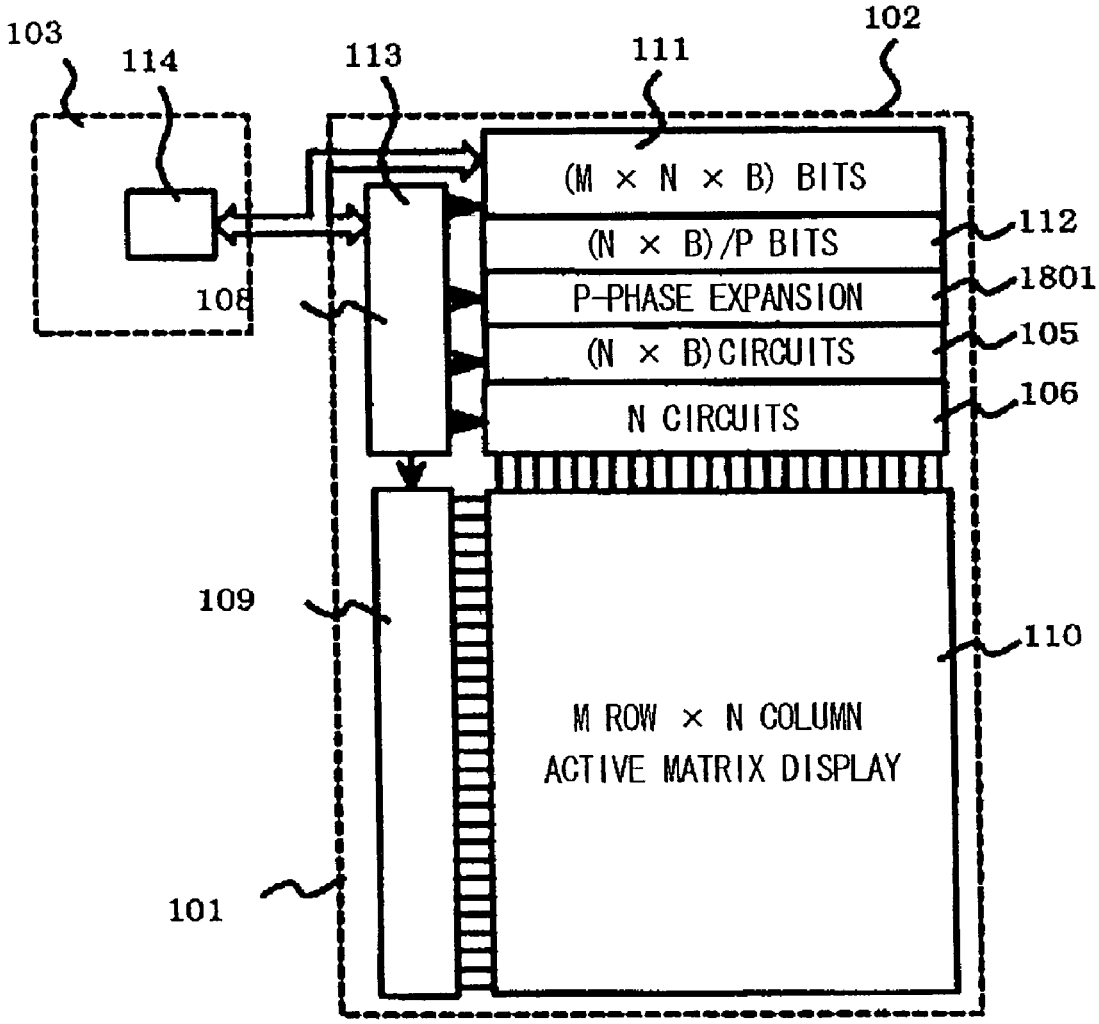

A 24th embodiment of the present invention will now be described with reference to FIG. 34, which illustrates the structure of a display device according to this embodiment. As shown in FIG. 34, the 24th embodiment includes the circuit board 103 on the system side and the display device substrate 101. The circuit board 103 on the system side includes the interface circuit 114 by which the board is connected to the display device substrate 101. The display device substrate 101 has, built in, the controller 113, memory 111, output buffer 112, scanning circuit 109, latch circuit 105, S/P converter 1801, DAC 106 and display area 110 and is connected to the circuit board 103 on the system side. The serial/parallel converting circuit 1801, latch circuit 105 and DAC 106 are disposed in the order mentioned, and the DAC 106 is connected to the column-side of the display area 110.

According to this embodiment, the display area 110 presents an active-matrix display of M rows and N columns, and the number of grayscale bits is B. Thus the memory 11 has a capacity of (M×N×B) bits.

Further, the DAC 106 has N-number of circuits, which is the same as the number of inputs on the column side of the display area 110. The output buffer 112 is provided with circuits of (N×B)/S-number of bits. This number is obtained by dividing (N×B) bits, which correspond to one row of bits in the (M×N×B)-number of bits of the display memory 111, by the serial-parallel phase expansion number P. The latch circuit 105 is placed downstream of the S/P converter 1801 and therefore is composed of (N×B)-number of bits, which is greater than the number of output-buffer bits by a factor of P.

This embodiment differs from the other embodiments in that the controller IC 102 is not provided and in that the memory 111 and buffer 112 are placed on the display device substrate 101. It goes without saying that this embodiment also may be so arranged that the controller 113 and scanning circuit 109 are disposed on the left and right sides of the display area 110 in a manner similar to that of the second embodiment.

Described next will be a method of manufacturing the display device substrate used in each of the above embodiments.

25th Embodiment

A polysilicon (poly-Si) TFT array was fabricated according to this embodiment. FIGS. 35*a* to 35*d* and FIGS. 36*e*-36*h* are fabrication-process sectional views illustrating the manufacture and structure of an array of polysilicon TFTs (planar structure) in which a channel is formed in the surface layer of polysilicon.

Figure 35A:
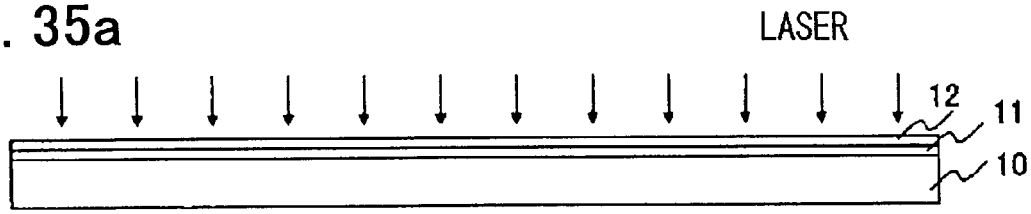
FIGS. 35*a* to 35*d* and 36*e* to 36*h* are sectional views useful in describing the main steps of a process for creating a display panel substrate used in embodiments of the present invention.

Specifically, a silicon oxide film 11 was formed on a glass substrate 10, after which amorphous silicon 12 was grown. Next, annealing was performed using an excimer laser and the amorphous silicon was polysiliconized (FIG. 35*a*).

Figure 35B:
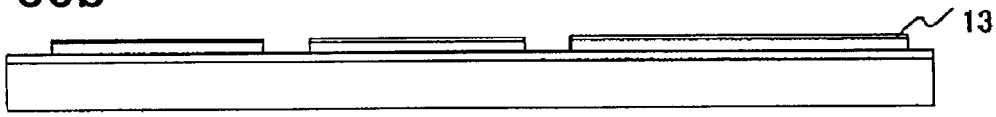
Figure 35C:
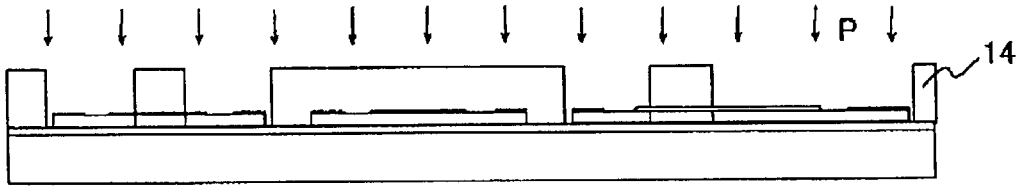

A silicon oxide layer 13 having a film thickness of 10 nm was then grown and patterned (FIG. 35*b*), after which the film was coated with a photoresist 14, subjected to patterning (adopting a p-channel area as a mask) and doped using phosphorous (P) ions, thereby forming n-channel source and drain regions (FIG. 35*c*).

Figure 35D:
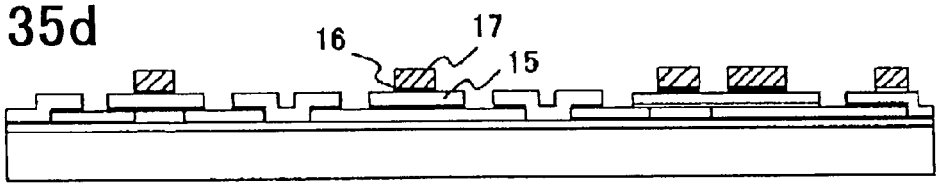

Furthermore, a silicon oxide film 15 having a film thickness of 90 nm and serving as a gate insulating film was grown, followed by the growing of microcrystalline silicon (μ-c-Si) 16 and tungsten silicide (WSi) 17 for constructing a gate electrode. This was then patterned into the shape of a gate (FIG. 35*d*).

Figure 36E:
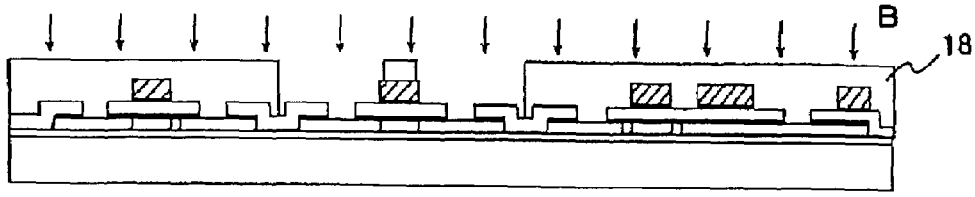
Figure 36F:
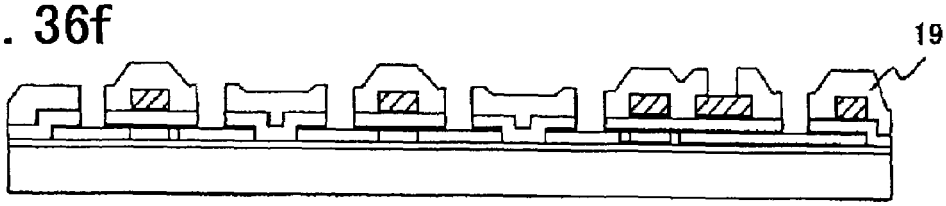

A coating of photoresist 18 was applied and patterned (adopting an n-channel area as a mask), and doping was performed using boron (B) ions, thereby forming n-channel source and drain regions (FIG. 36*e*).

Figure 36G:
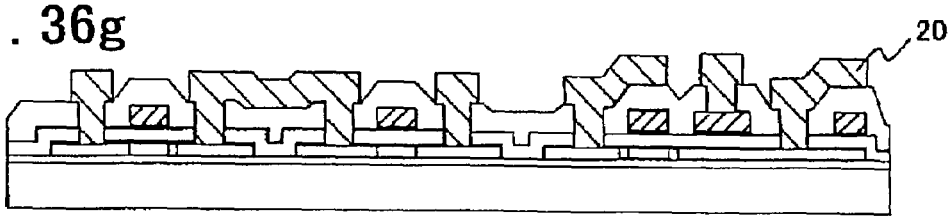

A silicon oxide film and a nitrogen oxide film 19 were grown continuously, followed by providing a hole for contact (FIG. 36*f*), forming aluminum and titanium 20 by sputtering and carrying out patterning (FIG. 36*g*). These patterning formed electrodes of CMOS sources and drains in peripheral circuits, data line wiring for connecting to the drains of pixel switch TFTs, and contacts to the pixel electrodes.

Figure 36H:
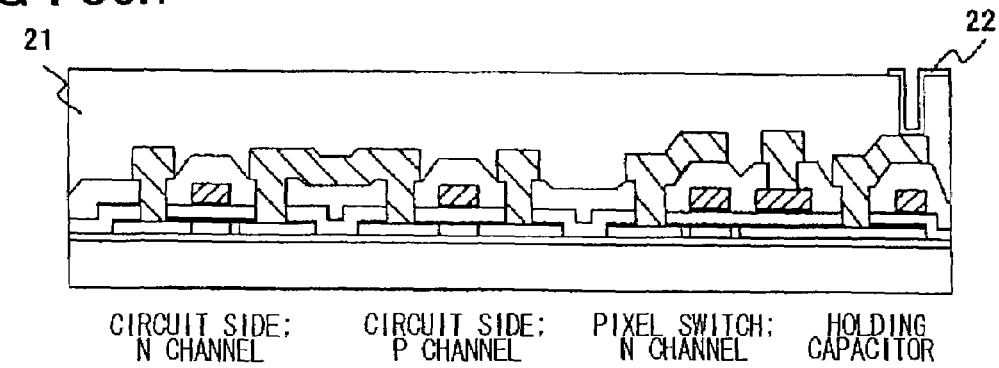
Figure 37:
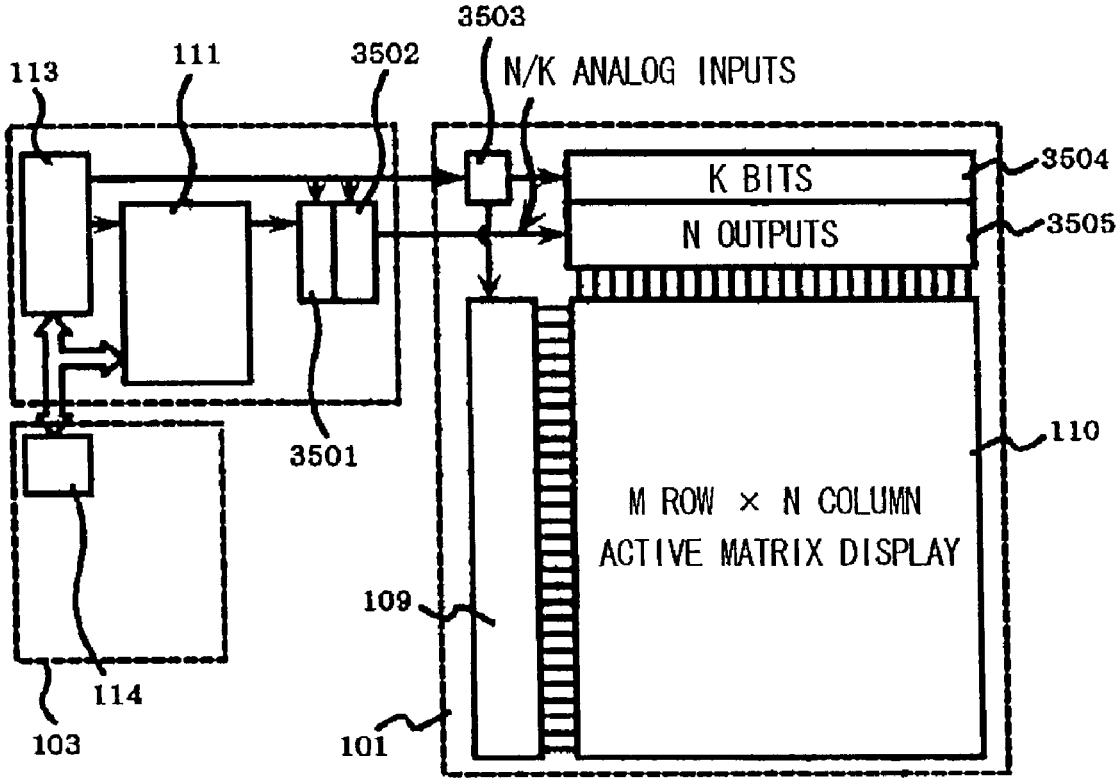
FIG . 37 PRIOR ART
FIG. 37 is a diagram illustrating an overview of a display system that employs a liquid crystal display device integral with driver circuits according to the prior art.
Figure 38:
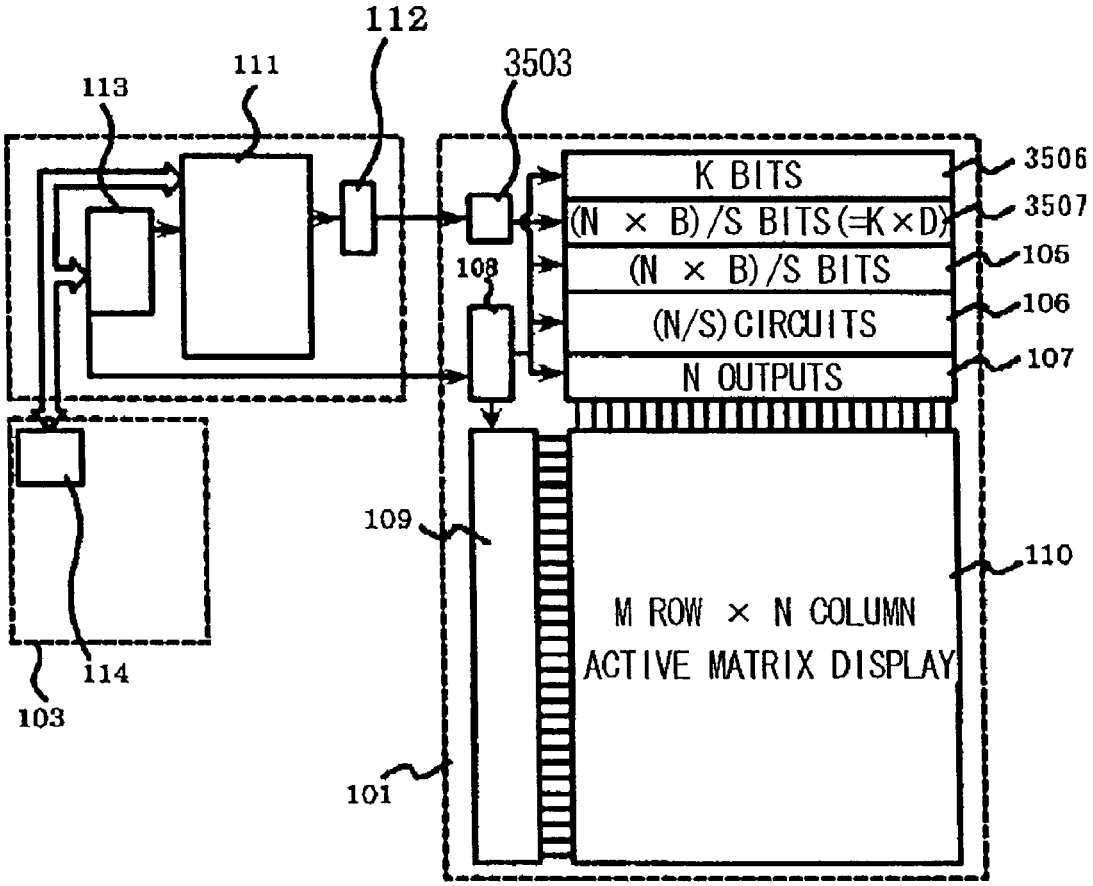
FIG . 38 PRIOR ART
FIG. 38 is a diagram illustrating an overview of a display system that employs a liquid crystal display device integral with driver circuits and having a built-in DAC according to the prior art.

Next, a silicon nitride film 21 of an insulating film was formed, a hole for contact was provided, ITO (indium tin oxide) 22, which is a transparent electrode, was formed for a pixel electrode, and patterning was carried out (FIG. 36*h*).

Thus, a planar-structure TFT pixel switch was fabricated and a TFT array was formed.

With regard to the peripheral circuitry, a p-channel TFT was fabricated together with an n-channel TFT similar to that of the pixel switch and through a process substantially similar to that of the n-channel TFT though by the doping of boron. FIG. 36*h* illustrates the following starting from the left side: an n-channel TFT as a peripheral circuit, a p-channel TFT as a peripheral circuit, a pixel switch (n-channel TFT), a holding capacitor and a pixel electrode.

The structure of the circuit is that of the first embodiment depicted in FIG. 1. The TFTs constituting the circuits on the display device substrate were fabricated from TFTs through an identical process. The process adopted makes possible the operation of the pixel switch and selector circuit 107, which require the highest voltage.

Furthermore, a 4-μm patterned column (not shown) was fabricated on the TFT substrate. The column was used as a spacer possessing a cell gap and was imparted with impact resistance.

Further, the exterior of the pixel region of the opposing substrate (not shown) was coated with a sealant for being hardened with ultraviolet light.

After the TFT substrate and opposing substrate were bonded together, liquid crystal was injected between them. The liquid crystal material used was nematic liquid crystal, a chiral material was added and the lapping direction was made to match to thereby obtain a liquid crystal of twisted nematic (TN) type.

With this embodiment, it was possible to realize a transmissive-type liquid crystal display device superior to the prior-art arrangement in terms of definition, number of colors, low cost and low power consumption.

Though an excimer laser was used to form the polysilicon film in this embodiment, it is permissible to use other lasers, such as a continuous-wave (CW) laser.

In embodiments such as the first embodiment, data is transferred from the controller IC 102 to the data-line drivers of the display device substrate 101 in single-line units or in bit-data units obtained by dividing one line by the block dividing number S(=4), and the operating frequency of the data-line drivers is reduced. In general, the greater the film thickness of the gate insulating films of a transistor, the higher the threshold value and the slower the operating speed. In the above embodiment in which the operating frequency of the peripheral circuit is reduced, operation can be achieved even if use is made of TFTs having a low operating speed. That is, when the operating frequency rises, optimization of the transistor threshold value is required. By lowering the operating frequency, however, transistor threshold value need not be optimized in this embodiment. According to this embodiment, it is possible to construct a peripheral circuit using a process that makes possible the operation of the pixel switch and selector circuit 107, which require the highest voltage, and a CMOS circuit of a polysilicon TFT (the film thickness of the gate insulating film of which is 90 nm) fabricated by the same process.

26th Embodiment

A polysilicon (poly-Si) TFT array was fabricated and a reflective-type display device constructed according to this embodiment.

With reference to FIGS. 35*a* to 35*d* and FIGS. 36*e* to 36*h*, a silicon oxide film 11 was formed on the glass substrate 10, following by the growing of amorphous silicon 12. Next, annealing was performed using an excimer laser and the amorphous silicon was polysiliconized (FIG. 35*a*). The growing of a silicon oxide layer 13 having a film thickness of 10 nm (FIG. 35*b*).

After patterning was carried out, a photoresist was applied and patterned and doping was performed using phosphorous (P) ions, thereby forming n-channel source and drain regions (FIG. 35*c*).

Furthermore, a silicon oxide film 15 having a film thickness of 90 nm was grown, followed by the growing of microcrystalline silicon (μ-c-Si) 16 and tungsten silicide (WSi) 17. This was then patterned into the shape of a gate (FIG. 35*d*).

A silicon oxide film and a nitrogen oxide film were grown continuously, followed by providing a hole for contact (FIG. 36*f*), forming aluminum and titanium 20 by sputtering and carrying out patterning (FIG. 36*g*).

Next, a coating of an organic film was applied and then patterned using a mask for achieving a substantially random uneven structure. A contact hole was provided again, aluminum and titanium were formed and patterned to obtain a reflective pixel electrode (reflective plate).

Next, 3.5-μm silica spacers were dispersed over the TFT substrate. Further, the exterior of the pixel region of the opposing substrate was coated with a sealant for being hardened with ultraviolet light. After the TFT substrate and opposing substrate were bonded together, liquid crystal was injected between them. The liquid crystal material used was nematic liquid crystal, a chiral material was added and the lapping direction was made to match to thereby obtain twisted nematic liquid crystal having a twist angle of 67°.

Further, a color filter having a density and color tone suited to the reflective structure was provided on the reflecting substrate. By further employing a compensating plate and an optimized polarizer, there was obtained a reflective liquid crystal display device exhibiting a high contrast ratio and a high reflectivity.

The circuit arrangement used in this embodiment is that of FIG. 18 illustrating the 12th embodiment. In this arrangement, the driving scheme is such that the common potential (Vcom) of the opposing substrate is inverted every scanning line. As a result, the voltage applied to the liquid crystal was enlarged to a maximum of 5 V (the transistors that drive the data lines was made 5-V drive transistors).

Since this embodiment concerns reflective liquid crystal, a backlight is not necessary, making it possible to achieve a liquid crystal device that consumes less power in comparison with the $25^{th}$ embodiment.

27th Embodiment

An organic EL was used as the display element. After a TFT array was fabricated in a manner similar to that of the $26^{th}$ embodiment, an element isolating film was formed and patterned. Next, a whole injection layer and a light emitting layer were formed successively by inkjet patterning. In this process, use was made of an inkjet patterning apparatus having a control mechanism capable of ejecting ink at any position, whereby the hole injection layer and light emitting layer were patterned. The device was sealed after the formation of a negative electrode.

The circuit arrangement used in this embodiment is that of FIG. 23 illustrating the $16^{th}$ embodiment. According to this embodiment, an organic EL could be driven to obtain an excellent display.

In the above embodiment, the structure is such that display elements are scanned sequentially. However, it is permissible to use panel-sequential scanning, in which a display section is provided with two memories, thereby enabling two fields of data to be stored in the two memories so that the entirety of the panel may be scanned collectively.

The actions and effects of the above embodiment will now be described.

(I) It is possible to reduce the cost of the IC by a wide margin by providing a controller IC, which has an internal memory, together with a combined driver circuit and display device having an internal DAC.

Figure 3:
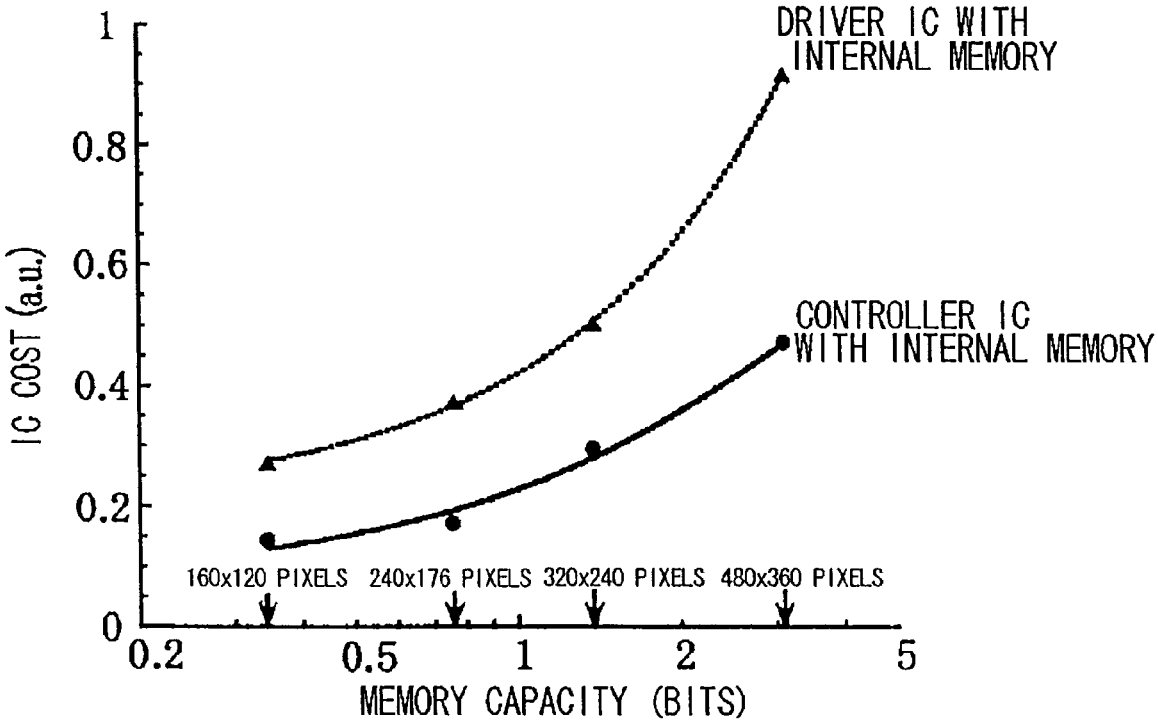
FIG. 3 is a diagram illustrating the relationship between internal memory capacity and IC cost with respect to a driver IC having a built-in memory and a controller IC having a built-in memory.

With a combined driver circuit and display device not having an internal DAC, a driver IC with an internal memory, rather than a controller IC, is necessary. FIG. 3 illustrates the relationship between internal memory capacity and IC cost regarding a driver IC with an internal memory and a controller IC with an internal memory. IC cost rises with an increase in memory capacity. A comparison of the driver IC with an internal memory and the controller IC with an internal memory reveals that the latter is approximately half the cost. Thus, in accordance with the present invention, a reduction in cost is readily achieved.

(II) Power consumed by the interface circuit is reduced.

Figure 4:
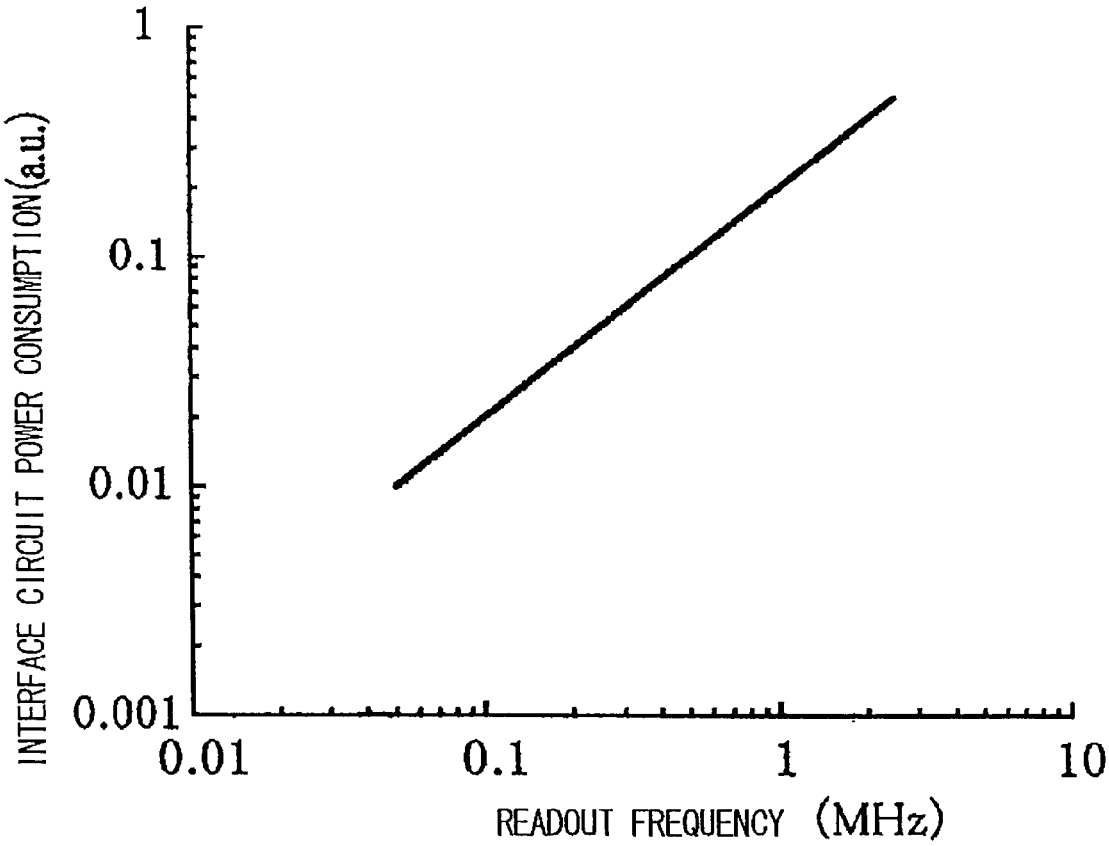
FIG. 4 is a diagram illustrating the relationship between read-out frequency and power consumption of an interface circuit.

FIG. 4 illustrates the relationship between readout frequency (MHz) and interface-circuit power consumption. It will be understood from FIG. 4 that when readout frequency declines by one order of magnitude, power consumption also declines by approximately one order of magnitude.

According to the present invention, enlarging the width of the bus from the controller IC having the internal memory reduces readout frequency. This reduction in frequency makes it possible to reduce the consumption of power by a wide margin.

28th Embodiment

A $28^{th}$ embodiment of the present invention will now be described. Why consumption of power can be reduced by the present invention will be described in detail while making a comparison with the circuit arrangement of a conventional display device serving as a comparative example. First, consider power consumption in a typical example of a well-known polysilicon TFT-LCD serving as the comparative example.

Figure 39:
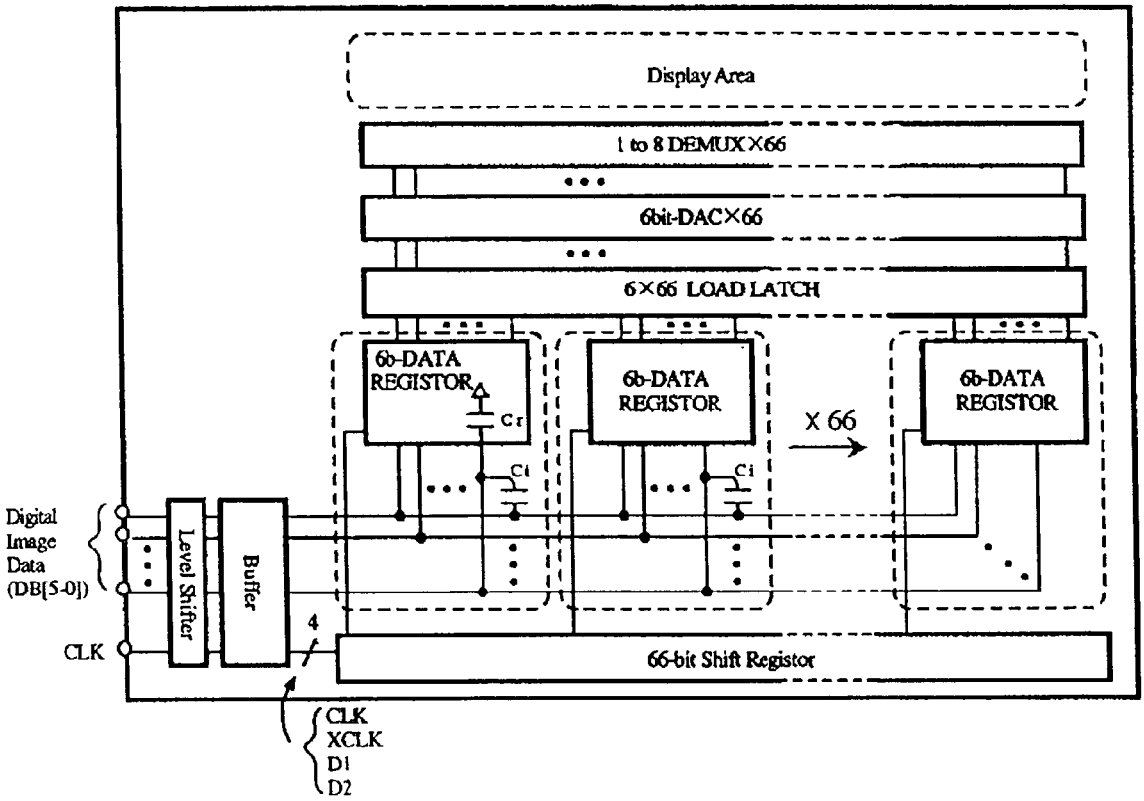
FIG . 39 PRIOR ART
FIG. 39 is a diagram illustrating the structure of a display device to which the conventional architecture is applied, this device serving as an example for comparison purposes.
Figure 42:
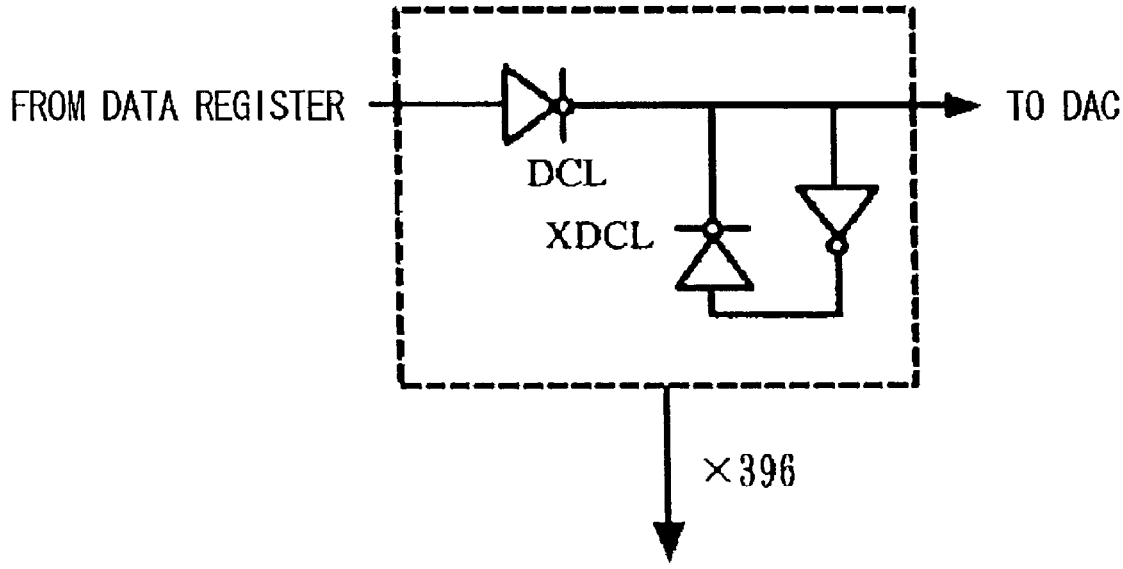
FIG. 42 is a diagram showing the circuit arrangement of a 6×6-load latch in FIG. 39.
Figure 43:
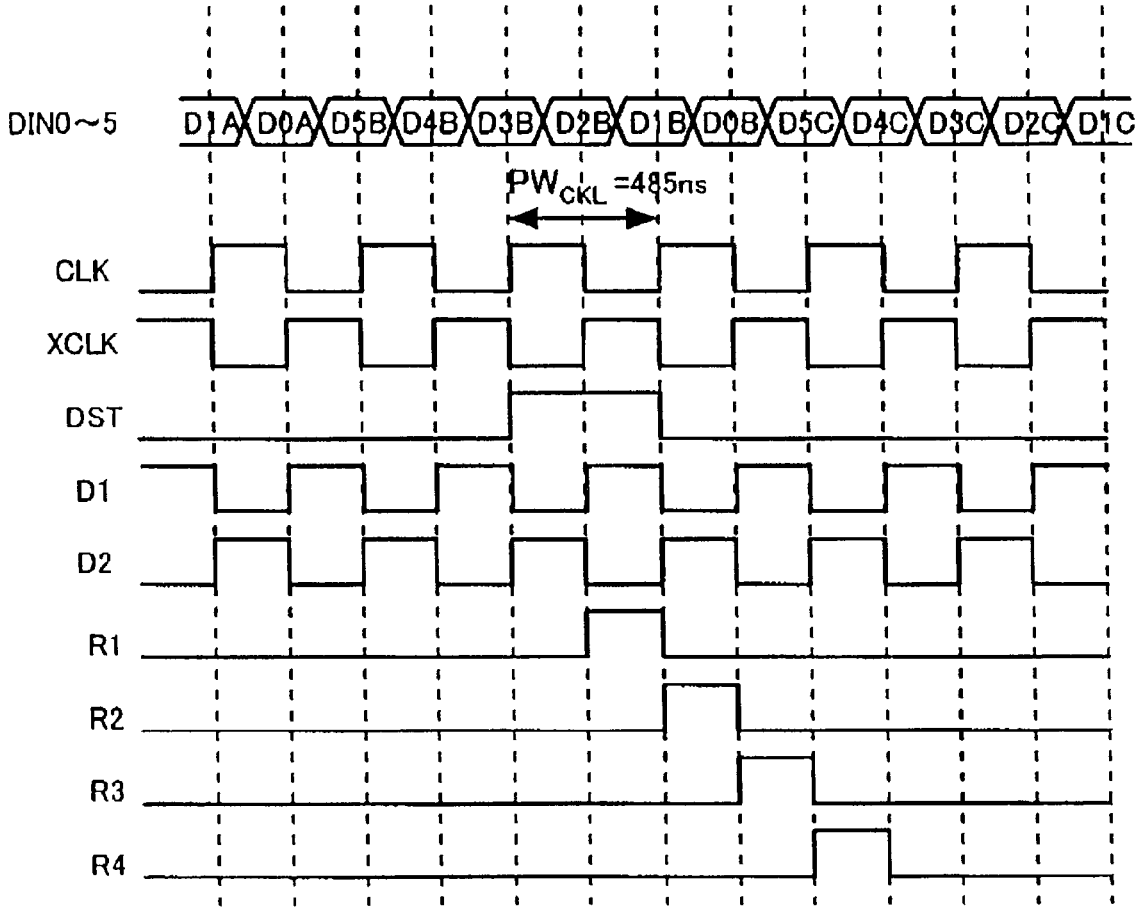
FIG. 43 is a timing chart illustrating signals supplied to the shift register circuit of FIG. 39 and digital-data bus line.

FIG. 39 is a diagram illustrating an example of the architecture of a display device in a case where the conventional structure and principles are applied in a comparative example. Examples of the circuit arrangements of single elements of a shift register (66-bit Shift Register), data register (DATA REGISTER), load latch (LOAD LATCH) and level shifter (LEVEL SHIFTER), which are used in FIG. 39, are illustrated in FIGS. 40, 41, 42 and 44, respectively. FIG. 43 is a timing chart illustrating the timing operation of the system shown in FIG. 39. The specific numerical values shown in FIG. 39 are for the purpose of description and comparison and therefore have been set to match the specifications of a display device (see FIG. 45) according to the $29^{th}$ embodiment of the invention, described below.

As shown in FIG. 39, digital video data DBO to DB5 (e.g., 0 to 3.0 V) is level-shifted to, e.g., 0 to 10 V by a level shifter circuit (Level Shifter), and the resulting data is output from a buffer (Buffer). A clock CLK supplied to the 66-bit shift register (66-bit Shift Register) also is level-shifted by the level shifter circuit (Level Shifter). The buffer (Buffer) supplies the shift register (66-bit Shift Register) with a signal having a 4-bit width representing CLK, XCLK, D1 and D2. Sixty-six data registers (DATA REGISTER) have, in parallel, latch circuits for accepting data signals of a 6-bit data bus DB0 to DB5 in response to latch timing signals Rn (n=1 to 66) from the 66-bit shift register (66-bit Shift Register), and for storing and holding these signals in response to complementary signals XRn of the latch timing signals.

Figure 40:
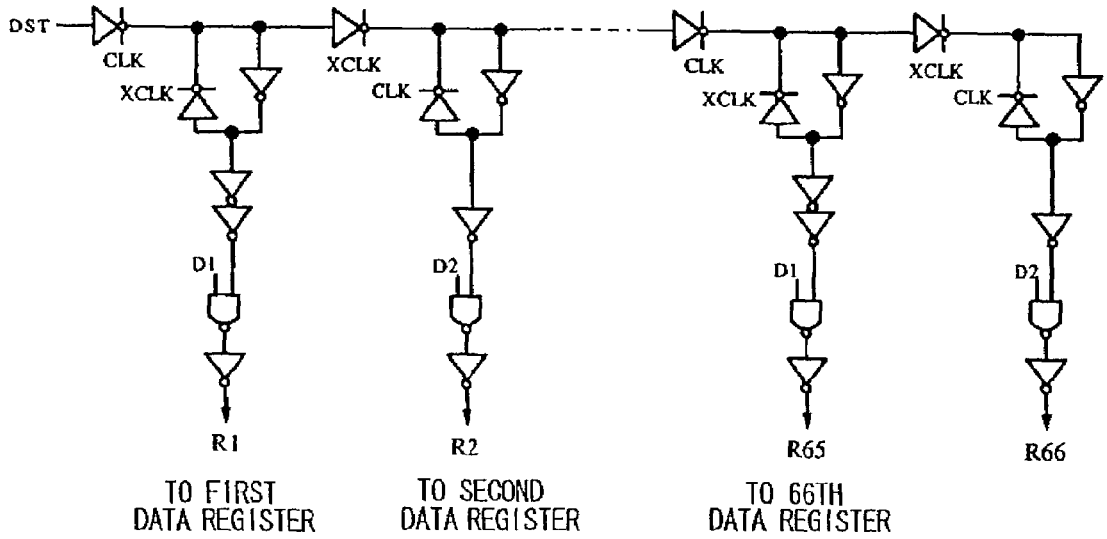
FIG. 40 is a diagram illustrating the circuit structure of a shift register in FIG. 39.

In the shift register (66-bit Shift Register) of FIG. 40, a first clocked inverter, an inverter whose input is connected to the output of the first clocked inverter, and a second clocked inverter whose input is connected to the output of the inverter and whose output is connected to the output of the first clocked inverter construct a unit latch circuit. The shift register of FIG. 40 has 66 latches connected in cascade, 66 being the number of data registers (6b-DATA REGISTER). Latches of two stages are such that clock signals supplied to corresponding clocked inverters are complementary (CLK and XCLK), and a master-slave latch is constructed every two latches. Latch timing signals R1 to R66 of the data latches are output from the 66 outputs of the shift register. The latch timing signals R1 to R66 are controlled by control signals DST, D1, D2 supplied to the shift register. (When DST and D1 are at the high level, R1 attains the high level, as shown in FIG. 43.) Further, with regard to the load latches (LOAD LATCH), as shown in FIG. 42, a first clocked inverter turned on and off by clock DCL, an inverter whose input is connected to the output of the first clocked inverter, and a second clocked inverter whose input is connected to the output of the inverter and whose output is connected to the output of the first clocked inverter, and which is turned on and off by the complementary signal XDCL of the clock DCL, construct a unit latch circuit.

Figure 44:
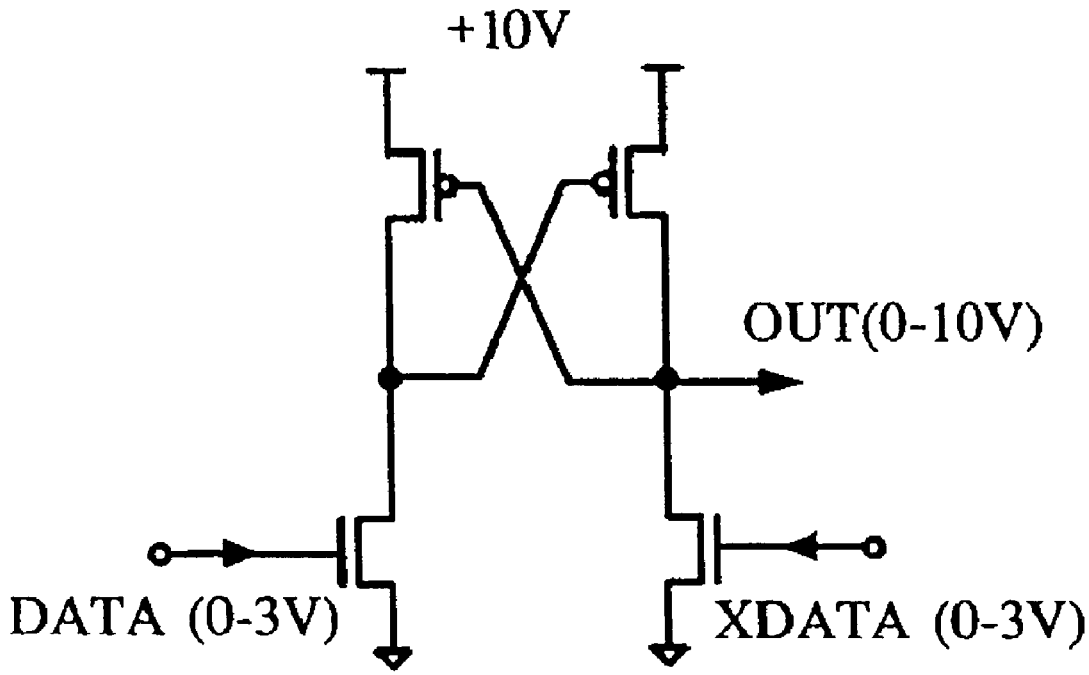
FIG . 44 PRIOR ART
FIG. 44 is a diagram illustrating the circuit arrangement of a level converter circuit according to the prior art.

As shown in FIG. 44, the level shifter circuit (Level Shifter) has a pair of PMOS transistors whose sources are connected to the side of +10 V and whose gates and drains are cross-connected, and a pair of NMOS transistors connected between ground and the drains of the pair of PMOS transistors. Data (0 to 3 V) and the complementary signal thereof are input differentially to the gates of the pair of NMOS transistors, and an output signal having an amplitude of 0 to 10 V is derived.

In the arrangement shown in FIG. 39, 6×66 load latches (LOAD LATCH) are provided for inputting digital video data simultaneously to 66 6-bit DACs (6-bit digital/analog converters) at a desired timing and for holding the data for a fixed period of time. In order to write digital video data to the load latches, 66 of the 6-bit data registers (6b-DATA REGISTER) addressed by the shift register (66-bit Shift Register) are connected by a bus. These logic circuits, i.e., digital signal processing circuits, are driven by a power-supply voltage of 10 V or greater. Accordingly, the digital signals of the six digital data bus lines that connect the 6-bit data registers (6b-DATA REGISTER) also are driven at an amplitude of 10 V or greater using the level converting circuit (Level Shifter).

These digital data bus lines and the clock lines for driving the shift registers are driven at the highest speed on the display device substrate. FIG. 43 is a timing chart of the control lines for driving this controller.

In a case where the display device is designed using this conventional architecture, the digital signal processing circuits implemented by the above circuits consume about half of the total power consumed on the glass substrate (the DAC consumes the major portion of the remaining half), as will be described later. Accordingly, it would be useful to devise an expedient for reducing the power consumed by the digital signal processing circuits.

When the power consumed by the digital signal processing circuits is considered, the causes are construed to be (a) to (c) below.

(a) A digital data bus line possesses a large parasitic capacitance. One reason for this is that a large number of data registers are connected to the bus lines. A second reason is that branch lines connecting the bus lines to the data registers cross the bus lines because of the layout, as a result of which much interline coupling is produced.

Figure 41:
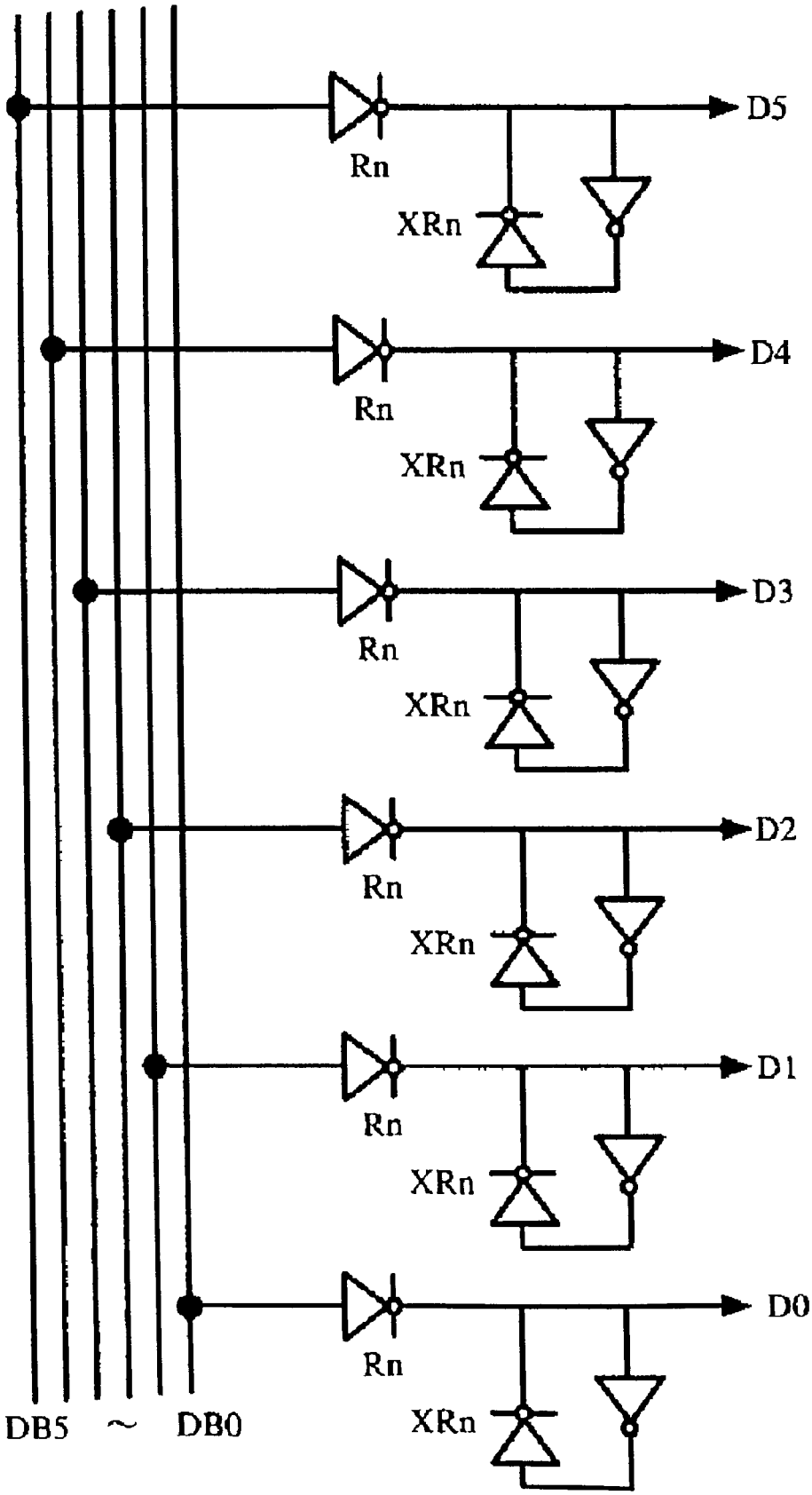
FIG. 41 is a diagram illustrating the circuit arrangement of a 6-bit data register in FIG. 39 and digital data bus lines connected thereto.

The circuitry of one element of the 6-bit data registers (6b-DATA REGISTER) shown in FIG. 39 and bus lines D0 to D5 are illustrated in FIG. 41.

(b) The digital data bus lines are driven at the highest frequency on the glass substrate. Clock lines (CLK, XCLK in FIG. 39) for driving the shift register (66-bit Shift Register) also are driven at the highest frequency.

(c) The level converting circuit (Level Shifter) (e.g., see FIG. 44) consumes a large amount of power.

Accordingly, the present inventors have discovered that mitigating the above-mentioned factors can reduce consumption of power. Specifically, in view of the causes of power consumption set forth above, the present inventors have devised new display device architecture.

Figure 45:
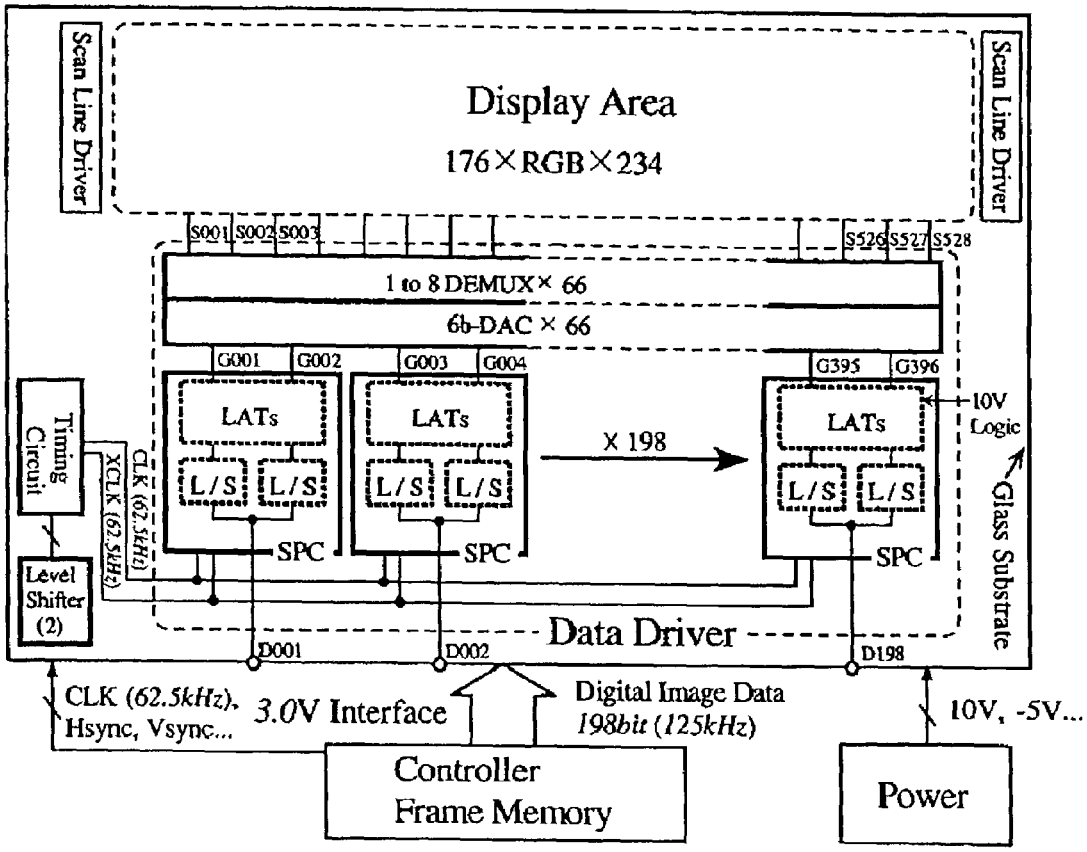
FIG. 45 is a block diagram illustrating the structure of a display device according to an embodiment of the present invention.

FIG. 45 illustrates the structure of a display device according to a $28^{th}$ embodiment of the present invention. The display device shown in FIG. 45 has a parallel architecture according to the present invention. Here a 6-bit grayscale (260,000 colors) DAC of 176×RGB×234 pixels is integrated on a glass substrate based upon the design specifications shown in Table 1 below, and an LCD having a 3.0-V digital interface is driven at a frame frequency of 30 Hz.

TABLE 1

DISPLAY DEVICE SPECIFICATIONS OF THIS INVENTION

| ITEM | VALUE |
|---|---|
| NUMBER OF PIXELS | 176 × RGB × 234 |
| FRAME FREQUENCY | 30 fps |
| NUMBER OF GRAY LEVELS | 6 BITS (260,000 COLORS) |

The display device according to the embodiment of the invention shown in FIG. 45 comprises a display device substrate (Glass Substrate in FIG. 45) having a display area (Display Area) in which pixels are arrayed in the form of a matrix of M rows and N columns at cross points of a plurality of data lines (N in number) and a plurality of scanning lines (M in number); and a control unit (Controller Frame Memory) having a display memory (Frame Memory) for storing (M×N) pixels of B-bit (6-bit in FIG. 45) grayscale display data [i.e., (M×N×B)−number of bits], an output buffer for reading data (Digital Image Data) out of the display memory and outputting this data to the display device substrate (Glass Substrate), and a controller for controlling the display memory and the output buffer as well as managing communication and control with a host device. The output buffer in the control unit comprises (N×B)/(P×S)-number of output buffers. This number is obtained by dividing (N×B) bits, which correspond to one row of bits in the (M×N×B)-number of bits of the display memory, by the product of the block dividing number S and P phases.

In the example shown in FIG. 45, N=176×3 (RGB components)=528, M=234, S=8, P=2 holds. The total number of data lines (signal lines) of the display area is 528, namely S001 to S528, and the number of data lines of the data bus (the number of output buffers of the control unit) is (N×B)/(P×S)=(528×6)/(8×2)=198. Provided between the controller IC (Controller Frame Memory) and glass substrate is a data bus for transfer of digital video data (Digital Image Data). The data bus consists of 198 bits, namely D001 to D198, and is driven at a transfer rate of 125 kHz.

Display data (digital video data) is transferred to a data-line driver (Data Driver), which drives the data lines of the display area on the glass substrate, via the data bus having the bit width of (N×B)/(P×S) bits. Digital video data of (N×B)/(P×S)-number of bits is divided (P×S) times in one horizontal scanning period, whereby one line of display data is transferred. In the example of FIG. 45, data (D001 to D198) having a bit width of 198 bits is divided 2×8 times to transfer one line of display data.

The data-line driver (Data Driver) on the glass substrate includes P-phase expansion circuits (SPC) each of which comprises: P-number of level shifter circuits (L/S) connected in common with one data line in the data bus, the level shifters level-shifting the amplitudes of P-phase signals output from the output buffers on the side of the control unit and accepted successively via the data lines to obtain signals higher amplitudes; and latch circuits (LATs) for latching each of the outputs of the P-number of level shifter circuits in accordance with the driver clock, expanding the P-phase serial bit data into P-number of parallel bits and latching these as P-bit parallel data. The number of the P-phase expansion circuits (SPC) provided is (N×B)/(P×S). The data driver further includes N/S-number of digital/analog circuits (referred to as "DACs"), to each of which is supplied a B-bit signal from (N×B)/S-bit data output in parallel from the (N×B)/(P×S)-number of P-phase expansion circuits (SPC), for outputting an analog signal; and a selector, which receives the outputs of the N/S-number of DACs as inputs, for outputting these signals to N-number of data lines of the display area.

In the implementation of FIG. 45, (N×B)/(P×S), i.e., (528×6)/(2×8)=66×3=198×2-phase expansion circuits (SPC) each comprising two lever shifter circuits (L/S) and a plurality of latch circuits (LATs) are provided in parallel. Naturally, the number of SPCs is equal to the number of data signal lines, namely lines D001 to D198. The 198 2-phase expansion circuits (SPC) output data composed of (528×6)/8=66×6=396 bits (G001 to G396). Furthermore, the number of 6-bit DACs (6b-DAC) provided is N/S=528/8=66. A 1:8 demultiplexer is adopted as the selector, which receives the outputs (66 analog voltage outputs) of the 66 DACs (6b-DAC) as inputs, for outputting these signals to N-number (528) of data lines (S001 to S528) of the display area. The 1:8 demultiplexer splits one signal into eight outputs. The number of these demultiplexers (1-to-8 DEMUX) provided is N/S=66. The selector circuit (1-to-8 DEMUX×66) receives outputs from the 66 DACs (6b-DAC) and, on the basis of a selector control signal, supplies data signals to a group of 66 data lines sequentially in a time obtained by division by the block dividing number S. Furthermore, the glass substrate is provided with a scanning-line driver circuit (Scan Line Driver) for applying voltage sequentially to a plurality of scanning lines of the display area.

The control unit supplies the level shifter circuit [Level Shifter (2)] on the glass substrate with a clock (CLK) (the frequency of which is 62.5 kHz) and with control signals such as a horizontal synchronizing signal (Hsync) and a vertical synchronizing signal (Vsync). The clock and control signals, along with the data bus, are compliant with a 3.0V interface. The level shifter circuit [Level Shifter (2)] level-converts the clock and control signals to 10V and outputs the resulting signals to a timing circuit. The latter supplies the SPCs with clock (CLK) having 10V amplitude and with a clock XCLK that is the complement of the clock (CLK). A power-supply circuit (Power) supplies the glass substrate with power-supply voltages of 10V and −5V, etc.

Thus, the data driver integrated on the glass substrate is composed of the 2-phase expansion circuits (SPC), which also perform a sampling level shift for a 3V interface, the 6-bit DACs and the 1-to-8 demultiplexers.

A group of output nodes(for example G001, and G002) for outputting a signal obtained on serial/parallel converting data supplied to a first input node(for example D001) of the serial/parallel converting circuit(SPC) unit, and a group of output nodes(for example G003, and G004) for outputting a signal obtained on serial/parallel converting data supplied to a second input node(D002), adjacent to the first input node of the serial/parallel converting circuit(SPC) unit are arranged adjacent. The serial/parallel converting circuit unit is arranged with a layout pattern having substantially a form of a rectangle, in which a group of input nodes of the serial/parallel converting circuit unit are provided on one of longer sides of said rectangle and a group of output nodes of said serial/parallel converting circuit unit being provided on another longer side f the rectangle.

Figure 46:
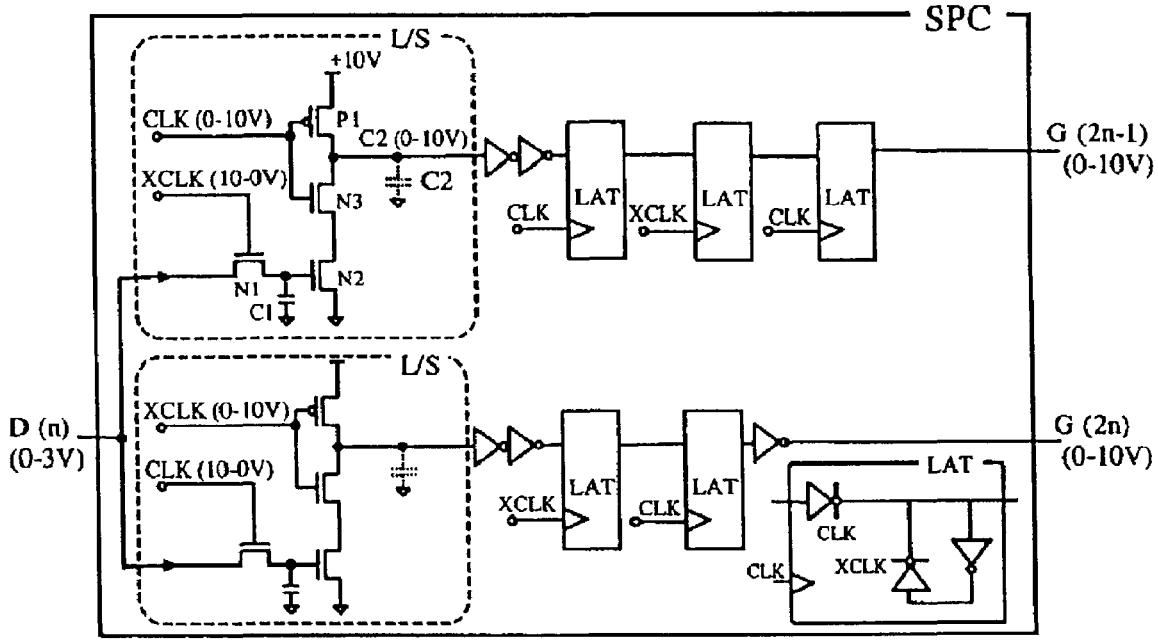
FIG. 46 is a diagram illustrating the circuit arrangement of a 1-to-2 serial/parallel converter circuit with a level conversion function according to the embodiment shown in FIG. 45.

FIG. 46 is a diagram showing an example of the circuitry of one element of the 2-phase expansion circuit (SPC) [namely the SPC connected to one data signal D(n)] of FIG. 45. The 2-phase expansion circuit (SPC) (the circuit for converting 1-bit serial data to 2-bit parallel data) includes two sampling level shifter circuits (L/S), which are connected in common with the output D(n) (0 to 3 V) of the data buffer, and a plurality of latch circuits (LAT) connected to each output of the two sampling level shifter circuits (L/S). Each latch circuit latches the input data at the sampling clock CLK and complementary clock XCLK.

A first sampling level shifter circuit(L/S), which is on the upper side in the SPC of FIG. 46, includes first to third MOS transistors P1, N3, and N2 constituting first to third switch elements connected serially between a high-potential power supply (10V in this example) and low-potential power supply (GND); a capacitor C2 connected to the connection point of the first and second MOS transistors P1 and N3; a fourth MOS transistor N1 constituting a fourth switch element connected between an input terminal, which is connected to D(n), and the gate terminal of the third MOS transistor N2; and a capacitor C1 connected to the gate of the third MOS transistor N2. A first sampling clock (CLK) (0 to 10V) is supplied commonly to the gates of the first and second MOS transistors P1, N3, and a second sampling clock (XCLK), which is the complement of the first sampling clock (CLK) is supplied to the gate of the fourth MOS transistor N1.

Operation of the sampling level shifter circuit (L/S) will now be described. When the first sampling clock (CLK) is at the low level (termed "setup time-interval"), the MOS transistor P1 constituting the first switch element turns on, the MOS transistor N3 constituting the second switch turns off and the capacitor C2 is charged to the power-supply voltage of the high-potential power supply. When the second sampling clock (XCLK) is at the high level, the fourth MOS transistor N1 constituting the fourth switch element turns on and the capacitor C1 is charged by the input signal voltage.

When the first sampling clock (CLK) is at the high level (termed "output time-interval"), the MOS transistor P1 constituting the first switch element turns off, the MOS transistor N3 constituting the second switch turns on and the terminal voltage of the capacitor C2 at this time is extracted as an output signal directly or indirectly. The sampling level shifter circuit (L/S) is mounted on the glass substrate, the first MOS transistor P1 comprises a P-type TFT, and the second to fourth MOS transistors N3, N2, N1 comprise N-type TFTs.

The second sampling level shifter circuit (L/S) on the lower side in the SPC of FIG. 46 has a structure similar to that described above, though the connection of the sampling clock differs from that of the first sampling level shifter circuit (L/S). The second sampling clock (XCLK) is supplied commonly to the gates of the first and second MOS transistors P1 and N3, and the first sampling clock signal (CLK) is supplied to the gate of the fourth MOS transistor (N1). When the second sampling clock (XCLK) is at the low level (setup time-interval), the second sampling clock (XCLK) is at the high level (output time-interval), and therefore the second sampling level shifter circuit (L/S) performs an operation that is complementary to the operation of the first sampling level shifter circuit (L/S).

In accordance with the sampling level shifter circuit (L/S) of this invention shown in FIG. 46, the following actions and effects are obtained:

(a) Power consumption is low because there is no flow of a steady current.

(b) Owing to a single-phase input (meaning that inverted data is unnecessary), a small number of terminals suffices. (The usual level converting circuit necessitates two inputs, namely data and the inverted version of this data.)

(c) There is little possibility of the circuits on the low-voltage side being destroyed because a potential on the high-voltage side is not produced at the input terminal. If the latch-type-sensing amplifier shown in FIG. 44 is used in the level shifter, there are instances where the input terminal develops a potential on the high-voltage side.

In the case of a polysilicon TFT LCD, the structure is such that as many as 200 data input terminals may be provided, by way of example. The present invention is particularly effective in a case where it is used in an application in which many items of data are thus sampled and level-shifted.

As shown in FIG. 46, the 2-phase expansion circuit (SPC) has the first and second sampling level shifter circuits (L/S), the input signal D(n) is supplied commonly to the first and second sampling level shifter circuits, and signals (i.e., XCLK, CLK) of values obtained by inverting the values of the first and second clock signals (CLK, XCLK) of the first sampling level shifter circuit are supplied as first and second sampling clocks to corresponding switch elements in the second sampling level shifter circuit. The 2-phase expansion circuit (SPC) further includes a first latch (LAT) for latching the output of the first sampling level shifter circuit based upon the first sampling clock signal (CLK); a second latch (LAT) for latching and outputting the output of the first latch (LAT) based upon the second sampling clock signal (XCLK); a third latch (LAT) for outputting the output of the second latch (LAT) based upon the first sampling clock signal (CLK); a fourth latch (LAT) for latching the output of the second sampling level shifter circuit based upon the second sampling clock signal (XCLK); and a fifth latch (LAT) for outputting the output of the fourth latch based upon the first sampling clock signal (CLK). The first and second latches construct a first master-slave latch, and the fourth and fifth latches construct a second master/slave latch. Each latch (LAT) includes a first clocked inverter activated by the input clock signal and having its input and output connected to the input and output terminals, respectively, of the latch; an inverter having its input connected to the output of the first clocked inverter; and a second clocked inverter having its input connected to the output of the inverter and its output connected to the input of the inverter. The first and second clocked inverters are activated and deactivated by the clock CLK and complementary clock XCLK, respectively.

Figure 47:
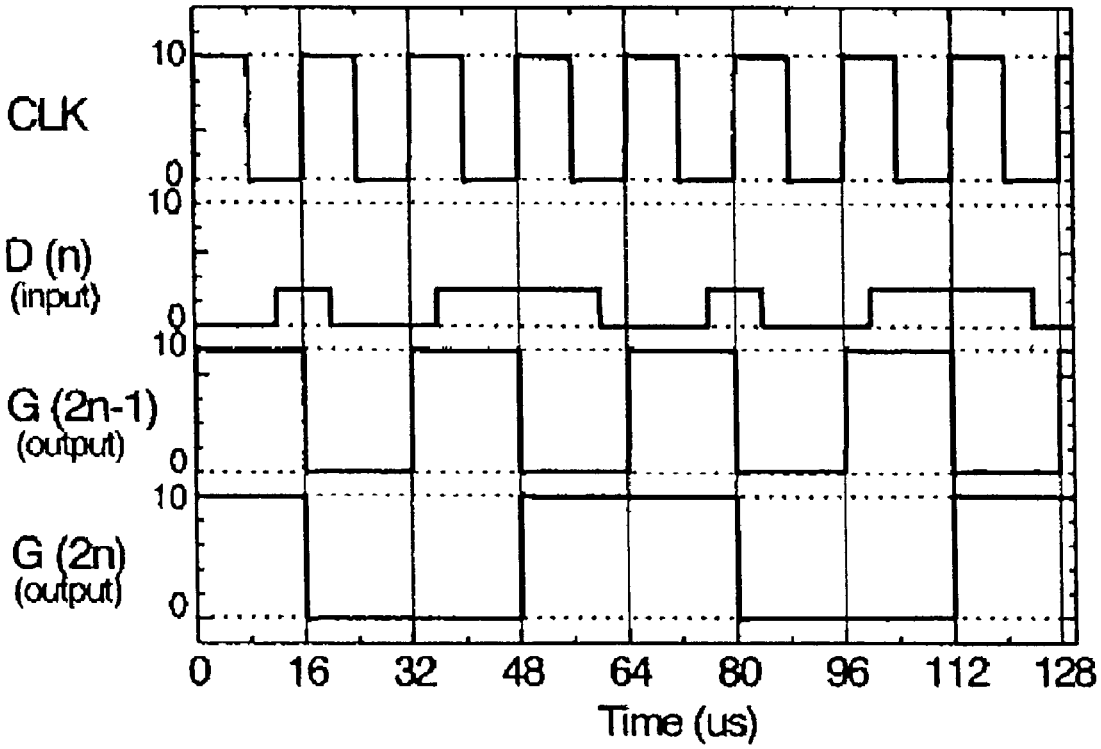
FIG. 47 is a timing chart illustrating the timing waveform of the 1-to-2 serial/parallel converter circuit shown in FIG. 46.

FIG. 47 is a waveform diagram illustrating the operation of the circuit shown in FIG. 46. In sync with the first sampling clock signal (CLK), the three cascade-connected latches output odd-numbered signals [G(2n−1)] and the two cascade-connected latches output even-numbered signals [G(2n)] in parallel.

In the display device shown in FIG. 45, digital video data is supplied from the external controller IC at an amplitude of 3 V and with a width of 198 bits, the signal level is converted to an amplitude of 10 V by the digital signal processing circuits (the array of SPCs), and the resulting signals are supplied to the DACs at a prescribed timing. The output of the first DAC drives eight data lines, which are connected to the pixel area (Display Area), in time-shared fashion using the demultiplexer (DEMUX).

A characterizing feature of this implementation is that data is supplied at low speed via an interface having a large bus width (198 bits), and the data is processed by the parallel-driven 2-phase expansion circuit (SPC), which has a level converting function, on a glass substrate. Thus, digital signal processing is executed by driving a number of phase expansion circuits in parallel. For this reason, this implementation is referred to as a "parallel digital data driver architecture".

Table 2 below compares this parallel digital data driver architecture and the conventional architecture. Why this parallel architecture reduces power consumption will now be considered.

TABLE 2

COMPARISON OF ARCHITECTURES

| | CONVENTIONAL ARCHITECTURE | PARALLEL DRIVER ARCHITECTURE |
|---|---|---|
| DIGITAL VIDEO DATA INTERFACE BUS WIDTH | 6 BITS (1) | 198 BITS (33) |
| CLOCK FREQUENCY | 2.1 MHz (1) | 62.5 kHz (1/33) |
| NUMBER OF TRANSISTORS CONNECTED TO CLOCK LINES | 396 (1) | 5148 (13) |
| NUMBER OF CROSS POINTS BETWEEN DIGITAL DATA BUS LINES AND BRANCH LINES THEREOF | 975 | 0 |

In Table 2, the numerals within the parentheses represent ratios.

With the parallel driver architecture of the present invention, the bus width of the interface for the digital video data is enlarged and the 198 2-phase expansion circuits (SPC) are driven in parallel, whereby the clock frequency is reduced from 2.1 MHz to 62.5 kHz while throughput is maintained.

In regard to the digital signal processing circuits placed on the input side of the DACs, 5148 transistors are connected to the clock lines driven at 62.5 kHz according to the parallel driver architecture of the present invention. On the other hand, with the conventional architecture, 396 transistors are connected to the clock lines of shift registers driven at 2.1 MHz.

If the product of the number of transistors connected to the clock lines and the clock frequency is calculated for each of these architectures, it will be found that the product is smaller for the parallel architecture. In other words, consumption of power that accompanies charging and discharging of the clock lines is less for the parallel architecture.

Further, with the parallel architecture, there is no interline coupling between the digital data bus lines and branch lines and therefore power relating to charging and discharging is zero.

Interline coupling, namely capacitance produced at locations where the wiring that transmits the digital data crosses the wiring that transmits other digital data, will now be described.

In the case of the example shown in FIG. 39, the bus width of the entered data is six bits, and the bus width of data after phase expansion, which is performed by the phase expansion circuit constituted by the shift register (66-bit Shift Register), data registers (DATA REGISTER) and load latches (LOAD LATCH), is 6×66 bits.

The number of cross points between the bus lines and branch lines at this time is 975. In general, if the bus width of entered data is n bits and the bus width of data output by the phase expansion circuit is k×n bits, then the number C of interline coupling locations is indicated by $$C=n(n-1)(k-1)/2.$$

In the above example, n=6, k=66 holds. In the case of the conventional arrangement in which the phase expansion circuit is constituted by bus lines and data latches connected to the bus lines, the number of locations of interline coupling cannot be reduced.

By contrast, the number of locations of interline coupling are zero in the present invention, as a result of which less power is consumed.

In general, a parallel architecture is accompanied by an increase in the scale of the circuitry. (If the clock frequency is made 1/n, it is required that the scale of the circuitry be increased by a factor of n in order to obtain the same throughput.) In the case of this digital interface, however, the number of transistors is about 8600 with the conventional architecture and is 9900 with the parallel driver architecture, meaning that the increase brought about by the parallel architecture is not that great.

Figure 50:
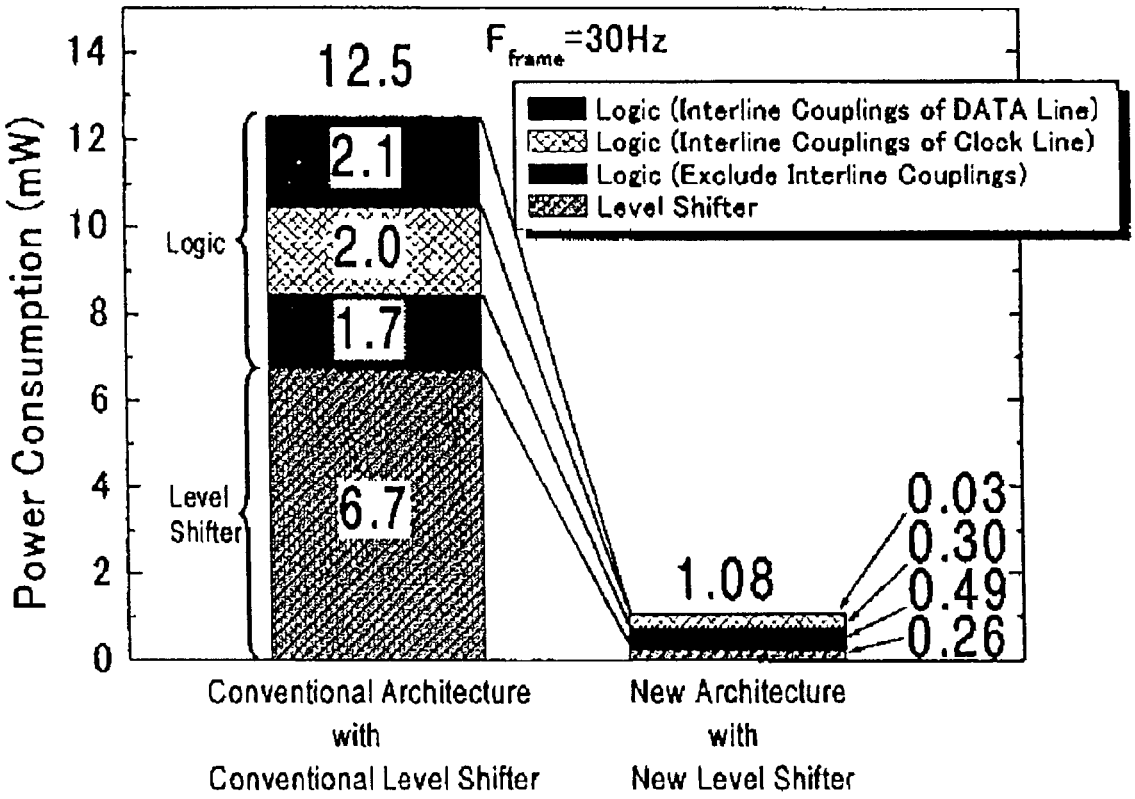
FIG. 50 is a graph for making a comparison between the display device of FIG. 39 and the display device of FIG. 45 with respect to the power consumption of a digital signal processor integrated on a display substrate.

FIG. 50 is a comparison between power consumption of a digital signal processing circuit in the parallel digital data driver architecture of the present invention and that in the conventional architecture.

In the logic portion exclusive of the lever shifter, power consumption is reduced from 5.8 to 0.82 mW inclusive of charging and discharging of parasitic capacitance.

The end result is that power consumed by the digital signal logic circuit can be reduced from 12.5 to 1.08 mW per panel by adopting the parallel digital data driver architecture of the present invention.

Figure 49:
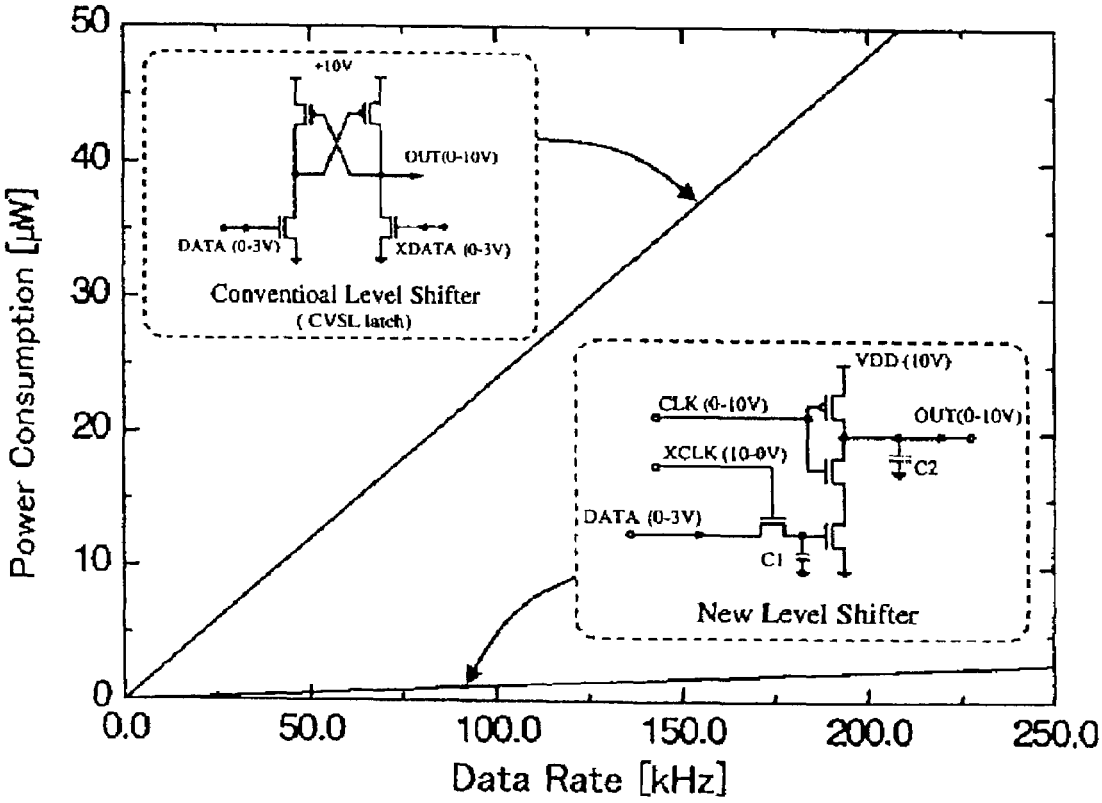
FIG. 49 is a graph that compares the power consumption of a lever converter included in the arrangement of FIG. 48 and the power consumption of the conventional level converter circuit shown in FIG. 44.

The power consumption [of the level shifter circuit (New Level Shifter) enclosed by the broken line in FIG. 49] per element of the new level shifter (L/S) illustrated in FIG. 46 is as depicted in FIG. 49. With the new level shifter, power consumption is on the order of several microwatts at a data rate of 200 kHz. With the conventional level shifter shown in FIG. 44, power consumption is 25 μW at a data rate of 100 kHz, 35 μW at a data rate of 150 kHz and 47 μW at a data rate of 200 kHz, as illustrated in comparison with FIG. 46.

In the case of the architecture of the present invention, the maximum operating clock on the display substrate (glass substrate) is 62.5 kHz. This is a great reduction in comparison with the 2 MHz of the prior art. This broadens the operating margin of the circuit.

Figure 48:
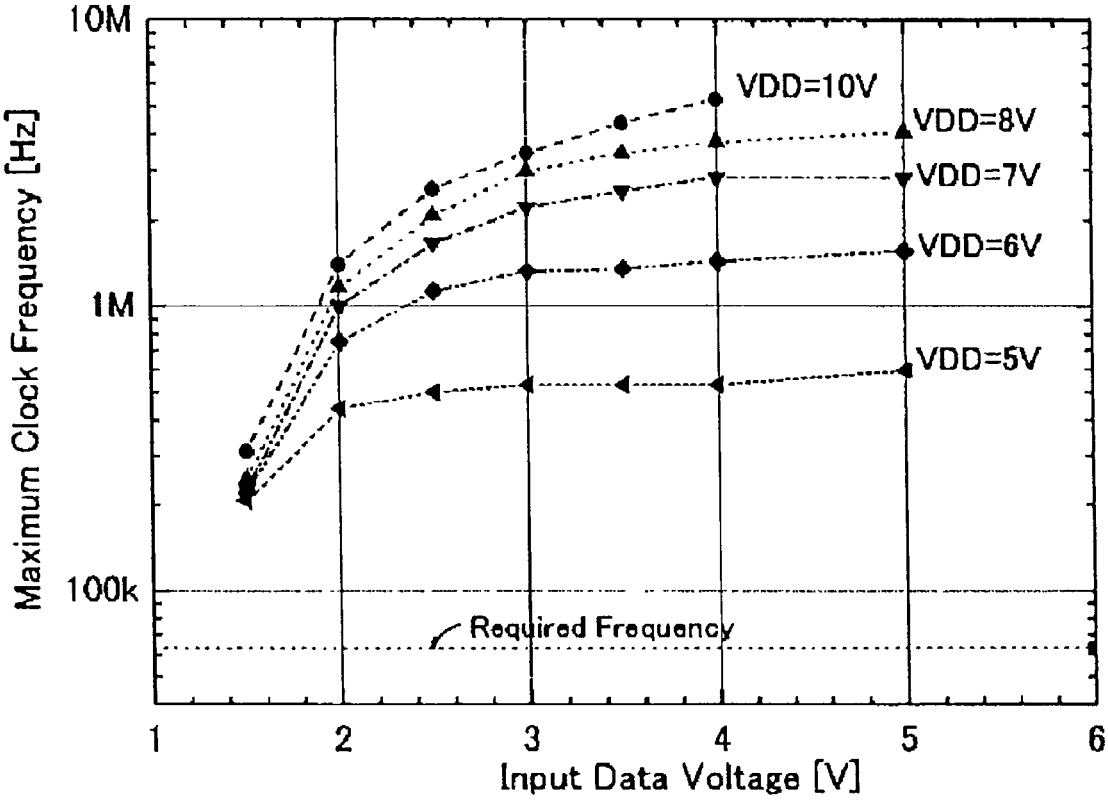
FIG. 48 is a graph illustrating the result of measuring the maximum operating frequency of the 1-to-2 serial/parallel converter circuit shown in FIG. 46.

FIG. 48 illustrates the result of measuring the maximum clock frequency of the 2-phase expansion circuit (SPC) having the level converting function. It will be understood from FIG. 48 that operation is at a frequency greater than 3 MHz when the input signal voltage (Input Data Voltage) is 3 V. Further, it will be understood that it is possible to make the power-supply voltage VDD less than 10 V. Power consumption can be reduced by thus lowering the power-supply voltage.

Though the present invention has been described in line with the foregoing embodiments, the invention is not limited to these embodiments and it goes without saying that the invention covers various modifications and changes that would be obvious to those skilled in the art within the scope of the claims.

The meritorious effects of the present invention are summarized as follows.

The present invention provides a number of advantages, which will now be set forth.

A first advantage is that it is possible to achieve a large-scale reduction in IC cost by providing a controller IC, which has an internal (built-in) memory, together with a combined driver and display device having an internal DAC.

A second advantage is that readout frequency is lowered and the power consumption of an interface circuit reduced by enlarging the width of the bus from the controller IC having the internal memory.

A third advantage is that effects of EMI can be neglected. The reason for this is that the frequency of data processing is reduced by utilizing a larger bus. When processing frequency declines, EMI noise is diminished sharply and therefore the effects of EMI become negligible.

A fourth advantage is that the same process can fabricate the interior of the substrate. Conventionally, in a case where various circuit elements are formed, various processes are used in conformity with the voltages employed by the various circuit groups. Since the frequency of processing is low in the present invention, the device operates without difficulty even if all of the circuit groups are fabricated with a single fabrication process made to conform to the circuit group that requires the highest voltage fabricates.

A fifth advantage is an improvement in the reliability of the display device. The reason for this is that the present invention is capable of suppressing the operating frequency of the circuits. When the operating frequency is low, stress imposed upon the elements declines and, hence, reliability improves. A simple estimation demonstrates that there is a proportional relationship between the rate of decline in frequency and the rate of increase in time over which continuous use is possible. That is, reliability rises when frequency falls. Further, the aforementioned fact that the effects of EMI vanish also plays a major role in enhancing reliability.

A sixth advantage is that providing a voltage-current converting circuit can drive current-driven elements.

The above-mentioned advantages make it possible to realize a high-definition, multicolor, low-cost display device that consumes little power.

As many apparently widely different embodiments of the present invention can be made without departing from the spirit and scope thereof, it is to be understood that the invention is not limited to the specific embodiments thereof except as defined in the appended claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items might fall under the modifications aforementioned.

What is claimed is:

1. A display device comprising:

a display device substrate provided with a display area in which a plurality pixels are arrayed in M rows and N columns in the form of a matrix at cross points of a plurality (N) of data lines and a plurality (M) of scanning lines; and a controller unit having a display memory for storing (M×N) pixels of B-bit grayscale display data, for a total of (M×N×B) bits, an output buffer for reading data out of said display memory and outputting this data to said display device substrate, and a controller for controlling said display memory and said output buffer as well as managing communication and control with a host device;

digital display data being transferred from the output buffer of said controller unit to said display device substrate via a data bus having a bit width of (N×B)/(P×S) bits obtained by dividing (N×B) bits, which correspond to one row of bits in the (M×N×B)-number of bits of said display memory, by the product of a block dividing number S and P-number of phases;

said display device substrate including a data-line driver circuit for driving data lines of the display area, said data-line driver circuit comprising:

(N×B)/(P×S) number of P-phase expansion circuits, each including:

P-number of level shift circuits, connected in common with one data line of the data bus, for level-shifting the amplitudes of P-phase signals output from said output buffer and received sequentially via the data line to respective ones of signals having a higher amplitude; and latch circuits for latching respective ones of outputs of said P-number of lever shifter circuits in accordance with a driving clock, expanding P-phase serial bit data into level-shifted P-bit parallel data, and latching and outputting this data;

(N×B)/S-bit data being output in parallel from (N×B)/(P×S)-number of said P-phase expansion circuits provided in correspondence with the data bus having the bit width of (N×B)/(P×S) bits;

(N/S)-number of said digital/analog converter circuits, provided for (N×B)/(P×S)-number of said P-phase expansion circuits, each of said digital/analog converter circuits receiving B-bit data from said P-phase expansion circuits, for outputting an analog signal; and a selector circuit, receiving outputs of (N/S)-number of said digital/analog converter circuits as inputs and having N-number of outputs connected to N-number of data lines of the display area, for supplying outputs of (N/S)-number of said digital/analog converter circuits to a group of data lines of the display area sequentially in a time obtained by division by the block dividing number S, wherein said P-phase expansion circuit includes as said level shift circuits:

first to third switch elements connected serially between a high-voltage power source and low-voltage power-supply;

a first capacitor connected to a connection point between said first and second switch elements;

a fourth switch element connected between an input terminal, to which an input signal is supplied, and a control terminal of said third switch element; and a second capacitor connected to a connection point between the control terminal of said third switch element and said fourth switch element;

wherein a first sampling control signal is supplied to both a control terminal of said first switch element and a control terminal of said second switch element, whereby one of these switch elements is turned off when the other is turned on;

a second sampling control signal is supplied to a control terminal of said fourth switch; and terminal voltage of said first capacitor is extracted as an output signal directly or indirectly.

2. A display device comprising:

a display device substrate provided with a display area in which a plurality pixels are arrayed in M rows and N columns in the form of a matrix at cross points of a plurality (N) of data lines and a plurality (M) of scanning lines; and a controller unit having a display memory for storing (M×N) pixels of B-bit grayscale display data, for a total of (M×N×B) bits, an output buffer for reading data out of said display memory and outputting this data to said display device substrate, and a controller for controlling said display memory and said output buffer as well as managing communication and control with a host device;

digital display data being transferred from the output buffer of said controller unit to said display device substrate via a data bus having a bit width of (N×B)/(P×S) bits obtained by dividing (N×B) bits, which correspond to one row of bits in the (M×N×B)-number of bits of said display memory, by the product of a block dividing number S and P-number of phases;

said display device substrate including a data-line driver circuit for driving data lines of the display area, said data-line driver circuit comprising:

(N×B)/(P×S) number of P-phase expansion circuits, each including:

P-number of level shift circuits, connected in common with one data line of the data bus, for level-shifting the amplitudes of P-phase signals output from said output buffer and received sequentially via the data line to respective ones of signals having a higher amplitude; and latch circuits for latching respective ones of outputs of said P-number of lever shifter circuits in accordance with a driving clock, expanding P-phase serial bit data into level-shifted P-bit parallel data, and latching and outputting this data;

(N×B)/S-bit data being output in parallel from (N×B)/(P×S)-number of said P-phase expansion circuits provided in correspondence with the data bus having the bit width of (N×B)/(P×S) bits;

(N/S)-number of said digital/analog converter circuits, provided for (N×B)/(P×S)-number of said P-phase expansion circuits, each of said digital/analog converter circuits receiving B-bit data from said P-phase expansion circuits, for outputting an analog signal; and a selector circuit, receiving outputs of (N/S)-number of said digital/analog converter circuits as inputs and having N-number of outputs connected to N-number of data lines of the display area, for supplying outputs of (N/S)-number of said digital/analog converter circuits to a group of data lines of the display area sequentially in a time obtained by division by the block dividing number S, wherein said P-phase expansion circuit includes as said level shift circuits:

first to third switch elements connected serially between a high-voltage power source and a low-voltage power-supply;

a first capacitor connected to a connection point between said first and second switch elements;

a fourth switch element connected between an input terminal, to which an input signal is supplied, and a control terminal of said third switch element; and a second capacitor connected to a connection point between the control terminal of said third switch element and said fourth switch element;

wherein a first sampling control signal is supplied to both a control terminal of said first switch element and a control terminal of said second switch element;

said first switch element is turned on, said second switch element is turned off and said first capacitor is charged to the voltage of the high-voltage power-supply when the first sampling control signal is a second logic value;

a second sampling control signal is supplied to a control terminal of said fourth switch element;

said fourth switch element is turned on and said second capacitor is charged by the input signal voltage when the second sampling control signal is a first logic value;

said first switch element is turned off and said second switch element is turned on when the first sampling control signal is the first logic value; and terminal voltage of said first capacitor prevailing at this time is extracted as an output signal directly or indirectly.

3. A display device comprising:

a display device substrate provided with a display area in which a plurality pixels are arrayed in M rows and N columns in the form of a matrix at cross points of a plurality (N) of data lines and a plurality (M) of scanning lines; and a controller unit having a display memory for storing (M×N) pixels of B-bit grayscale display data, for a total of (M×N×B) bits, an output buffer for reading data out of said display memory and outputting this data to said display device substrate, and a controller for controlling said display memory and said output buffer as well as managing communication and control with a host device;

digital display data being transferred from the output buffer of said controller unit to said display device substrate via a data bus having a bit width of (N×B)/(P×S) bits obtained by dividing (N×B) bits, which correspond to one row of bits in the (M×N×B)-number of bits of said display memory, by the product of a block dividing number S and P-number of phases;

said display device substrate including a data-line driver circuit for driving data lines of the display area, said data-line driver circuit comprising:

(N×B)/(P×S) number of P-phase expansion circuits, each including:

P-number of level shift circuits, connected in common with one data line of the data bus, for level-shifting the amplitudes of P-phase signals output from said output buffer and received sequentially via the data line to respective ones of signals having a higher amplitude; and latch circuits for latching respective ones of outputs of said P-number of lever shifter circuits in accordance with a driving clock, expanding P-phase serial bit data into level-shifted P-bit parallel data, and latching and outputting this data;

(N×B)/S-bit data being output in parallel from (N×B)/(P×S)-number of said P-phase expansion circuits provided in correspondence with the data bus having the bit width of (N×B)/(P×S) bits;

(N/S)-number of said digital/analog converter circuits, provided for (N×B)/(P×S)-number of said P-phase expansion circuits, each of said digital/analog converter circuits receiving B-bit data from said P-phase expansion circuits, for outputting an analog signal; and a selector circuit, receiving outputs of (N/S)-number of said digital/analog converter circuits as inputs and having N-number of outputs connected to N-number of data lines of the display area, for supplying outputs of (N/S)-number of said digital/analog converter circuits to a group of data lines of the display area sequentially in a time obtained by division by the block dividing number S, wherein said P-phase expansion circuit comprises a 2-phase expansion circuit, said 2-phase expansion circuit comprising:

first and second level shift circuits having input terminals thereof connected in common with a data line;

said first level shift circuit including:

first to third switch elements connected serially between a high-voltage power-supply and a low-voltage power-supply;

a first capacitor connected to a connection point between said first and second switch elements;

a fourth switch element connected between an input terminal, to which an input signal is supplied, and a control terminal of said third switch element; and a second capacitor connected to a connection point between the control terminal of said third switch element and said fourth switch element;

wherein a first sampling control signal is supplied to both a control terminal of said first switch element and a control terminal of said second switch element;

said first switch element is turned on, said second switch element is turned off and said first capacitor is charged to the voltage of the high-voltage power-supply when the first sampling control signal is a second logic value;

a second sampling control signal, which is the complement of the first sampling control signal, is supplied to a control terminal of said fourth switch element;

said fourth switch element is turned on and said second capacitor is charged by the input signal voltage when the second sampling control signal is a first logic value;

said first switch element is turned off and said second switch element is turned on when the first sampling control signal is the first logic value; and terminal voltage of said first capacitor prevailing at this time is extracted as an output signal directly or indirectly;

said second level shift circuit having a circuit structure identical with that of said first level shift circuit;

an input signal being applied commonly to both of said first and second sampling level converting circuits; and the second sampling control signal being input commonly to the control terminal of said first switch element and the control terminal of said second switch element of said second level shift circuit, and the first sampling control signal being input to the control terminal of said fourth switch element of said second level shift circuit;

a first master/slave latch, in which an output signal of said first level shift circuit is loaded based upon the first sampling control signal, for outputting this signal based upon the second sampling control signal;

a latch for delivering the output signal of said first master/slave latch based upon the first sampling control signal; and a second master/slave latch, in which an output signal of said second level shift circuit is loaded based upon the second sampling control signal, for outputting this signal based upon the first sampling control signal.

* * * * *

UNITED STATES PATENT AND TRADEMARK OFFICE

CERTIFICATE OF CORRECTION

PATENT NO. : 7,259,740 B2
APPLICATION NO. : 10/261584
DATED : August 21, 2007
INVENTOR(S) : Hiroshi Haga, Kenichi Takatori and Hideki Asada It is certified that error appears in the above-identified patent and that said Letters Patent is hereby corrected as shown below:

Col. 9, line 50, delete "311" and insert -- 111 --

Col. 30, line 35, delete "11" and insert -- 110 --

Col. 31, line 58, delete "10" and insert -- 110 --

Col. 42, line 30, delete "f" and insert -- of --

Signed and Sealed this

Nineteenth Day of January, 2010

David J. Kappos

David J. Kappos
*Director of the United States Patent and Trademark Office*